US006523572B1

(12) United States Patent
Levin et al.

(10) Patent No.: US 6,523,572 B1
(45) Date of Patent: Feb. 25, 2003

(54) APPARATUS FOR INDUCING FORCES BY FLUID INJECTION

(75) Inventors: Daniel Levin, Haifa (IL); Yuvai Yassour, Haifa (IL)

(73) Assignee: Core Flow Ltd., Yokneam (IL)

( * ) Notice: Subject to any disclaimer, the term of this patent is extended or adjusted under 35 U.S.C. 154(b) by 9 days.

(21) Appl. No.: 10/070,264

(22) PCT Filed: Aug. 20, 2000

(86) PCT No.: PCT/IL00/00500

§ 371 (c)(1),
(2), (4) Date: Feb. 25, 2002

(87) PCT Pub. No.: WO01/14752

PCT Pub. Date: Mar. 1, 2001

(30) Foreign Application Priority Data

Aug. 25, 1999 (IL) ..... 131589

(51) Int. Cl.[7] ..... F15D 1/02

(52) U.S. Cl. ..... 138/37; 138/42; 366/336; 366/337; 366/338

(58) Field of Search ..... 138/37, 42, 39; 366/336–341

(56) References Cited

U.S. PATENT DOCUMENTS

| | | | | | |
|---|---|---|---|---|---|
| 1,877,567 | A | * | 9/1932 | Erbes | 138/37 |
| 3,785,405 | A | * | 1/1974 | Quinn | 137/13 |
| 4,314,587 | A | * | 2/1982 | Hackett | 138/137 |
| 4,334,897 | A | * | 6/1982 | Brady et al. | 261/109 |
| 4,600,076 | A | * | 7/1986 | Yamamoto et al. | 181/233 |
| 4,655,397 | A | * | 4/1987 | Gorney | 138/39 |
| 5,830,515 | A | * | 11/1998 | Pleasant et al. | 138/38 |

* cited by examiner

*Primary Examiner*—Patrick Brinson
(74) *Attorney, Agent, or Firm*—Reed Smith LLP

(57) ABSTRACT

An injection system used to generate an acrodynamically induced force, with accordance to the present invention, serving as an air-cushion non-contact supporting system. The system comprises a high pressure manifold (101), connected by high pressure pipe (103), to a high pressure source (102). A SASO-conduit (1), whose inlet (2) is connected to the high pressure manifold, and the outlet (3) is located on the injection-surface (104), of the injection system.

49 Claims, 27 Drawing Sheets

Radial SAGU

Tangential SAGU

Cross Section AB

Cross-Sectional Illustration accessory

Cross-Sectional Illustration accessory

Cross-Sectional Illustration

Cross-Sectional Illustration of the hook

Cross-Sectional Illustration

APPARATUS FOR INDUCING FORCES BY FLUID INJECTION

FIELD OF INVENTION

The present invention relates to the induction of forces by injection of fluids through a conduit having a unique internal geometry. More particularly, it relates to an apparatus and method of fluid injection aimed at producing and employing aerodynamically induced forces.

BACKGROUND OF THE INVENTION

Injection of fluids, liquids, and in particular gases, through one conduit or a plurality of conduits, is a common mean to produce an aerodynamically induced forces acting on objects. Without derogating generality, the present invention relates commonly to the injection of air, although in general the present invention can be applied in connection with other fluids too.

In order to produce an aerodynamically induced force, interaction between the out coming flow and a nearby object must be established. As an applied pressure difference drives the fluid through the conduit, the out coming flow interacts in a perpendicular manner with an object placed further apart from the conduit outlet. When the distance between the conduit outlet and the object facing the outlet is small, in the order of 5 lateral scales of the particular conduit outlet (or more), a jet flow is generated. This jet has a momentum defined by its mass flow rate and velocity. When such a jet impinges on an object, it exerts an aerodynamically induced force on the object. This exerted force depends on the momentum of the jet, as well as on the object specific geometry. A different effect occurs when the distance between the conduit outlet and the object surface is small, in the order of 1 lateral scale of the conduit outlet (or less). In such a case, the fluid is forced to turn sideways. In this cases, the object is also subjected to aerodynamically induced force.

Alternatively, when a fluid is injected parallel to the object surface, it is possible to produce aerodynamically induced force that is substantially parallel to the fluid motion. In such cases, the direction of this essentially "parallel-to-fluid-motion" aerodynamically induced force can be altered, according to the local induced pressure that is generated on the interacting surface of the object: It can locally be higher or lower pressure with respect to the average pressure acting on the object.

The design of an injecting system that aims at producing aerodynamically induced force incorporates various aspects, (a) the applied external driving pressure difference, (b) the internal geometric details of the specific conduit of the present invention, (c) the geometry of the conduit inlet and outlet sections, (d) the specific arrangement of the conduits when a plurality of conduits are used, etc. Such aspects and many more are all taken in consideration according to the engineering requirements for a specific application.

The only related prior art references having some relevance to the present invention deal with irrigation emitters only where the fluid passing through it is water which is practically incompressible (as opposed to air or other gases).

U.S. Pat. No. 3,896,999 (Barragan) disclosed an anti-clogging drip irrigation valve, comprising a wide conduit equipped with a plurality of partition means, integrally formed with the conduit wall, forming labyrinth conduits, in order to reduce the water pressure prior to its exit through the labyrinth conduits outlet.

U.S. Pat. No. 4,573,640 (Mehoudar) disclosed an irrigation emitter unit providing a labyrinth conduit similarly to the valve in U.S. Pat. No. 3,896,999. Examples of other devices providing labyrinth conduits for the purpose of providing a pressure drop along the conduit can be found in U.S. Pat. No. 4,060,200 (Mehoudar), U.S. Pat. No. 4,413,787 (Gilead et al.), U.S. Pat. No. 3,870,236 (Sahagun-Barragan), U.S. Pat. No. 4,880,167 (Langa), U.S. Pat. No. 5,620,143 (Delmer et al.), U.S. Pat. No. 4,430,020 (Robbins), U.S. Pat. No. 4,209,133 (Mehoudar), U.S. Pat. No. 4,718,608 (Mehoudar), U.S. Pat. No. 5,207,386 (Mehoudar).

In a labyrinth conduit the aerodynamic resistance is substantially large due to the viscous friction exerted by the walls of the conduit (acting opposite to the direction of the flow), and as the passage becomes tortuous and lengthier (that's the essential feature of a labyrinth) more wall contact surface is acting on the flow, increasing the viscous friction. In some cases cavities are provided for intercepting contaminants and for freeing the flow passage. None of these patents, which basically deal with two dimensional geometry (the third being either very small or degenerated), mention or make use of a vortical aerodynamic blockage mechanism, that is an essential feature of the present invention.

It is emphasized that while the above mentioned patents deal with the delivery of water through the conduit, the present invention seeks to provide and exploit aerodynamically induced forces, with the fluid—air in most cases—merely serving as the means for generating these forces.

In an article titled "A FLOW VISUALIZATION STUDY OF THE FLOW IN A 2D ARRAY OF FINS" (S. Brokman, D Levin, Experiments in Fluids 14, 241–245 (1993)) a study of the flow field in a 2D arrangement of fins was carried out by means of flow visualization in a vertical flow tunnel. The study was related to an earlier studies that examined the fin arrangement as a conceptual heat sink. The above mentioned study went further to examine the complex flow field structure in order to obtain a better understanding of the heat convection process. A model was built of several series of fins, simulating a spatially unlimited multi-cell structure. Two main flow structures were observed—a flow separation from the leading edge of each fin, which due to the influence of neighboring fins, was reattached to the fin, creating a closed separation zone, and a vortex, that filled that closed separation zone.

The Mass Flow Rate (hereafter referred to as MFR) through the conduit (or conduits), the internal pressure drop that is developed within the conduit and the out-coming fluid velocity that define the momentum of the injected fluid as well as the aerodynamically induced force characteristics, are governed by the dynamic laws of fluid flows. Practically speaking, the characteristics of the aerodynamically induced force depend substantially on the fluid characteristics, its dynamic behavior due to the applied driving pressure, on one hand, and on the other hand on the internal geometry of the special conduit of the present invention.

In Israeli Patent Application titled SELF ADAPTIVE SEGMENTED ORIFICE DEVICE AND METHOD (hereafter referred to as SASO), simultaneously filed with the present invention, and incorporated herein by reference, a novel flow control device is disclosed. A typical embodiment of a SASO-device comprises a fluid conduit, having an inlet and outlet, said conduit provided with a plurality of fins mounted on the internal wall of said conduit, said fins arranged in two arrays substantially opposing each other, wherein each of the fins of either one of said fin arrays, excluding the fin nearest to the inlet and the fin nearest to the outlet of said conduit, is positioned opposite one of a plurality of cavities, each cavity defined between two consecutive fins of the other substantially opposite array of fins, and a portion of said internal wall, wherein when a fluid flows through said device a plurality of vortices are formed, each vortex positioned in one of said cavities, said vortices existing at least temporarily during said fluid flow through said device, and a thin core-flow is generated between the two opposite arrays of vortices. The unique advantages of SASO-technology are that it effectively decreases MFR through the SASO-conduit, and most importantly, with respect to fluid injection aimed at generating aerodynamically induced forces, it significantly increases the internal pressure drop within the conduit (hereafter referred to as $\Delta P$), in comparison with conventional conduits with about the same lateral diameter.

It is the object of the present invention to incorporate SASO-technology in injection systems to produce aerodynamically induced forces, that would improve the performance of such systems which are in common industrial use, and introducing novel systems implementing aerodynamically induced forces.

Furthermore, it is another object of the present invention to provide a wide scope of opportunities to adopt SASO-technology for new applications that could not be obtained with common technologies.

Basically the apparatus and method disclosed herein can operate with any fluid, but air is mainly and essentially the fluid to be considered for a wide scope of applications that take advantage of the special characteristics of the SASO-technology with respect to the aerodynamically induced forces of the present invention.

BRIEF DESCRIPTION OF THE INVENTION

It is thus provided, in accordance with a preferred embodiment of the present invention, an apparatus for generating a fluid injection induced forces comprising:

a high pressure source; a high pressure reservoir fluidically connected to said high pressure source; an injection surface; at least one conduit of a plurality of conduits;

wherein said conduit has an outlet positioned on said injection surface and an inlet fluidically connected to said high pressure reservoir and is provided with a plurality of fins mounted on the internal wall of said conduit said fins arranged in two arrays substantially opposite each other; wherein each of the fins of either one of said fin arrays excluding the fin nearest to the inlet and the fin nearest to the outlet of said conduit is positioned substantially opposite one of a plurality of cavities each cavity defined between two consecutive fins of one of said arrays of fins and a portion of said conduit internal walls wherein said two opposing fin arrays are arranged asymmetrically; whereby when fluid flows through said conduit a plurality of vortices are formed within said cavities one vortex in a cavity said vortices existing at least temporarily during said flow thus forming an aerodynamic blockage allowing a central core-flow between said vortices and the tips of said fins suppressing the flow in a one-dimensional manner, thus limiting the mass flow rate and maintaining a substantial pressure drop within the conduit, whereby when an object blocks said outlet the flow stops and said vortices dissipate thus said object is effectively forced away by the high pressure aerodynamically induced force whereas when the outlet is not blocked said vortices are formed and aerodynamically blocking the flow through said conduit and whereas said object almost blocks said outlet said vortices substantially collapse and the internal pressure drop through said conduit is gradually changed with respect to the gap between the said injection surface and the facing surface of said object thus said conduit respond as a fluidic return spring when injecting from close distance toward an object; and whereby when said apparatus equipped with at least one of a plurality of said conduits whereas one or a portion of said conduits are not physically blocked by said object the mass flow supply is significantly reduced as said open conduit are aerodynamically blocked by the said vortices.

Furthermore, in accordance with a preferred embodiment of the present invention, said fluid is air.

Furthermore, in accordance with a preferred embodiment of the present invention, said fins are L-shaped where a thin core-flow is suppressed in a two-dimensional manner by said vortices.

Furthermore, in accordance with a preferred embodiment of the present invention, said fins are U-shaped where a thin core-flow is suppressed in a two-dimensional manner by said vortices.

Furthermore, in accordance with a preferred embodiment of the present invention, said conduit follows a straight path.

Furthermore, in accordance with a preferred embodiment of the present invention, said conduit follows a tortuous path.

Furthermore, in accordance with a preferred embodiment of the present invention, said conduit cross-section is substantially rectangular.

Furthermore, in accordance with a preferred embodiment of the present invention, said conduit cross-section is substantially polygonal.

Furthermore, in accordance with a preferred embodiment of the present invention, said conduit cross-section is substantially circular.

Furthermore, in accordance with a preferred embodiment of the present invention, the downstream distribution of said conduit cross-section area is uniform.

Furthermore, in accordance with a preferred embodiment of the present invention, the downstream distribution of said conduit cross-section area is divergent.

Furthermore, in accordance with a preferred embodiment of the present invention, the downstream distribution of said conduit cross-section area is convergent.

Furthermore, in accordance with a preferred embodiment of the present invention, said fins are substantially perpendicular to said internal wall of the conduit.

Furthermore, in accordance with a preferred embodiment of the present invention, said fins are inclined with respect both to the general core-flow direction of motion and to the conduit internal walls.

Furthermore, in accordance with a preferred embodiment of the present invention, the average thickness of each of said fins is smaller in order with comparison to the distance between said fin and the next consecutive fin of the same fin array.

Furthermore, in accordance with a preferred embodiment of the present invention, said fin cross-section is substantially rectangular.

Furthermore, in accordance with a preferred embodiment of the present invention, said fin cross-section is substantially trapezoidal.

Furthermore, in accordance with a preferred embodiment of the present invention, said fin cross-section is substantially concave at least on one side.

Furthermore, in accordance with a preferred embodiment of the present invention, the distance between two consecutive fins is constant along the conduit.

Furthermore, in accordance with a preferred embodiment of the present invention, the distance between two consecutive fins varies along the conduit.

Furthermore, in accordance with a preferred embodiment of the present invention, the span of each of said fins is uniform along the conduit.

Furthermore, in accordance with a preferred embodiment of the present invention, the span of said fins varies along the conduit.

Furthermore, in accordance with a preferred embodiment of the present invention, the span of said fin is laterally uniform.

Furthermore, in accordance with a preferred embodiment of the present invention, the span of said fin laterally varies.

Furthermore, in accordance with a preferred embodiment of the present invention, the tips of said fins are sharp.

Furthermore, in accordance with a preferred embodiment of the present invention, the tips of said fins are blunt.

Furthermore, in accordance with a preferred embodiment of the present invention, the tips of said fins are curved.

Furthermore, in accordance with a preferred embodiment of the present invention, each of said fins substantially blocks half of the conduit lateral width.

Furthermore, in accordance with a preferred embodiment of the present invention, the two opposite fin arrays do not overlap.

Furthermore, in accordance with a preferred embodiment of the present invention, the two opposite fin arrays overlap.

Furthermore, in accordance with a preferred embodiment of the present invention, the ratio between the fin span and the gap between that fin and a consecutive fin of the same array of fins is in the range of 1:1 to 1:2.

Furthermore, in accordance with a preferred embodiment of the present invention, the said ratio is about 1:1.5.

Furthermore, in accordance with a preferred embodiment of the present invention, the absolute value of the gap between the virtual plane connecting the fin tips of one of said two opposite fin arrays and the virtual plane connecting the fin tips of the second of said two opposite fin arrays is of smaller order than the lateral width of said conduit.

Furthermore, in accordance with a preferred embodiment of the present invention, said absolute value of said gap is not more than 20% of the adjacent lateral width of said conduit.

Furthermore, in accordance with a preferred embodiment of the present invention, the size of each of said cavities is slightly smaller than the integrally defined natural scales associated with the vorticity of the vortex formed inside said cavity.

Furthermore, in accordance with a preferred embodiment of the present invention, said conduit passive dimension defined as the dimension substantially parallel to said vortices virtual axes and substantially perpendicular to said core-flow motion is in the order of the fins span.

Furthermore, in accordance with a preferred embodiment of the present invention, said passive dimension is substantially larger than the other lateral dimension of the conduit that is substantially perpendicular to both the vortex axis and to the core-flow motion.

Furthermore, in accordance with a preferred embodiment of the present invention, said passive dimension follows a close substantially annular route.

Furthermore, in accordance with a preferred embodiment of the present invention, when Reynolds Number is increased inside said conduit further secondary vortices are formed.

Furthermore, in accordance with a preferred embodiment of the present invention, said core-flow downstream motion is substantially sinusoidal.

Furthermore, in accordance with a preferred embodiment of the present invention, the sinusoidal core-flow strongly interacts with the fins by local impingement of the core flow with the surfaces of the fins facing its motion.

Furthermore, in accordance with a preferred embodiment of the present invention, when Reynolds Number is increased inside said conduit said core-flow breaks down locally and frequently generates unsteady secondary vortices intensively interacting with the core-flow or impinging on the surface of the facing fin.

Furthermore, in accordance with a preferred embodiment of the present invention, said apparatus is used to generate an air cushion.

Furthermore, in accordance with a preferred embodiment of the present invention, at least two air-cushion pads are generated.

Furthermore, in accordance with a preferred embodiment of the present invention, said apparatus is used for air bearing or air cushion.

Furthermore, in accordance with a preferred embodiment of the present invention, said apparatus is conveyed along a predefined pathway without physical contact by floating over an air cushion produced by the apparatus substantially reducing the friction.

Furthermore, in accordance with a preferred embodiment of the present invention, said injection surface defines a predetermined pathway producing an air cushion on which an object is conveyed without physical contact thus substantially reducing friction.

Furthermore, in accordance with a preferred embodiment of the present invention, it is incorporated with another apparatus as claimed in claim 1, said apparati positioned opposite each other, the injection surfaces defining between them a pathway whereby a flat object is conveyed between these surfaces without physical contact with the surfaces.

Furthermore, in accordance with a preferred embodiment of the present invention, a plurality of said conduits are positioned diagonally with respect to said injection surfaces to induce an aerodynamic conveying force in a predetermined direction.

Furthermore, in accordance with a preferred embodiment of the present invention, at least two substantially perpendicular injection surface are used to provide non-contact support or positioning control in a two dimensional manner.

Furthermore, in accordance with a preferred embodiment of the present invention, said injection surface is cylindrically shaped.

Furthermore, in accordance with a preferred embodiment of the present invention, said injection surfaces is the inner cylindrical surface of the stator component of a spindle.

Furthermore, in accordance with a preferred embodiment of the present invention, it is incorporated with another apparatus as claimed in claim 1, wherein injection surfaces of said apparati are cylindrically shaped and are positioned coaxially so that one injection surface is concave and the second injection surface is convex.

Furthermore, in accordance with a preferred embodiment of the present invention, the inner cylindrical injection surface rotates.

Furthermore, in accordance with a preferred embodiment of the present invention, said object is a wafer or a printed circuit board.

Furthermore, in accordance with a preferred embodiment of the present invention, said object is a car carriage or a container or any other storage case.

Furthermore, in accordance with a preferred embodiment of the present invention, said object is a paper sheet or a plastic sheet or a metallic plate including printing plates.

Furthermore, in accordance with a preferred embodiment of the present invention, said air injection induced force is applied in the direction of gravity.

Furthermore, in accordance with a preferred embodiment of the present invention, air injection induced force is applied irrespectful of the gravity.

Furthermore, in accordance with a preferred embodiment of the present invention, air cushion is used for positioning control without contact of said object, said object being stationary.

Furthermore, in accordance with a preferred embodiment of the present invention, air cushion is used for lateral positioning control without contact of said object, said object being conveyed by said apparatus.

Furthermore, in accordance with a preferred embodiment of the present invention, one or a plurality of said conduits that produce fluid injection force act in the gravity direction and are combined with at least one of a plurality of simple vacuum ports that produce fluid suction force that acts against gravity direction whereby when both injection and suction induced force are actuated simultaneously the combined fluid induced force acting on the upper surface of an object hold the object at a stable equilibrium position and balance the object own weight where said object suspended without contact.

Furthermore, in accordance with a preferred embodiment of the present invention, fluid injection by jets is used to hold said object with contact to a surface.

Furthermore, in accordance with a preferred embodiment of the present invention, fluid injection is applied from a distance smaller then the diameter of the injection conduit.

Furthermore, in accordance with a preferred embodiment of the present invention, it is provided an apparatus for generating a fluid injection induced forces comprising:

a high pressure source; a high pressure reservoir fluidically connected to said high pressure source; an injection surface; at least one conduit of a plurality of conduits;

wherein said conduit has an outlet positioned on said injection surface and an inlet fluidically connected to said high pressure reservoir said conduit is provided with a helical fin mounted on the internal wall of said conduit thus a helical cavity is formed defined by said helical fin and said internal wall; wherein when a fluid flows through said conduit a helical vortex is formed within said helical cavity said helical vortex exists at least temporarily during said flow thus forming an aerodynamic blockage allowing a central core-flow between said helical vortex and the tip of said helical fin and suppressing the flow in a two-dimensional manner, thus limiting the mass flow rate and maintaining a substantial pressure drop within the conduit; whereby said core flow flows through a central passage defined by the helical fin internal edge and may locally bypass an obstruction in said central passage by following the helical passage adjacent the helical fin; whereby when an object blocks the outlet of said conduit the flow stops said helical vortex dissipates thus said object is effectively forced away by the high pressure aerodynamically induced force whereas when the outlet is not blocked said helical vortex is formed and aerodynamically partially blocks the flow through said conduit and whereas when said object almost blocks the outlet of said conduit said helical vortex substantially collapses and the internal pressure drop through said conduit is substantially reduced with respect to the internal pressure drop when the vortex existed thus said conduit responds as a fluidic return spring when injecting towards a close object.

Furthermore, in accordance with a preferred embodiment of the present invention, said fluid is air.

Furthermore, in accordance with a preferred embodiment of the present invention, at least one barrier of a plurality of barriers is mounted substantially normally to said helical fin surface thus locally blocking the helical path to prevent the flow from following the helical path and thus said helical vortex locally splits by said barriers to at least two fragments.

Furthermore, in accordance with a preferred embodiment of the present invention, at least one barrier out of two barriers is mounted substantially normally to the fin surface on one of the two ends of said helical fin to act as anchorage for said helical vortex.

Furthermore, in accordance with a preferred embodiment of the present invention, said conduit follows a straight path.

Furthermore, in accordance with a preferred embodiment of the present invention, said conduit follows a tortuous path.

Furthermore, in accordance with a preferred embodiment of the present invention, said conduit cross-section is substantially circular.

Furthermore, in accordance with a preferred embodiment of the present invention, said conduit cross-section is substantially rectangular.

Furthermore, in accordance with a preferred embodiment of the present invention, said conduit cross-section is substantially polygonal.

Furthermore, in accordance with a preferred embodiment of the present invention, the downstream distribution of said conduit cross-section area is uniform.

Furthermore, in accordance with a preferred embodiment of the present invention, the downstream distribution of said conduit cross-section area is divergent.

Furthermore, in accordance with a preferred embodiment of the present invention, the downstream distribution of said conduit cross-section area is convergent.

Furthermore, in accordance with a preferred embodiment of the present invention, said helical fin is substantially perpendicular to said internal wall of the conduit.

Furthermore, in accordance with a preferred embodiment of the present invention, said helical fin is inclined with respect both to the general core-flow direction of motion and the to conduit wall.

Furthermore, in accordance with a preferred embodiment of the present invention, said helical fin thickness is of smaller order with comparison to the helical fin pitch.

Furthermore, in accordance with a preferred embodiment of the present invention, said helical fin cross-section is substantially rectangular.

Furthermore, in accordance with a preferred embodiment of the present invention, said helical fin cross-section is substantially trapezoidal.

Furthermore, in accordance with a preferred embodiment of the present invention, said helical fin cross-section is substantially concave at least on one side.

Furthermore, in accordance with a preferred embodiment of the present invention, said helical fin pitch is constant along the conduit.

Furthermore, in accordance with a preferred embodiment of the present invention, said helical fin pitch varies along the conduit.

Furthermore, in accordance with a preferred embodiment of the present invention, the span of said helical fin is uniform.

Furthermore, in accordance with a preferred embodiment of the present invention, the span of said helical fin varies along the conduit.

Furthermore, in accordance with a preferred embodiment of the present invention, the tip of said helical fin is sharp.

Furthermore, in accordance with a preferred embodiment of the present invention, the tip of said helical fin is blunt.

Furthermore, in accordance with a preferred embodiment of the present invention, the tip of said helical fin is curved.

Furthermore, in accordance with a preferred embodiment of the present invention, said helical fin span is substantially half of the said conduit lateral width.

Furthermore, in accordance with a preferred embodiment of the present invention, the ratio between the helical fin span and the helical fin pitch is in the range of 1:1 to 1:2.

Furthermore, in accordance with a preferred embodiment of the present invention, the said ratio is about 1:1.5.

Furthermore, in accordance with a preferred embodiment of the present invention, the central passage defined by the helical fin tip is of smaller order in comparison with the hydraulic diameter of said conduit.

Furthermore, in accordance with a preferred embodiment of the present invention, said gap is not more than 30% of the adjacent lateral width of said conduit.

Furthermore, in accordance with a preferred embodiment of the present invention, the size of said helical cavity is slightly smaller than the integrally defined natural lateral scales associated with the vorticity of the said helical vortex.

Furthermore, in accordance with a preferred embodiment of the present invention, when Reynolds Number is increased inside said conduit further secondary vortices are formed.

Furthermore, in accordance with a preferred embodiment of the present invention, the core-flow strongly interacts with said helical fin by local impingement with the surface of the helical fin facing its motion.

Furthermore, in accordance with a preferred embodiment of the present invention, when Reynolds Number is increased inside said conduit said core-flow breaks down locally and frequently generates unsteady secondary vortices, intensively interacting with the core-flow or impinging on the facing fin.

Furthermore, in accordance with a preferred embodiment of the present invention, said apparatus is used to generate at least one air cushion.

Furthermore, in accordance with a preferred embodiment of the present invention, two air-cushion are generated.

Furthermore, in accordance with a preferred embodiment of the present invention, said apparatus is used in an air bearing or air cushion application.

Furthermore, in accordance with a preferred embodiment of the present invention, said apparatus is moved on a pathway without contact floating over an air cushion produced by the apparatus.

Furthermore, in accordance with a preferred embodiment of the present invention, said injection surface defines a pathway producing an air cushion on which an object is conveyed without contact.

Furthermore, in accordance with a preferred embodiment of the present invention, two opposite flat injection surfaces are provided to define a pathway between said surfaces whereby a flat object is conveyed with no contact.

Furthermore, in accordance with a preferred embodiment of the present invention, said plurality of conduits are positioned diagonally with respect to said injection surfaces to induce an aerodynamic conveying force in a predetermined direction.

Furthermore, in accordance with a preferred embodiment of the present invention, at least two substantially perpendicular injection surface are used to provide non-contact support or positioning control in a two dimensional manner.

Furthermore, in accordance with a preferred embodiment of the present invention, said injection surface is cylindrically shaped.

Furthermore, in accordance with a preferred embodiment of the present invention, said injection surface is the inner cylindrical surface of the stator component of a spindle.

Furthermore, in accordance with a preferred embodiment of the present invention, two opposite injection surfaces are cylindrically shaped where the outer one is concave and the inner one is convex.

Furthermore, in accordance with a preferred embodiment of the present invention, the inner cylindrical injection surfaces rotates.

Furthermore, in accordance with a preferred embodiment of the present invention, said object is a wafer or a printed circuit board.

Furthermore, in accordance with a preferred embodiment of the present invention, said object is a car carriage or a container or any other storage case.

Furthermore, in accordance with a preferred embodiment of the present invention, said object is a paper sheet or a plastic sheet or a metallic plate including printing plates.

Furthermore, in accordance with a preferred embodiment of the present invention, air injection induced force is applied in the direction of gravity.

Furthermore, in accordance with a preferred embodiment of the present invention, air injection induced force is applied irrespectfully of gravity.

Furthermore, in accordance with a preferred embodiment of the present invention, an air cushion is generated for positioning control with no-contact with said object.

Furthermore, in accordance with a preferred embodiment of the present invention, one or a plurality of said conduits that produce fluid injection force acting with gravity direction are combined with at least one of a plurality of simple vacuum ports that produce fluid suction force that acts against gravity direction whereby when both injection and suction induced force are actuated simultaneously the combined fluid induced force acts on the upper surface of an object holds the object at a stable equilibrium position and balances the object own weight said object suspending with no-contact.

Furthermore, in accordance with a preferred embodiment of the present invention, fluid injection by jets is used to hold an object with contact to a surface.

Finally, in accordance with a preferred embodiment of the present fluid injection is applied from a distance smaller then the diameter of the injection conduit.

BRIEF DESCRIPTION OF THE FIGURES

In order to better understand the present invention, and appreciate its practical applications, the following Figures are provided and referenced hereafter. It should be noted that the Figures are given as examples only and in no way limit the scope of the invention as defined in the appending Claims. Like components are denoted by like reference numerals.

DETAILED DESCRIPTION OF THE INVENTION

Figure 1A:
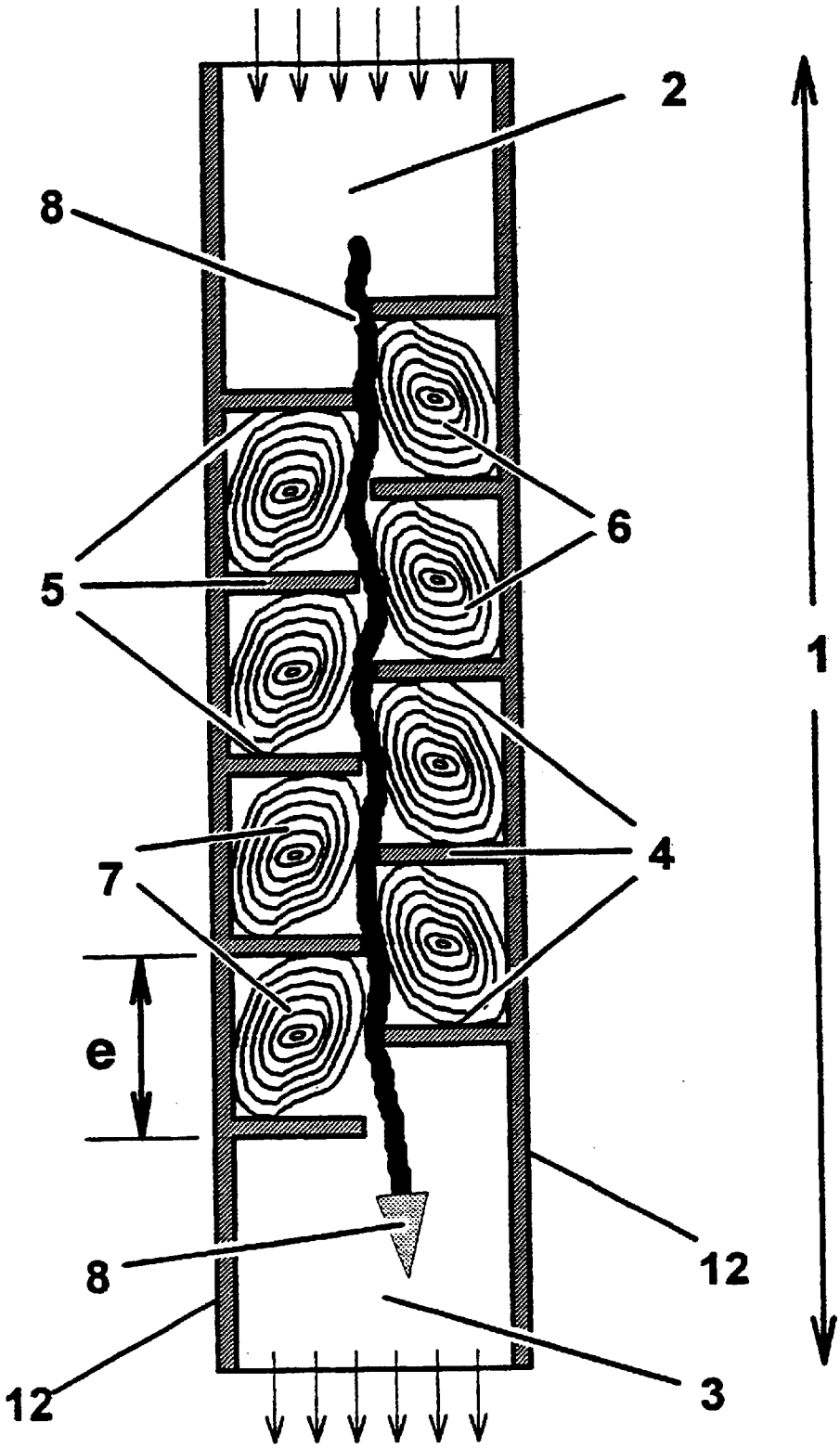
FIG. 1*a* illustrates a longitudinal cross section view of a Self Adaptive Segmented Orifice Device, in accordance with a preferred embodiment of the present invention, with existing through-flow and formed vortices.

An injection system used for aerodynamically induced forces applications, comprises a pressure system that generates an external pressure difference to drive the fluid, and a SASO-conduit or a plurality of SASO-conduits through which the fluid is to be injected. The geometrical details of these conduits and the applied pressure difference determine the MFR and the out coming momentum at the conduits outlet. When an objected is facing the conduit outlet with a moderate distance, a jet flow is generated and impinges on the object surface. In this case the flow decelerates as it reaches the object. Most of the flow rebounds sideways, and some of it comes to rest at the stagnation point region. As a result, the jet delivers it's momentum to produce the aerodynamically induced force acting on the object. When that distance is small, the out coming flow can not develop to become a jet flow, and the flow is forced to turn sideways. Nevertheless, it produces aerodynamically induced forces. A factor that may dramatically affect the aerodynamically induced force is the distance between the SASO-conduit outlet and the object surface. When this distance is gradually narrowed, and the conduit outlet is almost covered then the flow through the conduit decays. As a result, the intensity of the vortical aerodynamic blockage mechanism significantly deteriorates in a self-adaptive manner, and the conduit ceases to sustain the internal pressure drop. Consequently, most of the applied high-pressure at the conduit inlet is introduced to the object that almost covers the conduit outlet. This effect, where the SASO-conduit exhibits features of "aerodynamic return spring" with respect to the distance between the conduit outlet and the object, may be of great practical value. In fact, the "erodynamic return spring" feature of the SASO-conduit is based on the transitional, "not fully developed" state of the vortical aerodynamic mechanism where the internal pressure drop—$\Delta P$—dramatically changes when the object is very near the conduit outlet. The stiffness equivalent of this aerodynamic return spring directly relates to the internal pressure drop—$\Delta P$—that develops within the SASO-conduit when its outlet is not covered. The aerodynamic return spring feature of the SASO-conduit is a fundamental aspect of the present invention, in particular with respect to force control and positioning control issues. At short distances, the "external" flow regime, developed between the conduit's outlet and the object, becomes a sort of internal flow, particularly in common cases where a plurality of conduits are configured on a the "active" or Injection-surface of the injection system, that is parallel to the surface of the object. (It can be for example a flat or cylindrical surface). Therefore, when a plurality of SASO-conduits are used, the interactions between the conduits become significant and must be considered at the practical phase of development of an injection system for aerodynamically induced forces applications, based on SASO-technology.

These two distinct aerodynamically induced force (the short-distance case, and the case of impinging jets) are two practical alternatives and can beneficially be utilized for specific application. Furthermore, there are applications where this distance is inherently a dynamic parameter and the two distinct type of aerodynamically induced force can alternatively dominate, in a self-adaptively manner with respect to that distance. Since the MFR and the velocity or the momentum at the conduits outlet, as well as the static pressure introduced at the conduit outlet, determined the force induced by the out coming flow, it is possible to obtain a desired aerodynamically induced force set-point by determining the flow parameters. These parameters can be controlled by setting a specific external pressure difference and/or by changing the SASO-conduit geometrical details. In particular for gases, compressibility effects may also play an important role. Furthermore, in cases of moderate distances (between the conduit outlet and the object), when a compressible gas is expanded and accelerated from a sufficiently high pressure reservoir, a jet flow that is developed away from the conduit outlet, may reach a super-sonic speed, a very different situation from incompressible case. Super-sonic jets can also be used to generate aerodynamically induced forces, but mostly it is an undesired flow pattern as it generates much noise.

Injection systems with accordance to the present invention are used to generate aerodynamically induced forces to be used for various application. in order to understand the practical engineering requirements form such a system, we shall first examine the features of current injection systems that use conventional conduits, and later, the novel self-adaptive conduit, the SASO-conduit of the present invention will be introduced.

Conventional Conduits

Current conventional conduits are either simple cylindrical holes or of more sophisticated shape. Sometime they are combined with control-valves having mechanical or electro-mechanical mechanisms, that can regulate both the mass flow rate and the pressure, in a wide range of external conditions. In most cases the use of the control-valves is impractical or undesired either by the price tag or by their feasibility. When a plurality of conduits are used and must be individually controlled, the use of sophisticated means is almost impossible because of unacceptable price and due to increasing of the maintenance expenses. Often, the current technology is not cost-effective or can not meet the engineering requirements, where the injection systems used for aerodynamically induced force applications are limited by the following conduit features:

1. Inability to sustain a large internal pressure drop—ΔP, without significant narrowing of the typical diameter of the conduit, a case where a severe increased risk of mechanical blockage by contaminants may occur.
2. Extremely high mass flow rate (MFR) that is linear with the external driving pressure. It is, in fact, a parasite MFR when aerodynamically induced force and not the transfer of fluid is of interest.
3. High sensitivity to changes in the external driving pressure and to temporal pressure fluctuations.
4. Supersonic out-coming flow that may be developed when the ratio between the driving pressure at the conduit inlet and the conduit outlet pressure exceeds a certain level, where a severe noise generation may be resulted.

These features lead to the following shortcomings in the conventional injection systems when aerodynamically induced force applications are of interest:

1. The necessity to control the driving pressure level at a high precision, at the local value, and its spatial distribution when a plurality of conduits are involved, or else the out coming flow will vary with time and position.
2. The need to employ a very high parasite MFR, in order to guarantee the required aerodynamically induced forces. This drawback is especially severe, when a plurality of conduits participate in the injection system, when only a fraction of them are actually contributing to produce the induced force, but all of the conduits have to be continuously operational.
3. The possible, mostly unintended, generation of supersonic jet flow. This flow regime shortcoming may be coupled with a severe generation of noise and mechanical vibrations. In addition it may be a critical shortcoming with respect to the induced forces. In such respect, if the external pressure conditions or any relevant geometry (the distance to the object for example), are changed, the induced force can immediately be triggered in a non-continuous manner and it is hard to control such a phenomena.
4. When the out coming flow acts as a sort of "aerodynamic return spring", the aerodynamically induced force is changed with respect to the distance from the conduit outlet to the object in a self-adaptive manner (regarding to positioning control). Usually, the maximal induced force is obtained when the distance becomes zero, and is equal to the pressure level multiplied by the effective active area, and the minimal force is approaching zero when the distance grows to infinity. In common practical applications where extremely short distances are of interest and due to the fact that only small internal pressure drop—ΔP, can be developed within the conventional conduits, the "fluidic return spring" stiffness equivalent (or the internal pressure drop—ΔP, through the conduit), is small. Consequently, the self-adaptive potential of force and positioning control is very limited when conventional conduits are used.
5. Another solution often applied is to limit the mass flow rate by using an orifice with a very small typical diameter, for example, in air bearing applications. Such a solution is very sensitive to contaminants in the flow where the conduits can be mechanically blocked. In addition, the use of narrow orifices may severely affect the control task.

To overcome these limitations, and expand the scope of performance of injection systems for applying aerodynamically induced forces, it is suggested to replace the conventional conduit with a novel SASO-conduit that based on an aerodynamic blockage mechanism. Furthermore, novel applications, based on SASO-conduits for injection systems used to generate aerodynamically induced forces, offer new practical opportunities that are currently not available with respect to conventional conduits.

SASO-conduits

Conventional conduits that are used to inject gases from a high pressure reservoir into a lower pressure environment, are often simple conduits, especially when a plurality of conduits are involved. Practically there is almost no pressure drop along such conduits, unless compressible flow phenomena occurs or intentionally involved, for example to set the MFR by special nozzle where the flow accelerates to Mach number M=1 at the nozzle throat. However, at common cases where compressibility is not playing an important role, the internal pressure drop through conventional conduits is of small potential with respect to its "aerodynamic return spring" behavior. The SASO-conduit incorporated in the present invention manifests a significantly improved characteristics with respect to the "fluidic return spring". Another important practical requirement is to minimize the MFR as much as possible but to fulfill the required performance for specific application, where an injection system is used to apply aerodynamically induced forces. Moreover, when a plurality of conduits are used, only portion of them may participates in applying the aerodynamically induced force. In such a case, where fluid, (air in most practical cases), must be supplied also to the conduits that are not functioning (at least temporarily), much efforts are unnecessarily spend. The SASO-conduits can solve such problems of parasite MFR.

The purpose of the novel SASO-conduits for injection systems in accordance with the present invention, is to define a new relationship between the external driving pressure and the out coming flow dynamic characteristics. This new relationship is obtained by the SASO-conduit of special internal geometry that dictates the vortical aerodynamic blockage mechanism, when through flow exists. The aerodynamic blockage is obtained by flow separation governed by the SASO-conduit internal geometry, followed by the development of the vortical flow patterns, as will be discussed later. This separation and the generated vortical flow patterns are essentially of a non-viscous nature. However, viscosity may contribute secondary effects. The aerodynamic blockage mechanism is similarly developed both in incompressible or compressible flow-field conditions, but the details may be slightly different. The aerodynamic blockage, dictated by the SASO-conduit internal geometry, determines the internal pressure drop—$\Delta P$ along the conduit, as well as the MFR, which are the most significant parameters of injection systems of the present invention, used to generate aerodynamically induced forces.

The aerodynamic blockage mechanism of the SASO-conduit is hereby explained with reference to the Figures. The SASO-device basic two dimensional configuration in accordance with a preferred embodiment of the present invention comprises a conduit (1), provided with an inlet (2) and outlet (3), having a plurality of fins, arranged in two arrays (4, 5), substantially at opposing sides on the inside of the conduit walls (12), as illustrated in FIG. 1*a*. The two fin arrays are arranged in a relative shifted position, where opposite to the gap formed between two successive fins of the first array of fins (apart from both end fins), there exists one opposite fin of the second array, thus creating the typical asymmetric configuration that characterizes SASO-device. Consequently, two asymmetrical arrays of cells are formed, each cell bounded by two consecutive fins of the same array, and a portion of the conduit wall in between them. Thus a cavity is defined, where a large vortex may develop inside it when a fluid flows through the conduit (this cavity, hereafter referred to as SASO-cell).

The SASO-device internal configuration dictates the unique vortical flow field pattern established inside the conduit, when a fluid flows through it. Each one of the fins imposes a separation of the flow downstream from the fin's tip. Further downstream, a large fluid structure, namely a vortex, is generated inside each of the SASO-cells. A vortex is a circular motion of fluid around a virtual axis, where the term "circulation" defines the vortex intensity. A vortex is generated by a well-known roll-up mechanism of the separated shear flows, following the flow separation from the upstream fin of each SASO-cell. Beside the main dominant vortices, secondary vortices may develop, playing an important role in the enhancement of SASO-device performance. An optional prominent feature is the unsteady nature of the main vortices, as well as unsteady modes of the secondary vortical flow patterns, that may significantly augment the aerodynamic blockage effect.

In practice, a flow pattern of two opposite rows of vortices (6,7) is asymmetrically arranged, as shown in FIG. 1*a*. Each vortex is located inside a SASO-cell, facing an opposite fin. These vortices, and in particular when formed with almost closed stream lines, practically block the flow through the conduit, thus preventing the development of a wide sinusoidal fluid motion, a type of fluid motion that characterizes labyrinth-like conduits (internal configuration). Consequently, a significantly thin core-flow (8), is developed between the blocking fins and the vortices. The core-flow may be of a relatively high downstream velocity, and it is bounded on two sides by the vortices and do not touch the conduit walls. Hence, as the core-flow instability increases, it breaks down and may frequently generate unsteady secondary vortices, shed downstream and intensively interacting with the core-flow. An impingement of the core-flow with the facing fins may also occur, following the core-flow breakdown. In addition, wavy flow patterns of periodic or chaotic nature may develop. Such interactions may significantly enhance the aerodynamic blockage effects. FIG. 1*a*, which shows schematically a two dimensional longitudinal cross-section through a typical SASO-device conduit, presents a basic SASO-device, with fully developed vortical flow pattern. A SASO-device is a three-dimensional conduit, but can in practice be of essentially two-dimensional nature where the third direction perpendicular to both the core-flow motion and the main vortices virtual axes (hereafter referred to as the "passive direction"). Hence, the illustration of the SASO-device given in FIG. 1*a* should be considered as the cross-section of a practical device.

When flow exists through the conduit, the two set of vortices block the flow, allowing thus only a very narrow core-flow 8 to develop between the arrays of the vortices and the fins tips. Since the MFR through a SASO-device is mainly conveyed by the core-flow, such a blockage dramatically reduces the MFR. Moreover, additional MFR reduction may be obtained when non-steady interactions between the core-flow and secondary shed vortices occurs inside the SASO-device conduit. The vortical aerodynamic blockage substantially increases the internal pressure drop—$\Delta P$, along the conduit. It results from the interaction between the vortices and the SASO-cell walls. The large $\Delta P$ that is develops inside the SASO-conduit is of great practical importance in the present invention. In particular, the large $\Delta P$ plays a most important role with respect to the SASO-conduit "aerodynamic return spring" features, that significantly improve the force control and positioning control characteristics.

The significant increase in ΔP and the substantial reduction in MFR are fundamental features of great practical importance with respect to the present invention. It should be noted, however, that these important features are obtained only when flow through the conduit exists, where if there is no flow, no vortices are developed. This "dynamic" nature is the essence of the SASO-Idea that may be defined as follows:

- The special internal configuration of a SASO-device conduit intentionally dictates the development of the vortical flow patterns.
- The vortical flow pattern is responsible for the aerodynamic blockage mechanism, blocking the flow in a self-adaptive manner, thus increasing the ΔP and reducing the MFR.
- It is effective only during the dynamic state, when there is flow through the conduit.
- Unsteady cases where the vortical flow patterns are effective only for an essential portion of time, out of the entire operational duration, are also included within the scope of the present invention.

It has to be emphasized that there is a wide variety of possible SASO-device configurations (some of them will be discussed later). Therefore, as long as any device or product essentially implements the vortical aerodynamic blockage mechanism, as dictated by the special internal geometry of the SASO-conduit, it is inherently a SASO-device, and covered by the scope of the present invention. It is true regardless of the specific geometry of the SASO-device.

SASO-device is generally a solid body without any moving parts. It does not involve a need for any mechanical parts (such as springs, membranes etc.), or employ electromechanical control means. It can be made of metallic material as well as non-metallic material, such as plastics. Nevertheless, its self-adaptive behavior with respect to external conditions yields a new type of device, where the regulation of the MFR and ΔP is achieved by applying the aerodynamic blockage mechanism of the present invention.

The aerodynamic blockage mechanism, established by the primary vortices that develop within the SASO-cells, is the fundamental mechanism of self-adaptive nature associated with the SASO-device. However, additional vortical flow patterns of self-adaptive nature might alternatively or simultaneously be developed at different external conditions, or in response to varying external conditions. When increasing the external pressure drop or when the Reynolds number is intentionally increased, the following vortical flow patterns that modify the aerodynamic blockage mechanism may be involved:

- The intensity (circulation) of the primary vortices may intensify.
- The downstream distribution of the primary vortices intensity may vary.
- The number of effective primary vortices inside a conduit may change.
- Vortical fluttering modes, mostly of periodic nature may be excited.
- Secondary shed vortices strongly interacting with the core-flow or with the facing fins may develop.

Such vortical flow patterns may significantly improve the efficiency of the aerodynamic blockage mechanism.

As a consequence of the vortical aerodynamic blockage effects, the SASO-device has a unique response during transient operational periods like starting or stopping sequences, or when external conditions such as the pressure drop between the inlet and the outlet are altered. SASO-device response to such transient conditions can be designed to achieve favorable transient behavior such as fast or slow response, smooth response, etc.

Figure 1B:
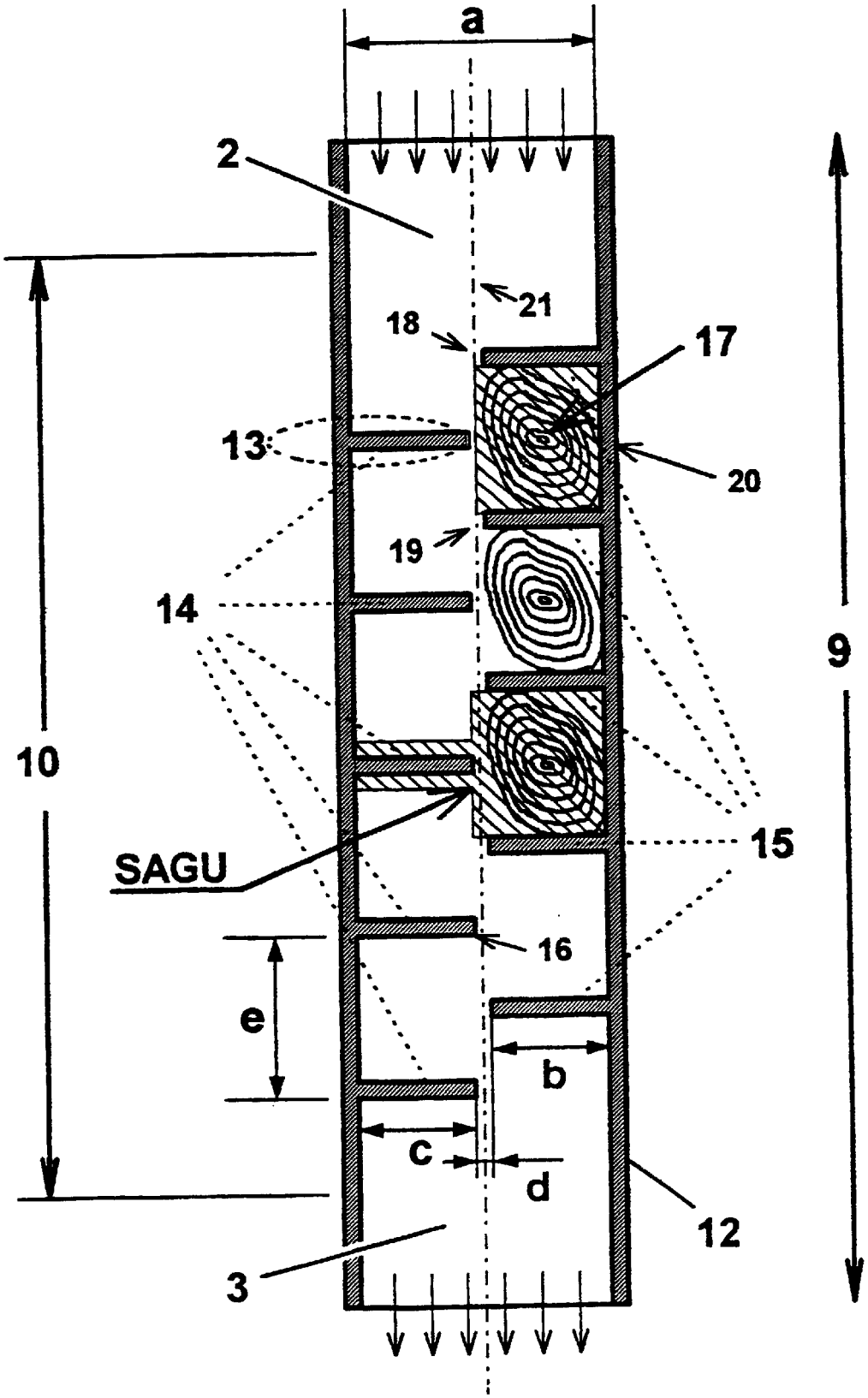
FIG. 1*b* illustrates a longitudinal cross section view of a Self Adaptive Segmented Orifice Device, in accordance with a preferred embodiment of the present invention, highlighting some of its features for explanatory purposes.
Figure 2A:
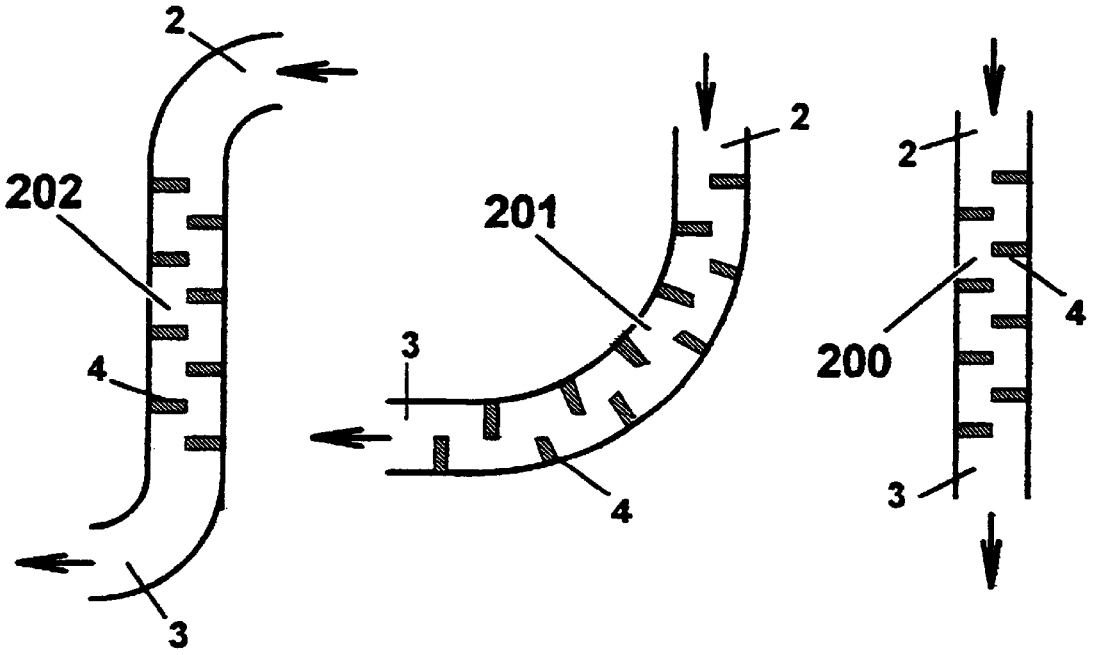
FIGS. 2*a,b* illustrate some optional configurations of SASO-device conduit in accordance with a preferred embodiment of the present invention.
Figure 2B:
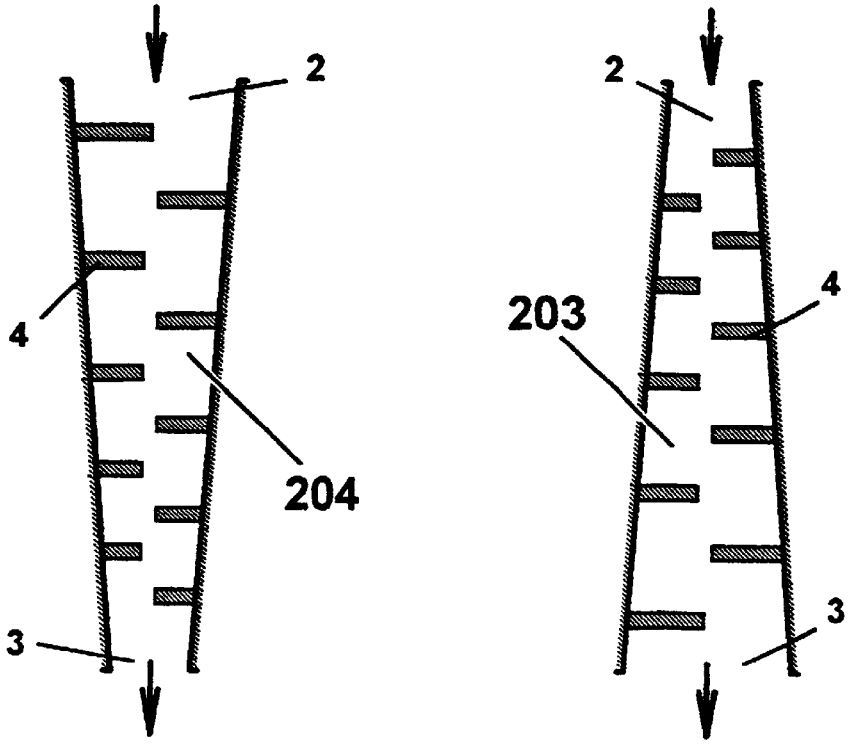

FIG. 1*b* demonstrates the geometrical aspects of the present invention. The following detailed description of the various SASO-device structural elements, is given with the essential functioning of each of the elements as well as its influence on SASO-device characteristics and the way it affects the vortical flow patterns that block the flow. The first element is the SASO-device conduit (9), which connects between two "reservoirs" of different pressure, one located adjacent to the inlet (2), and the other located adjacent to the outlet (3), of the conduit. The SASO-device conduit may be stretched in a straight line (FIG. 2*a*, 200), or aligned along a tortuous course (FIG. 2*a*, 201,202). FIG. 2*a* illustrate only 2-dimensional aspect are shown SASO-device conduits course can also be tortuous in a three-dimensional manner, thus the fluid may be conveyed to any desirable direction, distance and location. Additionally, the downstream distribution of the conduit's cross-section area may be uniform (FIG. 2*a*, 200), divergent (FIG. 2*b*, 203), convergent (FIG. 2*b*, 204), or of any other practical distribution. The conduit cross-section might be of rectangular (FIG. 6*a*, 220,222), substantially circular (FIG. 6*a*, 221,224), Polygon (FIG. 6*a*, 223), or of any other shape dictated by the specific engineering needs.

The lateral dimension of the SASO-device conduit is denoted by "a" (see FIG. 1*b*). The internal walls surface of the SASO-device conduit may be smooth or rough to enhance small scale turbulence within the thin boundary layers, attached to the conduit walls. In the case of rough walls, the skin friction is augmented. For the same matter, the conduit internal wall may also be provided with small extruding obstacles, preferably not greater than the boundary layer width, to enhance local flow separation that triggers wall turbulence.

Fin (13), FIG. 1*b*, is a member of one of the two opposite fin arrays (14,15), forming the special internal geometry of the SASO-device. The objective of the fins is to force flow separation, and consequently to generate the vortical flow patterns. The fins may be positioned perpendicularly to the conduit walls, thus facing the flow, as illustrated in FIG. 1*b*, Alternatively, the fins may be inclined with respect to both the general core-flow direction and the conduit walls. The surfaces of the fin may be flat or of any other predetermined surface geometry, to manipulate the separation characteristics.

Figure 5A:
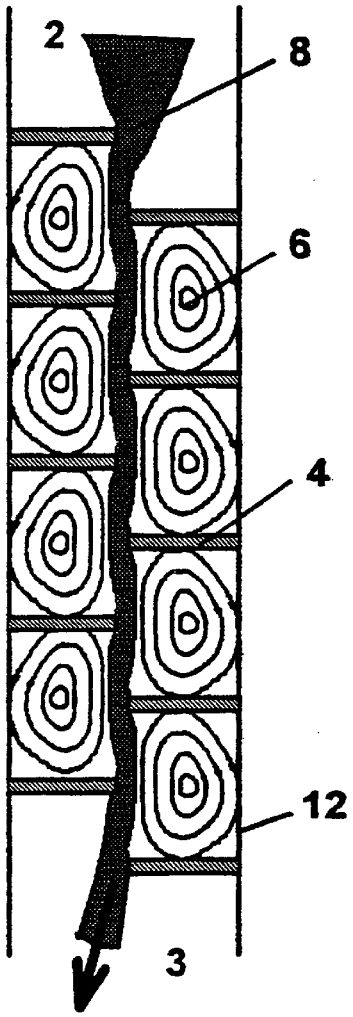
FIG. 5 illustrates lateral aspects of the core-flow motion, including impingement with the fins of a SASO-device in accordance with a preferred embodiment of the present invention.
Figure 5B:
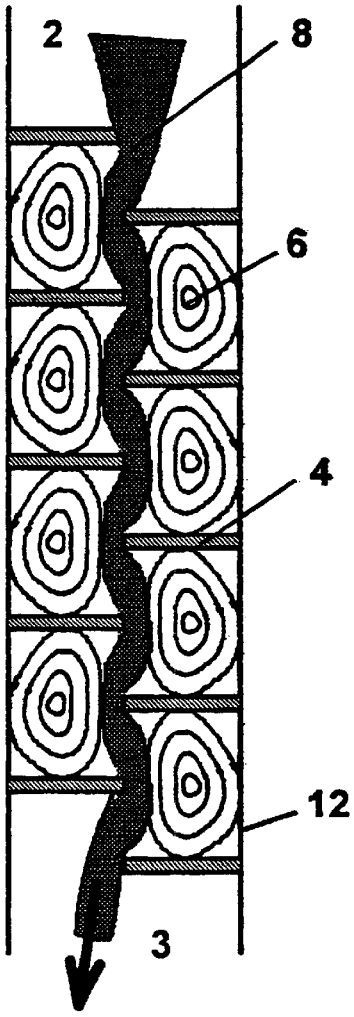

A typical fin span of a fin from one fin array is denoted by the dimension "b", as shown in FIG. 1*b*. The fin span of a fin of the opposite fin array, closest to the first fin of the first fin array, is denoted by "c". The fin span of both fin arrays can be uniform as illustrated in FIG. 1*b*, or varying. The fin tip (16) may be sharp or blunt, or of any reasonable shape. Preferably, each of the fins substantially blocks half of the conduit, thus "b" and "c" are each substantially half of the hydraulic diameter "a". The gap between the two opposite arrays of fins is "d"=a−(b+c), as shown in FIG. 1*b*. There are three practical possibilities for the value to "d":

- d is greater than zero (see FIG. 6*b*, 212): An almost straight core-flow is developed as shown in FIG. 5*a*.
- d approaching zero (see FIG. 6*b*, 211): The gap is substantially diminished and the core-flow becomes sinusoidal developed as illustrates in FIG. 5*b*.
- d is smaller than zero (see FIG. 6*b*, 213): The fins partially overlap and the sinusoidal motion is amplified.

In fact, for the purposes of implementation of the principles of the present invention, the absolute value of "d"

should be of a smaller order than the lateral dimension of the conduit "a". Preferably said absolute value of said gap is not more than 20% of the adjacent lateral width of said conduit.

Figure 5C:
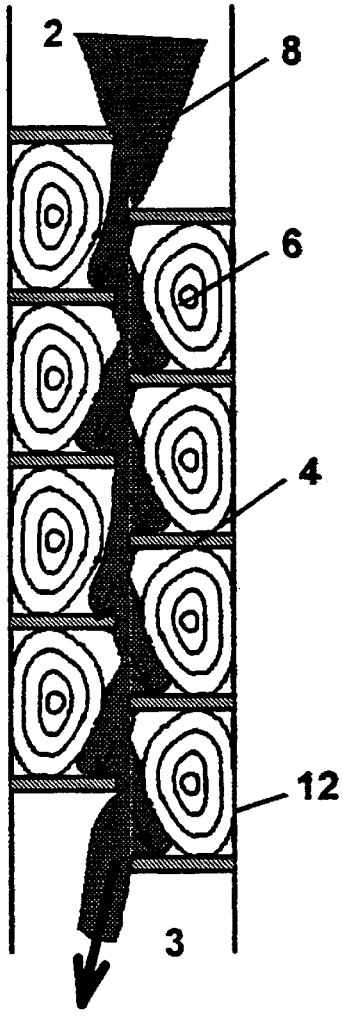

The core-flow laterally sinusoidal motion does not exclusively depend on the gap "d" but also on the geometrical details of the fins. In addition, the laterally sinusoidal motion may be amplified when the through flow Reynolds Number is increased. When intensive core-flow motion exists, local impingement of the core-flow at the edge area of the fins facing surface may be developed as shown in FIG. 5*c*.

Figure 6A:
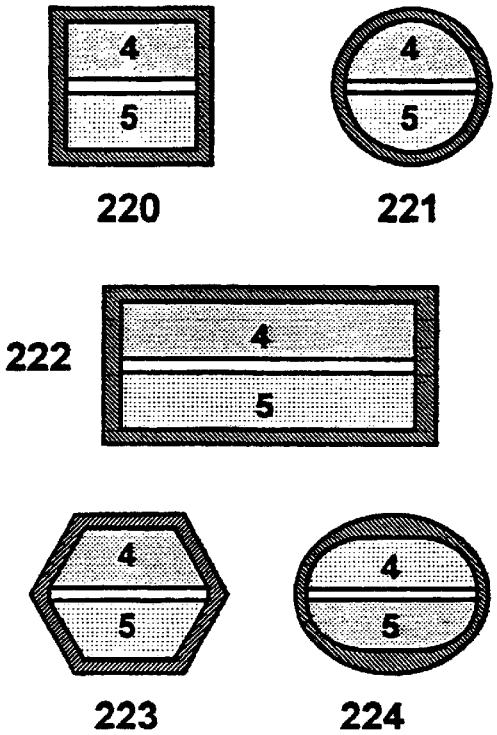
FIGS. 6*a–c* illustrate geometrical aspects of the fins structure and of fins arrangement of a SASO-device in accordance with a preferred embodiment of the present invention.

The fin shape, and in particular the shape of the fin tip, may significantly affect the SASO-device performance, since the flow separates from the fin tip. The fin tip can be sharp (FIG. 6*c*,230), round (FIG. 6*c*,231) or of blunt cut (FIG. 6*a*, 232,233). The fin tip is usually a curve in real three dimensional cases, and the "separation point" is in fact a "separation curve", which is substantially normal to the core-flow motion direction. The "separation curve" may be a straight line, or of any predetermined curvature, in correspondence to the fin tip curvature or the lateral distribution of the fin span. The fin span can be laterally uniform (FIG. 7*c*, 241), roundly curved (FIG. 7*c*, 242), symmetrically "V" shaped (FIG. 7*c*, 243), or laterally inclined (FIG. 7*c*, 244), The "separation curve" may be fixed (stationary) to a substantially sharp or blunt fin tip, or of a non-stationary behavior. The non-stationary behavior can be dictated by the use of a round fin-tip. The fin surface may be smooth or rough, to generate small scale boundary layer turbulence. In particular, by using roughness in the fin-tip region, especially in round fin-tip cases, the characteristics of the flow separation might be manipulated. Unsteady character of the flow separation may significantly improve the SASO-device performance, as it may trigger complex unsteady vortical flow patterns that may block the through flow more efficiently.

In practice, a SASO-device includes a plurality of fins. Thus various fin combinations may be configured inside the conduit, to provide a SASO-device with improved characteristics. Without derogating generality the following combinations are available:

One fin type with constant geometrical profile throughout the entire SASO-device.

One fin type, but the fins geometrical profile change in the downstream direction. For example, a divergent distribution of the free gap "d" (see FIG. 7*d*), or alternatively a convergent distribution.

A combination of fin types. Although the use of one fin type is preferable.

The fins may be inclined relative to the main flow motion.

Any shape of fin, of any geometric details mentioned above, is allowed in the SASO-device, as long as the fundamental SASO-idea of vortical aerodynamic blockage mechanism is established, as a result of flow separation from the fins.

The last geometrical element to be defined is the SASO-cell (17), shaded by diagonal lines in FIG. 1*b*. SASO-cell is a cavity that is bounded by two consecutive fins (18,19), the conduit wall (20), and the conduit's center-line (21). The SASO-device comprises two substantially opposite arrays of consecutive SASO-cells, where in opposite each SASO-cell of the first set there exists one fin of the opposite set, as shown in FIG. 1*b*. The basic lateral scale of SASO-cell is substantially the fin height, "b" (or "c"), or approximately half of the conduit lateral dimension, "a/2". The longitudinal gap between the fins, denoted by "e" in FIG. 1*b*, is the SASO-cell pitch. Although it usually is the case, it is not always necessary to place the opposite fin facing the exact center of SASO-cells of the opposite set, and it may be off the center. The SASO-cell pitch "e" can be constant, or of any practical downstream distribution.

In the cavity of the SASO-cells, the primary vortices are developed. The developed vortices are dynamic fluid structures that develop and survive within the SASO-cell, only when through flow is maintained inside the conduit. A vortex is a rotational motion of fluid around a fixed or an unsteady virtual axis. A steady vortex is a fully developed vortex, that induces a steady velocity field. In cases of a steady state situation, the primary vortex is characterized by closed stream-lines as illustrated in FIGS. 1*a* and 1*b*. It means that there is no mass flow normal to the vortex stream-lines, thus it may serve as an efficient fluid barrier, just like the solid fins that face the incoming flow. When the primary vortex is of unsteady nature, but still maintained substantially within the SASO-cell, it may be distorted while moving periodically, or even chaotically. In such unsteady cases, the vortex streamlines are not necessarily dosed and there is some mass exchange with the core-flow. Nevertheless, practically speaking, the vortex still serves as an effective "fluid" barrier. The unsteady nature of the primary vortices is of great importance in accordance to the present invention, because it can trigger complex interactions between the vortices and the core-flow. It can also trigger longitudinal interactions between the vortices. These interactions can be intentionally invoked and may significantly improve the efficiency of the aerodynamic blockage mechanism.

Figure 3A:
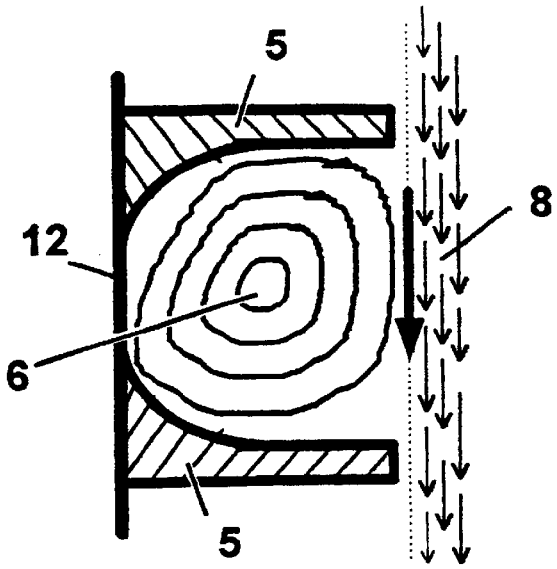
FIGS. 3*a–h* illustrate some possible interactions between various vortical flow patterns with the SASO-cell walls and with the core-flow.
Figure 3B:
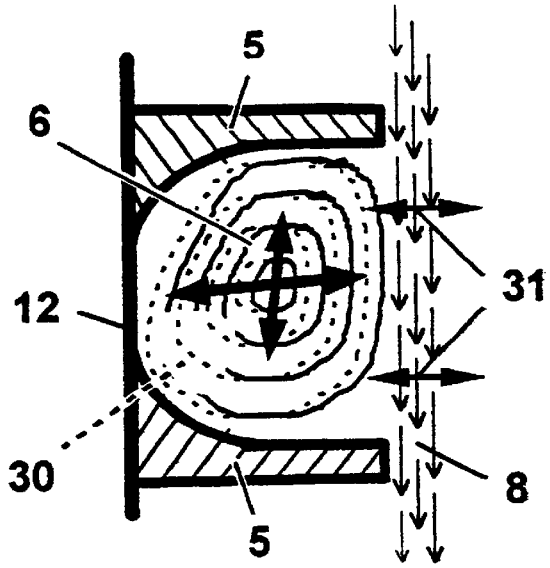
Figure 3C:
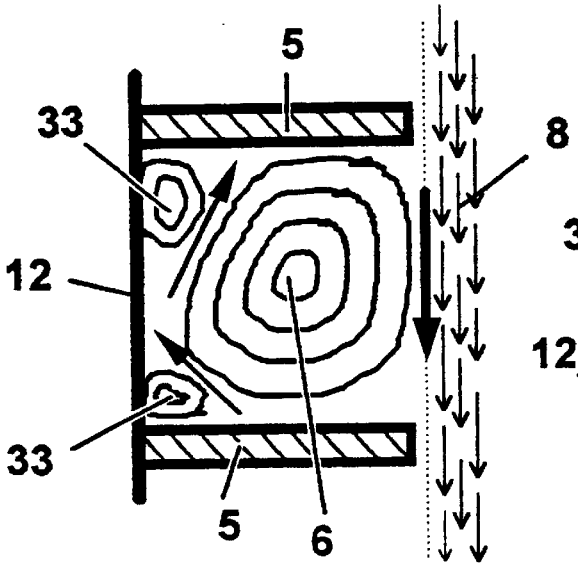
Figure 3D:
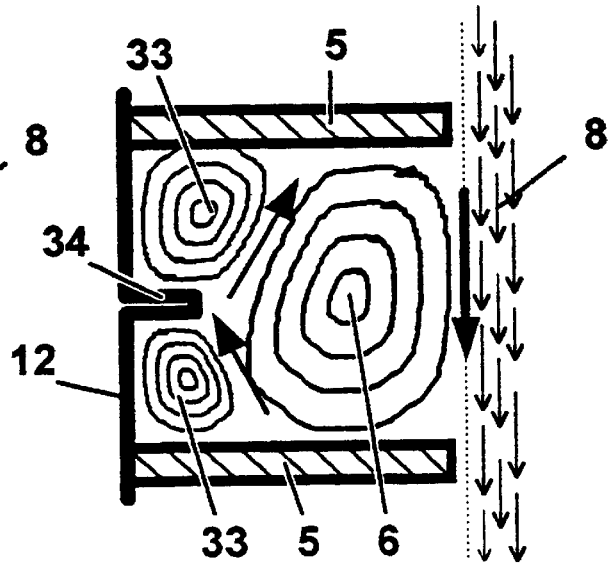
Figure 3E:
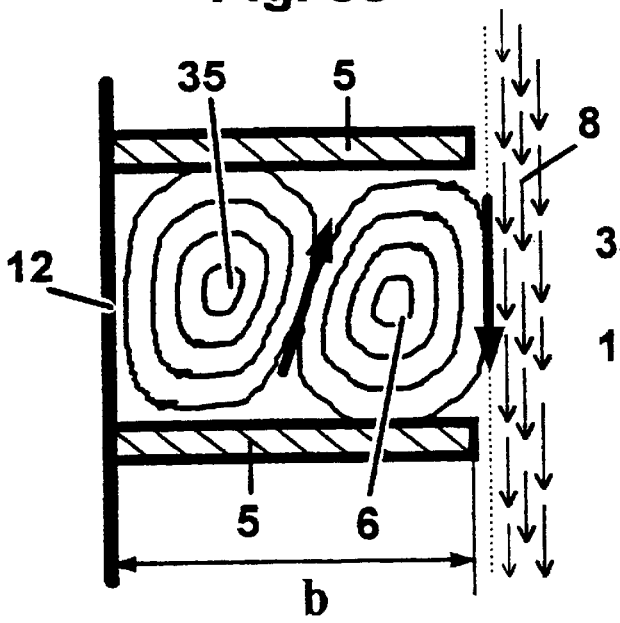

The vortical flow patterns strongly interact with the walls of the SASO-cell, involving viscous wall friction. The cases of steady and unsteady viscous interactions should be treated separately. Without derogating generality, FIGS. 3*a*–3*h* illustrate some possible interactions between various vortical flow patterns with the SASO-cell walls, where interactions with the core-flow may be involved. An interaction of a steady character is shown in FIG. 3*a*, where the principle substantially stationary vortex (6), is developed inside the SASO-cell. FIG. 3*b* illustrates the case where weak non-steady interaction, mostly of a time-periodic nature, takes place where the vortex deforms and shifts inside the SASO-cell, and interacts with the core-flow. As the vortex swings about (in the directions represented by arrows (30)), it causes the core-flow to adjust, by locally altering its course to follow the "free passage", which shifts accordingly in the direction of arrows (31). The aerodynamic blockage effect may significantly be augmented when unsteadiness is introduced to the flow, for example by selecting the desired scales of the SASO-device. Alternatively speaking, the two fundamental features of the present invention, the significant increase of $\Delta P$ and the drastic reduction of MFR, are both modified. Generally, in cases of unsteady vortical patterns, the various aspects of the aerodynamic blockage effects must be treated in terms of time-averaged quantities.

Figure 3F:
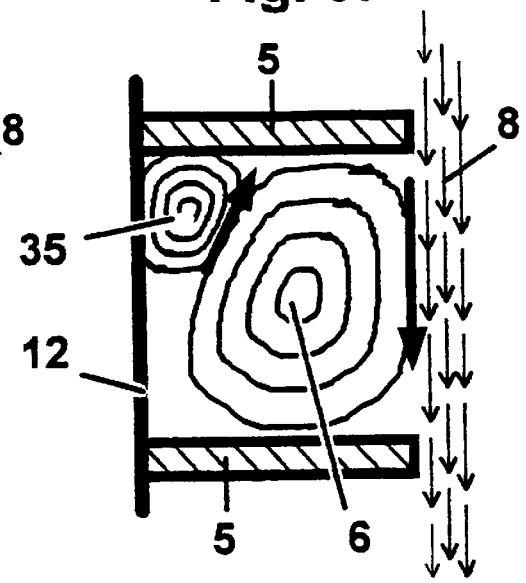

The interactions of the SASO-cell walls with the flow that are shown in FIGS. 3*a* and 3*b*, shed a light on a distinctive aspect of the present invention, resulting from its unique vortical flow mechanism. In such cases, the viscous friction force that acts on the conduit walls is in opposite direction to the viscous force found in conventional or labyrinth-like conduits. It is the vortices inside of a SASO-cell that alter the direction of the viscous friction force. By employing SASO-technology, the direction of the wall viscous friction force can be manipulated, by using secondary vortical flow patterns. Secondary vortices (33) of essentially stationary nature may develop between the principle vortex and the SASO-cell corners (see FIG. 3*c*). Such small scale vortices can be intentionally initiated with the aid of a special cell geometry, see FIG. 3*d*, where the conduit wall (12), is provided with a extruding construction element (34). Alternatively, when the fin span "b" is enlarged a secondary vortex (35), of scales similar to these of the principal vortex, may develop (see FIG. 3*e*). This secondary vortex (35) is usually of a reduced circulation. In other cases, the principle vortex (6) may be forced by the core-flow (8), to a declined orientation inside the SASO-cell cavity. In such a case, a small secondary vortex (35), or several vortices, may develop in the "unoccupied" corner region of the SASO-cell, as shown in FIG. 3*f*. The resulting vortices illustrated in FIGS. 3*c*, 3*d*, 3*e* and 3-*f*, are in fact a few of many possible SASO-technology tools for manipulating the viscous friction force. Such manipulations may significantly modify the two fundamental features of the SASO of the present invention—increasing the ΔP and reducing the MFR.

A "free" (geometrically unforced) developed vortex has its own "natural" scales (by this term we mean integral scales as referred to in the art), that depends on the flow characteristics and its own formation history. The questions of matching between the vortex integrally defined natural scales associated with its vorticity, and the actual space available inside the SASO-cell, expressed by the term "spacing", is of great importance in the present invention. In the two-dimensional case, the vortex spatial growth is bounded by the SASO-cell walls in a two-dimensional manner. Thus only the vortex cross-sectional aspects of the spacing are relevant to the present discussion, where the geometrical limitation in the passive direction, is further discussed. In certain situations, where the SASO-cell dimensions are effectively larger or smaller than the vortex integrally defined natural scales associated with its vorticity, the vortex, practically speaking, does not achieve its full potential, thus it is less effective with respect to the aerodynamic blockage mechanism. States of "optimal spacing" might be achieved, practically speaking, when the size of the SASO-cell is slightly smaller than the vortex integrally defined natural scales associated with its vorticity. In such a case the vortex practically achieves its full potential while it is slightly deformed and intensively interacts both with the SASO-cell walls and with the core-flow. The spacing issue is a most important aspect that affects the SASO-device performance. It is the task of the SASO-technology to define what is the optimal configuration with respect to a specific injection system used to generate aerodynamically induced forces, and to provide the practical design guidelines (to achieve optimal spacing), for a SASO-device design of the best performance. For the case of steady vortices pattern, a recommended approximate ratio of e/b is in the range of 1:1 to 1:2, and preferably about 1:1.5. When the SASO-conduit internal configuration is more complex, in particular when three dimensional elements are involved, or in more complex vortical flow patterns, of steady or non-steady nature, or when secondary vortices are developed and interact with the core-flow and/or the primary vortices, or when the vortical flow pattern is inherently three-dimensional, this ratio may no longer be considered as an initial guideline of the design.

Figure 3G:
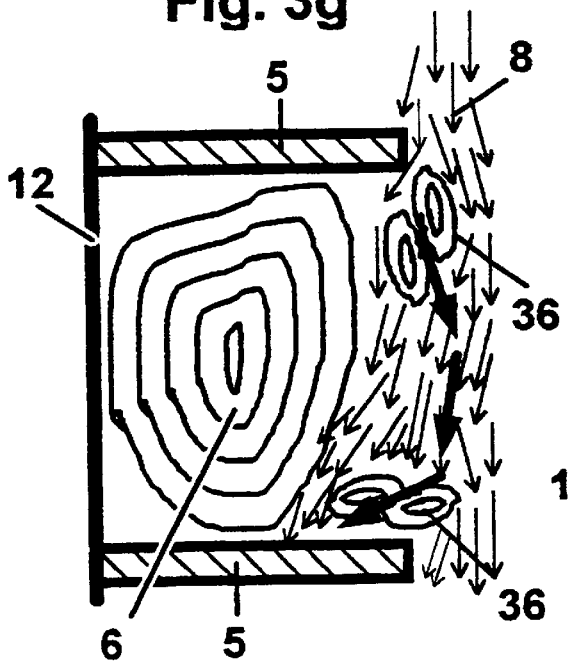
Figure 3H:
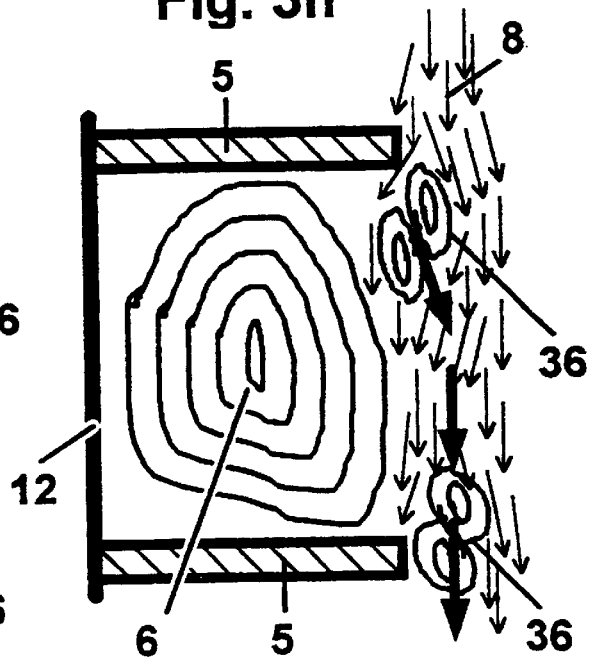

The SASO-device vortical flow pattern becomes more complex and involves unsteady flow mechanisms, as the Reynolds number (Re) increases. When Re number is increased, unsteady secondary vortices may be developed between the core-flow and the principal vortex. The typical scales of these vortices are similar to the core-flow width, and is significantly smaller than the principle vortex. These are shed vortices that may develop and travel downstream in a periodic mode, with complex periodicity or even in a chaotic way. These shed vortices violently interact with the core-flow, and a core-flow of unsteady character is attained. When the shed vortices directly confront the core-flow, unsteady core-flow "break-down", may take place. In addition, local impingement of the core-flow on the facing fins may occur. Shed vortices (36) may exist locally inside the SASO-cell, as illustrated in FIG. 3*g*. They can also travel downstream and interact with the consecutive SASO-cells, see FIG. 3*h*. The unsteady nature of the flow may significantly modify the aerodynamic blockage effect, and affect the fundamental features of the present invention, i.e. increasing the ΔP and reducing the MFR. It is within the scope of SASO-technology to implement and harness the benefits of the unsteady vortical flow patterns.

The appearance of traveling vortices which strongly interact with the core-flow and with the principle vortices may create downstream propagating wavy modes, where a plurality of vortices "communicate" with each other. As a result of direct interactions between the secondary vortices and the core-flow, instantaneous large changes in the lateral and in the longitudinal core-flow velocity may be locally developed. Consequently, the strongly disturbed core-flow may impinges in an unsteady fashion, on the facing fin. As the Reynolds number (Re) is further increased, (for example, by increasing the SASO-conduit lateral scale), more secondary vortices may be generated, and the direct interaction between the vortices and the core-flow becomes more violent. Consequently, the aerodynamic blockage effect can be significantly augmented. Furthermore, SASO-technology provides the necessary know-how required to utilize these unsteady vortices/core-flow interactions for the design of injection systems, of improved characteristics, used to generate aerodynamically induced forces. The present invention covers all these unsteady secondary vortices patterns. Therefore, the SASO-idea is hereafter extended to include also secondary shed vortices that may instantaneously block the core-flow.

The core-flow lateral scale (or the core-flow width), is significantly narrower than the SASO-conduit hydraulic diameter. The core-flow velocity distribution and its width are essentially determined by the external pressure drop, the various SASO-device internal configurations, and particularly, by the vortical flow-field patterns that are developed inside the SASO-conduit. When the flow accelerates from rest, the initial core-flow is wider, characterized by a sinusoidal downstream fluid motion of large lateral amplitude, bounded by the fins and the conduit walls. At this first instance, the flow is very similar to the flow in conventional labyrinth type devices. At a later stage, a totally different flow-field develops inside the SASO-device conduit. The flow can not follow the internal passage defined by the walls of the special SASO-device configuration. Consequently, the flow separates at the fin tips, and two opposing arrays of intensive principle vortices are developed inside the SASO-cells. These arrays of vortices limit the passage of the flow through the conduit, and a detached, severely narrower, core-flow is obtained. In many cases, the core-flow involves unsteady vortical flow patterns, with respect to the predetermined Re number (when Re number is increased).

The core-flow characteristics are affected by the geometry of the SASO-device internal configuration, and to a great extent by the gap, "d", between the two opposite arrays of fins. In most cases, as "d" is reduced, the core-flow becomes narrower, but as "d" is further reduced, a lateral sinusoidal motion may develop. Furthermore, as the gap is closed ("d"=0), or when the fins overlap ("d"<0), the lateral sinusoidal motion is augmented and the core-flow width may increase. These two contradictory effects bring about the notion that values of "d" between a/10<d<−a/10 may be particularly preferable (a—is the SASO-conduit "hydraulic diameter"). As one of these contradictory effects intentionally becomes dominant, it may serve practical requirements, when, for example, maximizing of the ΔP is of interest, but not the optimal reduction of MFR—or vise versa.

It has to be noted that as the degree of fin-overlap increases above a certain value, the core-flow might be forced to reattach to the conduit walls. In this case the SASO-idea is no longer sustained, the flow adopts a labyrinth type of motion and the vortical flow pattern disappears. Nevertheless, as long as the core-flow is substantially separated from the fins, and it is thus basically different from labyrinth flow types, and as long as the core-flow is dominated by the various types of vortical flow patterns, that block the flow, it maintains the SASO-idea described in the present invention.

The typical width of the core-flow is the effective hydraulic diameter of the SASO-cell conduit. Thus, a SASO-device that has a large lateral physical size ("a"), is practically of a much narrower effective width, with respect to the MFR, compared to conventional conduits. In typical cases, the physical size and the effective size, regarding MFR through the SASO-conduit, differ by orders of magnitude. This dual-scale behavior (small effective scale in respect to the MFR and large physical dimensions), is a fundamental feature of the present invention. In particular, the large physical scale is important with respect to significantly reducing the risk of contamination blockage in the case of fluids containing contaminants. It is further suggested that the physical passage inside the SASO-conduit (i.e. the winding passage within the conduit, between the fins) be greater than the envisaged size of the contaminant particles inside the fluid by at least 10%. The contaminants size can be predicted when the SASO-device is designated for a specific injection system used to generate aerodynamically induced forces, and therefore SASO-device scales relevant to that physical passage can be specified.

The discussion until now was limited to a two dimensional case of the SASO-device, in order to simplify the presentation of the flow field and its structure. However, for a true three dimensional SASO-device the "passive dimension" (passive—from topological point of view), physical scale denoted by the width "w" must be large enough so that the viscous edge effects should be negligible. Too small a "w" will render the SASO-device ineffective, as the large velocity gradient between the vortices and the side walls will attenuate the vortices intensity. It is recommended that the minimal width therefore should be at least of the same order of magnitude as "b" (see FIG. 1*b*).

The Self-Adaptive Segmented Orifice (SASO), of the present invention brings about two principal concepts:

The Self-Adaptive Gate Unit.

The Segmentation concept

A discussion of these two concepts follows.

Figure 4A:
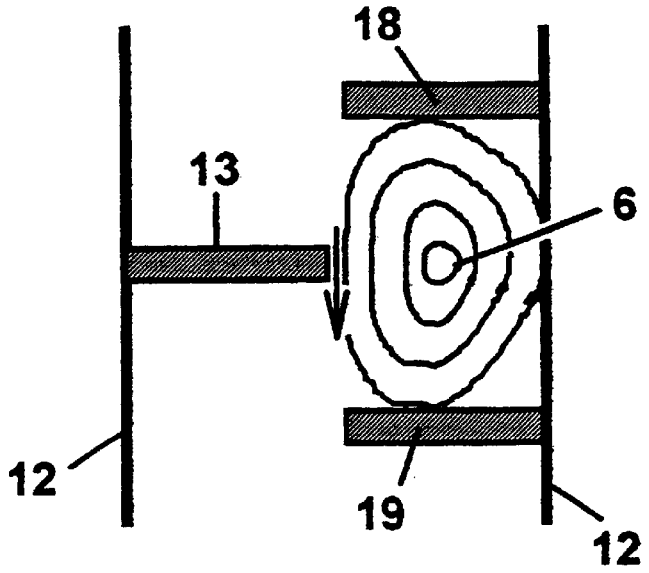
FIG. 4*a* illustrates a sectional partial view of a SASO-device in accordance with a preferred embodiment of the present invention, depicting Radial Self-Adaptive Gate Unit (SAGU).

Each vortex and the opposing fin define a "Self-Adaptive Gate Unit" (hereafter referred to as SAGU), which is the fundamental unit of the present invention as illustrated in FIG. 1*b*, depicting a sectional view of a SASO-device in accordance with a preferred embodiment of the present invention. A SAGU is a "virtual" orifice unit consisting of two complementary elements, a solid element—the fin, and a dynamic element—a vortical fluid structure positioned between two fins of the opposite fin array (15). Hence, SAGU is a dynamic entity that exists as long as fluid motion through the conduit is maintained. Two distinct SAGU types are relevant for the present invention:

Radial SAGU—where the fin (13) substantially points toward the vortex (6) core, positioned in the opposite SASO-cell, between two consecutive fins of the opposite fin array (18,19), as shown in FIG. 4*a*.

Figure 4B:
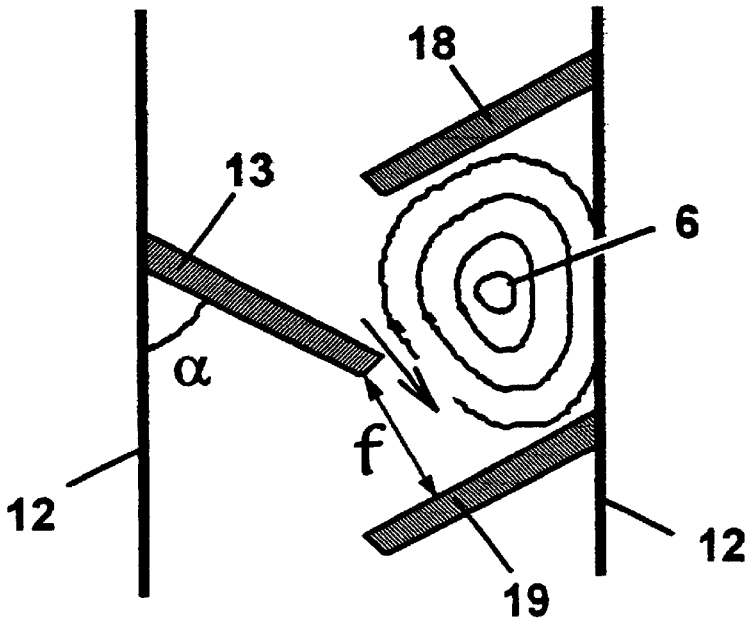
FIG. 4*b* illustrates a sectional partial view of a SASO-device in accordance with a preferred embodiment of the present invention, depicting Tangential Self-Adaptive Gate Unit (SAGU).

Tangential SAGU—where the fin (13) is substantially tangential to the circular motion of the vortex (6), with the fins inclined with respect to the conduit wall (12), defining angle "α" between the fin and wall (12), and introducing a typical distance "f" which is the shortest distance between the tip of a fin in one fin array and the closest fin of the second substantially opposite fin array, see FIG. 4*b*.

A Hybrid SASO-device consisting of both SAGU types is also included in the scope of the present invention.

Due to a significant increase of the fluid-dynamic resistance, a SASO-device incorporating several SAGUs, may be of appealing engineering advantage in two aspects:

Significantly increased internal pressure drop (ΔP), is developed within the conduit, in comparison to conventional conduits of the same hydraulic diameter.

The through-flow is substantially blocked by the vortices, and consequently MFR is dramatically reduced, relative to the MFR through a conventional conduits.

It has to be emphasized here that these two aspects are functionally related, and it is SASO-technology that manipulates and exploits this mutual dependence.

The second fundamental substance of the SASO in accordance with the present invention is the Segmentation Concept. In practice, it is beneficial to employ a combination of SAGUs, to configure a well functioning SASO-device. This is the essence of SASO-technology that provides SASO-devices with new or improved predetermined feature, to fulfill specific engineering requirements for Injection systems used to generate aerodynamically induced forces.

A fundamental aspect of the present invention is the self-adaptive nature of SASO-devices. Such devices respond differently from conventional devices to changing or unsteady external conditions. In particular, SASO-devices are superior when external conditions are not stable or intentionally altered, or when adjustable functionality is required to meet different engineering requirements. Ultimately, the dynamic nature of the vortical flow pattern and the possible interactions of the vortices with the core-flow render the SASO its self-adaptive behavior.

SASO-technology can be used to manipulate two essentially different engineering aspects:

A SASO-device can be used to withhold a substantial internal pressure drop (ΔP), resulting from the aerodynamic blockage mechanism.

A SASO-device can be used to limit or control the motion of any fluid through the conduit, by generating aerodynamic blockage.

The fundamental idea of the present invention is manifested by the following statement: the SASO in accordance with a preferred embodiment of the aerodynamic blockage mechanism imposed by the Self-Adaptive Segmented Orifice of the present invention is effective as long as the SASO-device special configuration imposes the development of the vortical flow field patterns, thus achieving substantial control over the flow through the conduit.

When the flow through the conduit commences, vortices are not yet developed and therefore initial MFR is relatively large (during a transitional period). A short while later, as the transitional period is over, the vortical flow pattern is fully developed and efficiently blocks the flow through the conduit. As a result, the internal pressure drop (ΔP) is significantly increased and MFR is drastically reduced. It has to be emphasized that transitional events are predominantly responsible for the self-adaptive nature of the present invention. When a fluid starts flowing through the conduit, the SASO-device "reacts" in a self-adaptive manner, as the vortical flow pattern is instantly developed and aerodynamically blocks the flow.

The transitional period also exhibits the multiple-functioning nature of the SASO, a most important feature of the present invention, where different performances are exhibited by the SASO-device at different working conditions, or when it operates at varying working conditions. The characteristics of the vortices and consequently MFR and ΔP, strongly depend on various flow-field phenomena and, most importantly, on the internal configuration of the SASO-device conduit that dictates the internal vortical flow patterns.

The Self-Adaptive Gate Unit, SAGU, is the basic component of the present invention that features both structural elements and a flow-field element. Therefore a SAGU may be regarded as a "dynamic" or fluidic type of a gate. A SAGU includes the following elements:

One SASO-cell, on one side of the SASO-device conduit walls.

One fin of the opposite array of fins (on the opposite conduit wall).

One principle vortex (of steady or non-steady nature).

An illustration of one SAGU, shaded with diagonal lines, is given in FIG. 1*b*. A SASO-device may consist of one or more SAGUs, sequentially arranged in an anti-symmetric configuration as shown in FIG. 1*b*. When a plurality of SAGUs are used, unsteady vortical flow patterns, strong vortices/core-flow interactions and communication between SAGUs may significantly modify the practical characteristics of the SASO-device.

For the clarity of the presentation, only one type of SAGU was introduced so far. In accordance to the SASO of the present invention, two distinct types of SAGU may be considered:

a Radial SAGU—characterized by a core-flow being substantially perpendicular to the SAGU fins. This SAGU type is the one that was presented above, and illustrated in FIGS. 1*a*, 1*b* and 3, and further described in FIG. 4*a*.

a Tangential SAGU—characterized by a core-flow being locally and substantially parallel to the SAGU fins, as shown in FIG. 4*b*.

a combination of Tangential and Radial SAGUs may be implemented in a single SASO-device, to fulfill different engineering requirements of injection systems used to generate aerodynamically induced forces, and is also covered by the scope of the present invention, as long as the SASO-idea is maintained.

The definition of the physical dimensions of the Tangential SAGU are similar to the dimensions defined for the Radial SAGU, except for the gap "d" that becomes irrelevant. Two variables, the angle "α", and the distance "f", define the effective gap of the Tangential SAGU as shown in FIG. 4*b*. Angle "α", defines the orientation of the fins with respect to the conduit wall, and does not have to be identical for all the fins. The dimension "f" is the shortest distance between the tip of a fin from one set to the opposing fin of the second set, as shown in FIG. 4*b*. The basic idea of the present invention, generating an aerodynamic blockage by vortical flow patterns, is also dominant in the case of the Tangential SAGU, but the details may be different.

The essential difference between the Tangential SAGU and Radial SAGU, is the local wall-jet flow that is developed due to the core-flow motion that is parallel to the fin. Two significant aspects distinguish the Tangential SAGU flow-field from the Radial SAGU flow-field are the increased amplitude of the core-flow lateral wavy motion, and the relatively violent local impingement of the core-flow on the facing fins (see FIG. 4*a* for a comparison with a Radial SAGU). Consequently, a different distribution of fluid-dynamic forces is generated upon the SASO-cell walls. These phenomena might significantly affect the main features of the present invention, namely, increasing the ΔP and decreasing the MFR.

Another distinct aspect of the Tangential SAGU in comparison with the Radial SAGU, is the change in fluid-dynamic resistance, when the fluid flow direction is reversed. It is due to the fact that while the Radial SAGU is of a "symmetric" nature with respect to flow direction, the Tangential SAGU has an "asymmetric" nature, in that respect. This tangential SAGU "dual behavior" may be beneficial, for instance, when a different fluid-dynamic resistance is required to inject or suck a fluid, in different operational stages, with different ΔP (or MFR) requirements.

The second principle concept of the SASO of the present invention, and the SASO-technology is the Segmentation Concept. It states that specific engineering requirements can be fulfilled by a sequential arrangement of a plurality of SAGUs. Thus, a SASO-device can be configured with a plurality of identical type SAGUs, or by using a combination of more than one SAGU type. In other words, each SASO-device is characterized by a specific SAGU arrangement, the number of SAGUs, and the types of SAGUs used. In this way the same basic components (SAGUs), can be re-utilized to design SASO-devices of different characteristics, to be implemented for various types of injection systems used to generate aerodynamically induced forces. Thus, the Segmentation Concept, included in the SASO-technology procedure of design, involves the selection the SAGU types and the optimal number of SAGUs to be used, and the SAGU axial arrangements along the specific SASO-device.

Therefore, any combination of SAGUs, in corporation with any configuration of the SASO-device inlet or outlet sections that are assembled together in the design, are all covered by the present invention. It is further noted that any variant of a SASO-device that is based substantially on the SASO-idea of vortical aerodynamic blockage including possible incorporation with various passive or active means, of various engineering disciplines, is covered by the scope of the present invention.

The present invention involves a wide variety of SASO-devices with distinct configurations. Some optional SASO-devices that can be applied in injection systems used to generate aerodynamically induced forces are hereafter described, without limiting the scope of the invention as defined by the appended Claims.

Figure 6B:
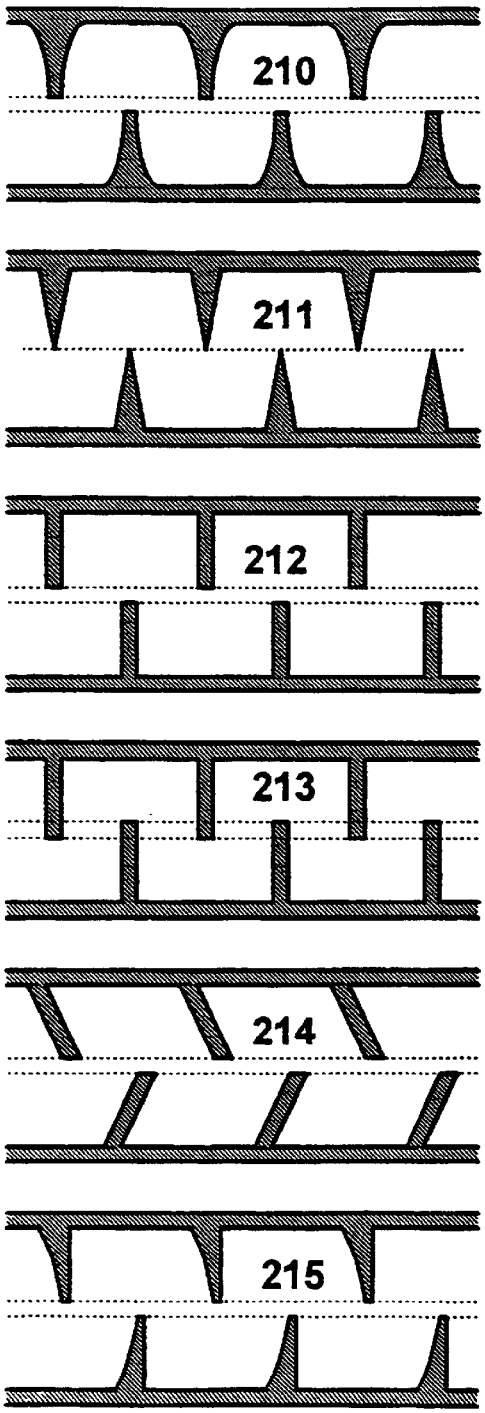
Figure 6C:
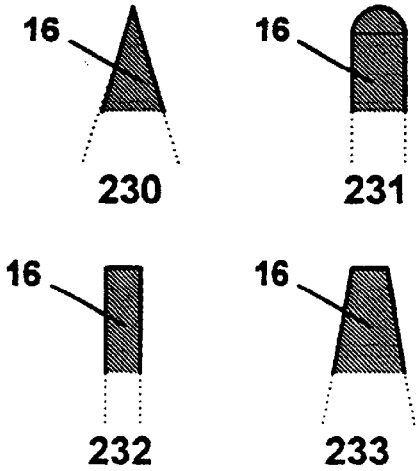
Figure 7A:
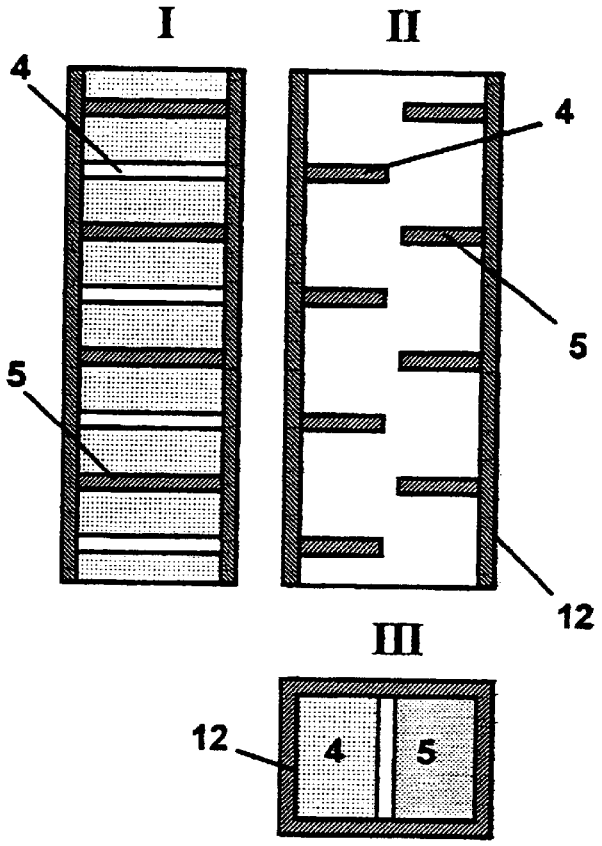
FIGS. 7*a–c* display a three-dimensional view, and three cross-sectional side views of a SASO-device in accordance with a preferred embodiment of the present invention, and presents optional fin-surface formations, in accordance with a preferred embodiment of the present invention.
Figure 7B:
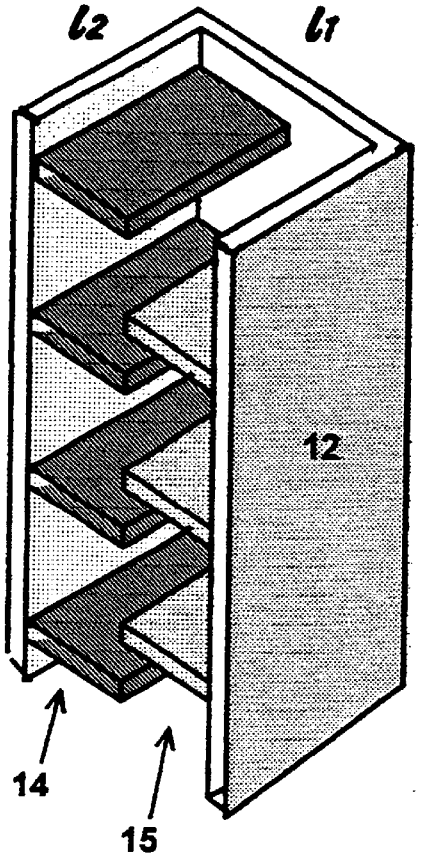
Figure 7C:
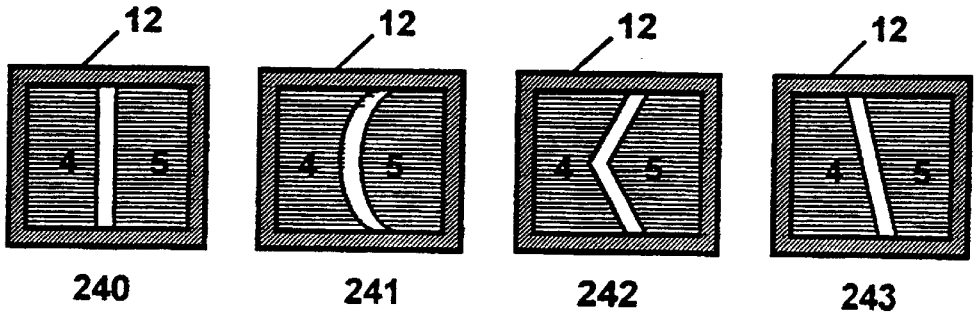

The basic SASO-device is the "SASO-tube" of rectangular cross section, illustrated in FIG. 7*a*. It is essentially a three-dimensional SASO-device, where the third dimension of typical width "12" is the "passive direction". Although the main fluid dynamic patterns are of a two-dimensional character, secondary flow effects of three-dimensional character may develop. The flow is of a three-dimensional nature when approaching the side walls (of the "passive" direction). As "I2" (FIG. 7*a*) reaches a sufficiently small value, the flow becomes of significantly three-dimensional nature and viscous effects may significantly affect the SASO-tube performance. In particular it may cause an intensive decay of the vortical flow patterns, thus the aerodynamic blockage mechanism may be severely deteriorated. It is recommended that the size of "I2" should be, at least, similar to "I1" to practically avoid the above wall effects. Two side views and one top view of the basic two-dimensional configuration, are illustrated in FIG. 7*b*. Lateral side view I shows the "active" dimension, with the two opposite fin arrays. Side view II shows a sectional view of both fin arrays appearing interlaced (this is of course not true, but the angle of view provides the interlacing effect). Top view III shows the first two opposite facing fins (4,5) at the inlet. As already mentioned, fins of different laterally span distribution are optional, as shown in FIG. 7*c*. FIG. 6*b* illustrates several optional fin cross section or fin profiles, The fin profile can be rectangular (212), sharp (211), curved (210) or of different fin's side surfaces (215). The arrays of fins can overlap (213) or not (212) or with no gap between them (211). The fins can be mounted perpendicularly to the SASO-conduit walls (212), or inclined with respect to the SASO-device conduit wall (214). The fin arrangement can provide a different behavior with respect to the direction of flow (214–215) or to be not sensitive to the flow direction (210–213). By using different fins, the characteristics of the flow separation can be manipulated, thus SASO-tube performance may be modified to fulfill specific requirements. This basic SASO-device consists of a predetermined number of identical SAGUs, as stipulated by SASO-technology procedure of design, depending on the engineering requirements of a specific injection system used to generate aerodynamically induced forces.

A modified SASO-device, namely a "SASO-slot", is defined in cases where "I2" is the lateral length of the fin along the passive direction is considerably larger then "I1", the second lateral direction, as illustrates in FIG. 6*a* (222). Within this basic SASO-slot of stretched rectangular cross-section, the flow is essentially two-dimensional, as the lateral scale of the boundary layers and the resulting viscous effects, at the edges of the slot, is practically negligible in respect to "I2". Consequently, the one-dimensional lateral suppression (by the vortices) of the core-flow width, or, alternatively speaking, the aerodynamic blockage mechanism, may be more efficient.

Figure 7D:
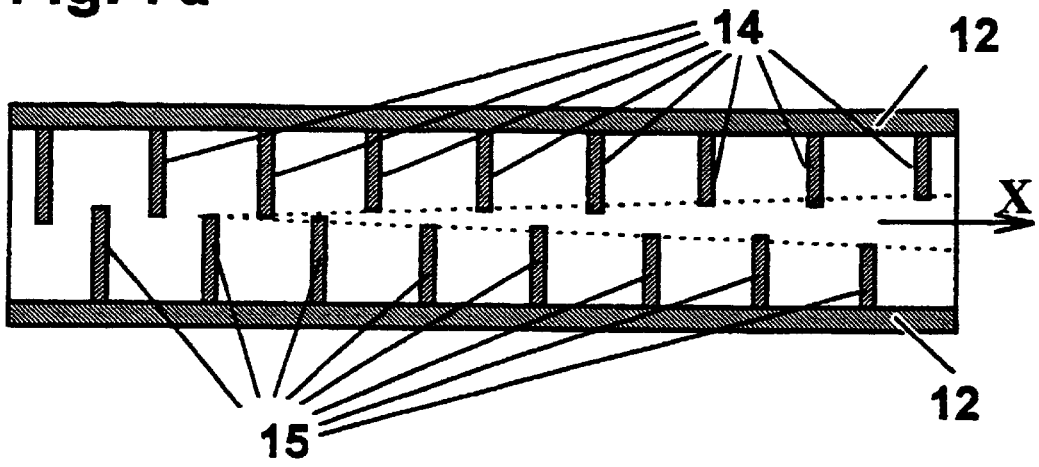
FIGS. 7*d–f* depict three optional fin alignments and fin construction incorporated in a SASO-device, in accordance with a preferred embodiment of the present invention, rendering a "Directional" SASO-device.
Figure 7E:
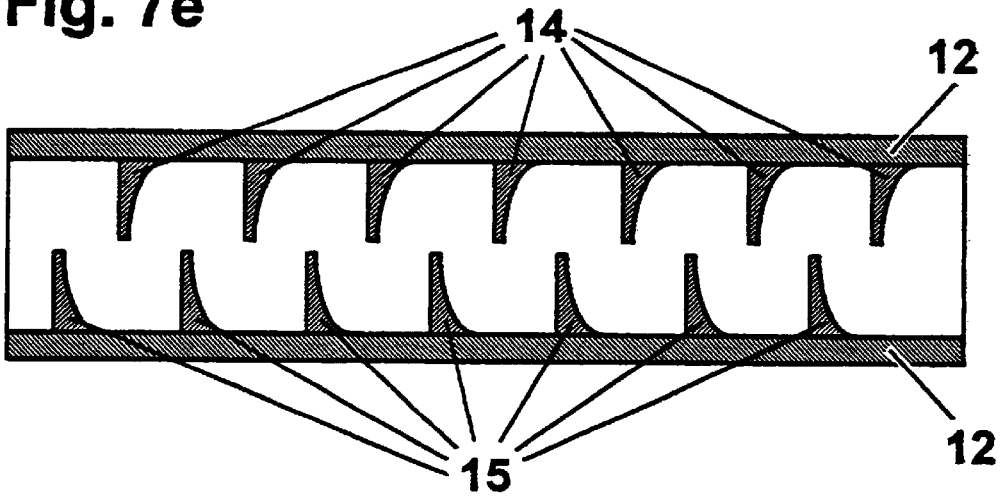
Figure 7F:
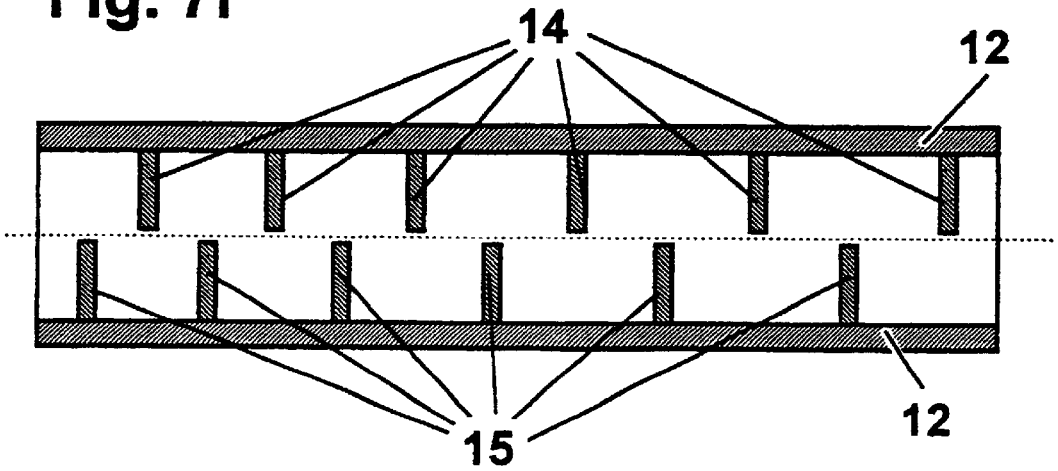

"Directional" SASO-device configurations are illustrated in FIGS. 7*d*, 7*e* and 7*f*, where the fluid-dynamic resistance becomes significantly different when the flow is reversed in direction. The asymmetric profile (215) and the inclined fins (214), see FIG. 6*b*, are features of a directional SASO-device. Also the converging and diverging conduits (FIG. 2*b* 203,204) establish a directional SASO-device. Additionally, FIG. 7*d* is a "directional" SASO-device, where the span of the fins (14,15) is shortened gradually in a predetermined flow direction x. In this embodiment the core-flow is divergent in direction x, or convergent if the flow direction is reversed, as the aerodynamic resistance is not similar in both directions. FIG. 7*e* shows a different "directional" SASO-device, where one surface of the fins (14,15) is, for example, flat and the opposite side of the fin is curved. In this case the characteristics of the vortical flow patterns and the core-flow are manipulated differently, and the aerodynamic resistance varies, when the flow changes its direction. In fact, a SASO-device based on Tangential SAGU is a typical example of a Directional SASO-device. FIG. 7*f* show different "directional" SASO-device, where the pitch or the distance between two consecutive fin changes substantially in a predetermined flow direction x.

Figure 8A:
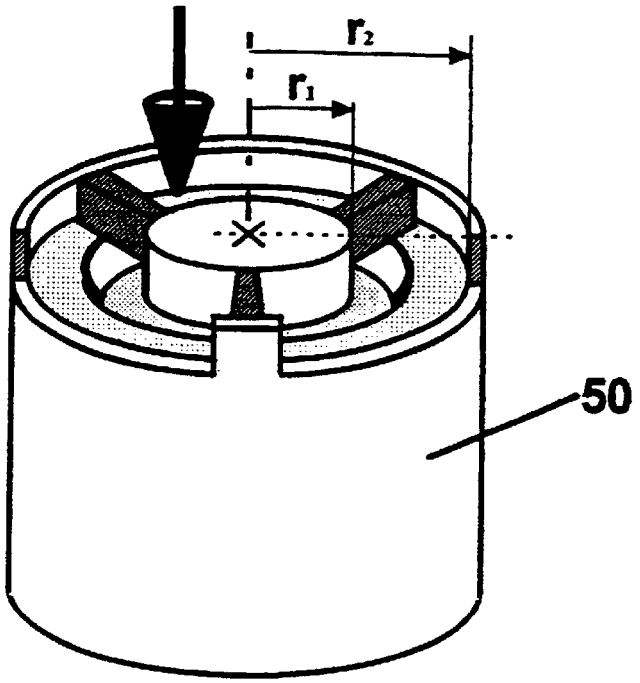
FIGS. 8*a,b* illustrate an annular SASO-slot, in accordance to a preferred embodiment of the present invention.
Figure 8B:
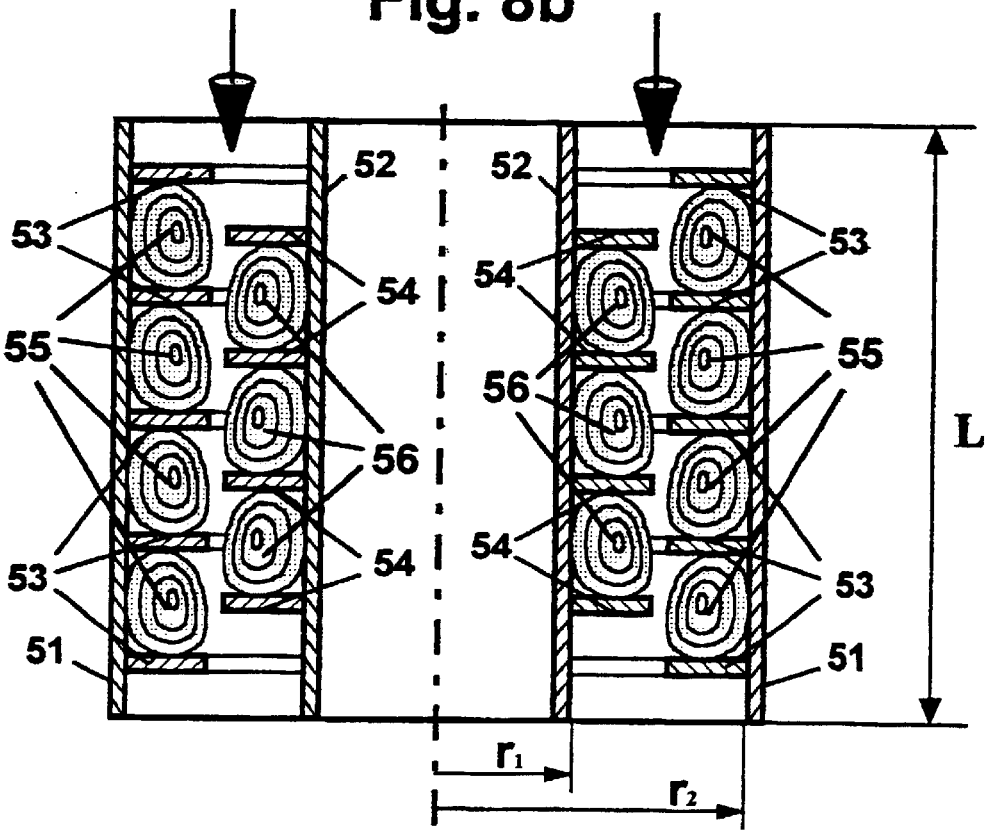

The examples discussed so far are all dealing with open curved vortex lines (having two ends). A special case of the SASO-slot is the annular SASO-slot, shown in FIG. 8, which exhibits the possibility of creating two arrays of closed-loop vortices (in this case, two arrays of vortex-rings). FIG. 8*a* illustrates an annular SASO-slot (50), having two opposite ring-shaped fins arrays (the top two fins are shown in FIG. 8*a*, and see also fins (53, 54) in FIG. 8*b*), where the annular SASO-slot conduit has an internal wall (52) of radius $r_1$, and an external wall (51) of radius $r_2$, as shown in FIG. 8*b*. FIG. 8*b* illustrates a sectional view of the annular SASO-slot, where two arrays of ring-shaped fins (53,54) are positioned within the internal walls (51, 52) of the annular conduit. The vortical pattern formed in an annular SASO-slot is in the form of two arrays of vortex-rings (55, 56). Note that in this configuration the core-flow suppression by the vortex-rings is also of a one-dimensional character.

Figure 9B:
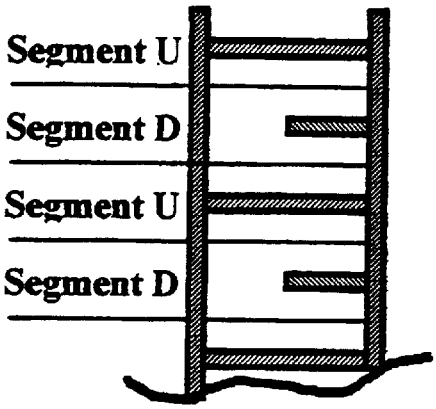
FIGS. 9*a–b* illustrate a SASO-device, in accordance with another preferred embodiment of the present invention, with L-shaped fins (and U-shaped fins), exhibiting 3-dimensional core-flow suppression.
Figure 9A:
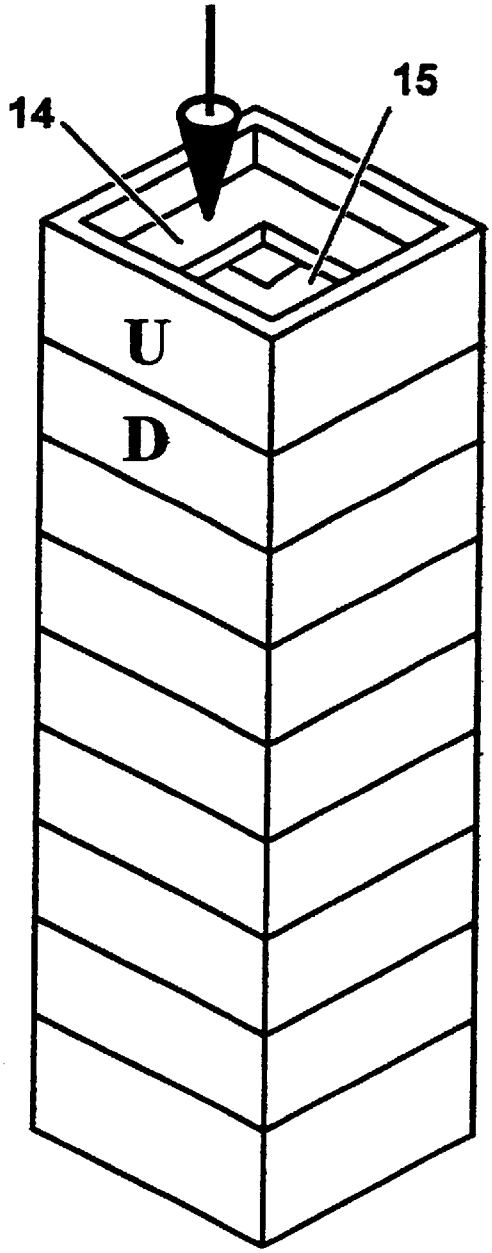
Figure 9C:
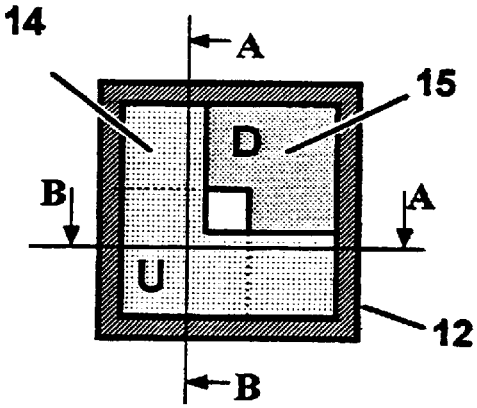
Figure 9D:
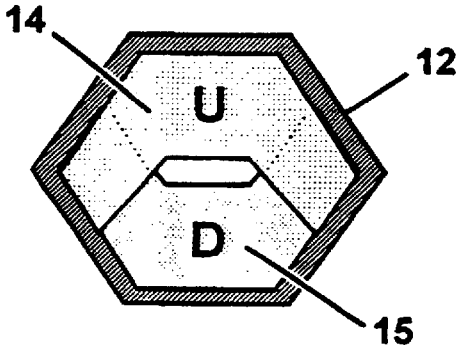

A different type of a SASO-device, of a three dimensional character, is presented in FIG. 9*a*. This type of a SASO-device has a conduit of lateral rectangular cross section (FIG. 9*b*) with "L" shaped fins (14,15), that are consecutively located at opposing corners. FIG. 9*c* depicts a longitudinal cross section view (cross-section A-B as shown in FIG. 9*b*), of the first fins (segment U and segment D) arrangement inside the SASO-device. In this three-dimensional type of SASO-device, the core-flow is laterally suppressed by the vortices in a two-dimensional manner. Two-dimensional suppression is the most significant issue of three-dimensional variants of SASO-device, where in a two-dimensional SASO-device variants, the core-flow lateral suppression is of one-dimensional character. As a result of the two-dimensional core-flow lateral suppression, the aerodynamic blockage efficiency of three-dimensional SASO-device configurations is expected to be significantly improved, expected to improve. Another similar alternative is shown in FIG. 9*d*, where "U" shaped fins (14,15) are mounted within a conduit having a polygon cross-section.

Figure 10:
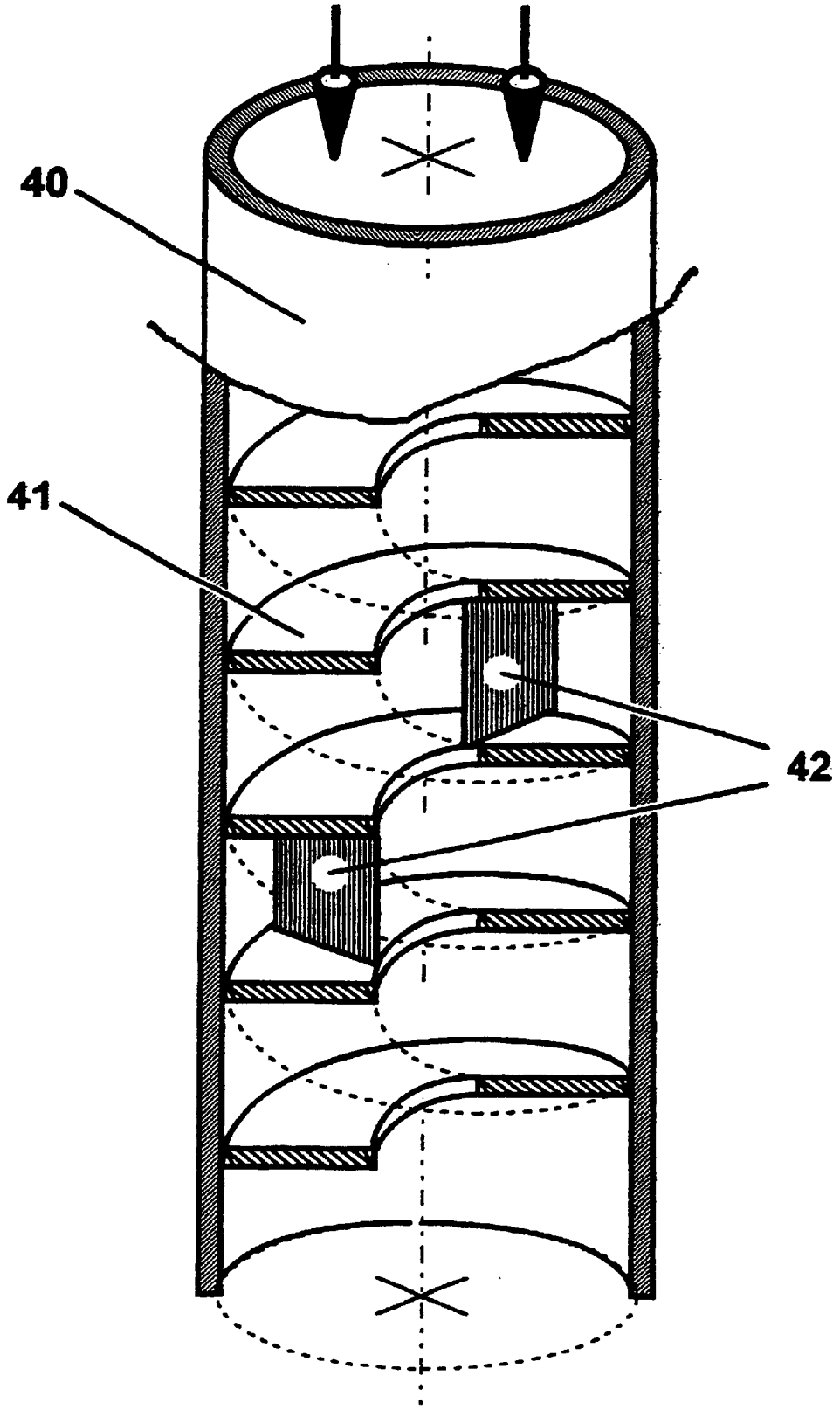
FIG. 10 illustrates a SASO-device, in accordance with another preferred embodiment of the present invention, with single helical fin, exhibiting 3-dimensional core-flow suppression and dual passage character.

FIG. 10 illustrates a longitudinal cross-section view of a SASO-device comprising a conduit (40), here possessing circular lateral cross section, with a single fin (41) presenting an internal helical structure. It is in fact one helical fin, optionally provided with barriers (42) distributed along the device to enforce flow separation and prevent a natural selection of a helical flow motion that may be triggered at specific combinations of the geometrical parameters. Note that the presence of such barriers is not essential, but may improve flow separation. Optionally, both fin ends may be provided with extruding rims, projecting substantially normal to the fin surface, used as a seat to hold the helical vortex at its both ends.

This is a three-dimensional SASO-device type where the core-flow is being laterally suppressed from all directions in a two-dimensional circumferential manner by the helical vortex that is developed. Therefore, such a configuration of SASO-device is essentially an efficient variant enhancing aerodynamic blockage effect. Furthermore, this SASO-device configuration offers a dual passage for the fluid flow. The flow can separate from the fin and move in the central passage, thus creating a thin core-flow, or move in a helical course along the fin. The geometrical design, with or without barriers, is aimed to make the flow choose the first central route, and separate from the fin, filling the helical cavity behind the fin with a helical vortex, thus obtaining similar pattern as the SASO-tube described before. However, if a contamination of any kind is stuck in the central passage and physically blocking the flow locally, this type of a SASO-tube offers an alternative passage—the helical route—to overcome this obstacle locally, and then resume the central separation route, in a self adaptive manner or it is forced to resume the central separation route by the next barrier (if it exists). This dual passage character is of great practical importance since it offers a SASO-device with its advantages, that is "almost free" of mechanical blockage, and can thus operate well in specific injection system used for aerodynamically induced forces applications, where severe contamination environment exists.

The internal features of SASO-devices (such as the fin construction, size, texture and shape, etc.) apply accordingly to the helical fin SASO-device too.

Without derogating the generality, hereafter we present several preferred embodiments of injection systems for aerodynamically induced forces applications in accordance to the present invention, that uses one or more SASO-elements to generate fluid-induced forces. The embodiments include air-cushion support, conveying, load carrying, air bearings, upper non-contact gripping and high-pressure hold-down with contact. These embodiments exhibit the versatility of the present invention and point out the SASO advantages and superior performance, in particular with respect to its "aerodynamic return spring" characteristics. Such SASO-technology based injection systems for aerodynamically induced forces applications, are all based on air injection, but this technology is not limited to air and any gas or liquid can be used depending on the specific aerodynamically induced forces application desired.

Air Bed Support and Conveying Systems

A common injection system of the present invention, used to generate aerodynamically induced forces is the air-cushion apparatus. Such a supporting or conveying system uses air injection to generate air-cushions to support the objects to be conveyed with no contact with a solid surface, thus it either protects the object from a contact damage, or conveys it applying significantly less energy, as the friction coefficient is greatly reduced, or both.

Figure 11:
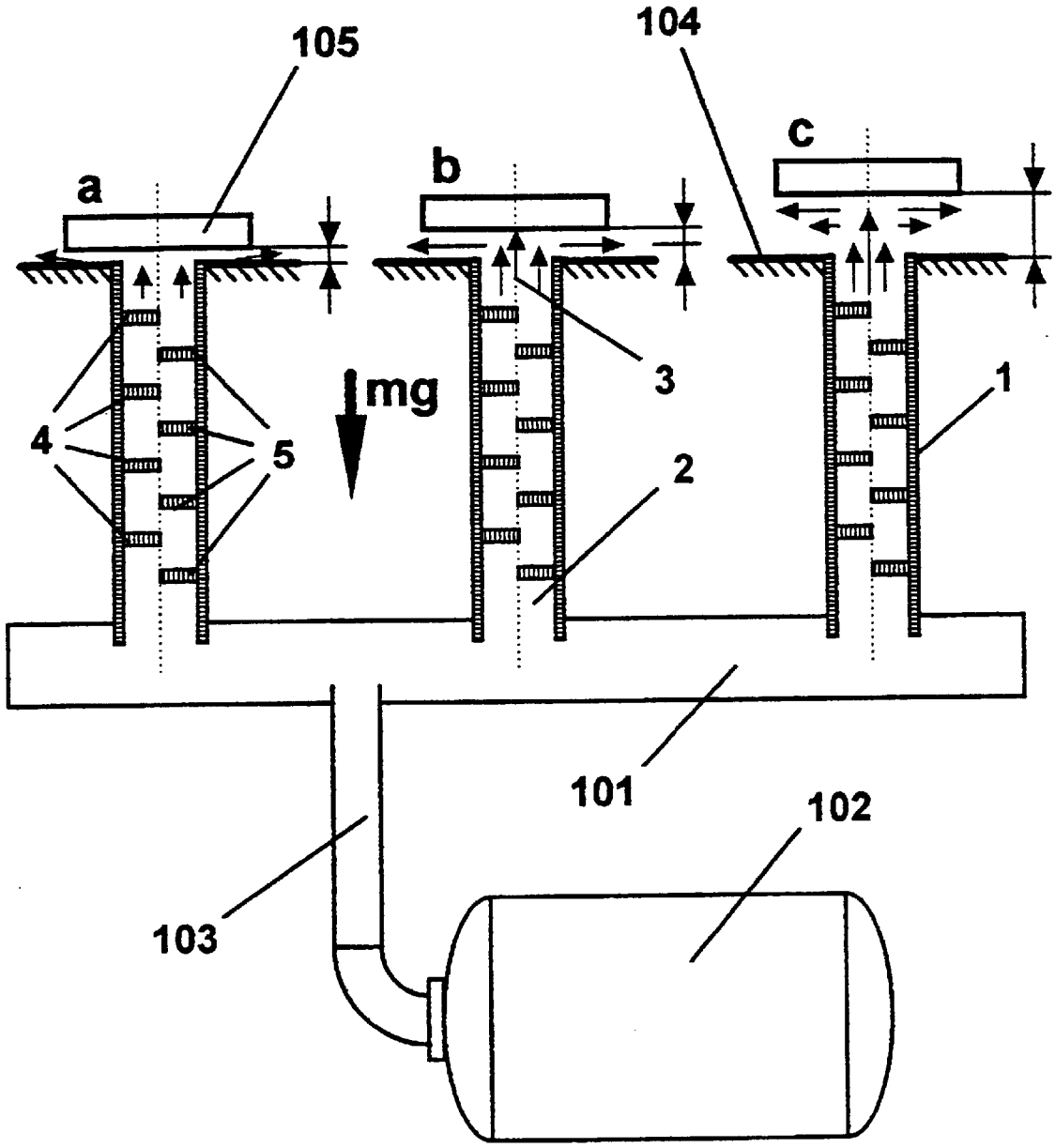
FIG. 11 illustrates a fluid injection apparatus, in accordance to a preferred embodiment of the present invention, serving as an air-cushion no-contact supporting system.

FIG. 11 illustrates an injection system used to generate an aerodynamically induced force, with accordance to the present invention, serving as an air-cushion non-contact supporting system. The system comprises a high pressure manifold (101), connected by high pressure pipe (103), to a high pressure source (102). A SASO-conduit (1), whose inlet (2) is connected to the high pressure manifold, and the outlet (3) is located on the injection-surface (104), of the injection system. It should be noted that the internal configuration of the SASO-conduit can be selected from the embodiments shown in FIGS. 1–10, or can be of any other SASO-conduit configuration covered by the scope of the appending Claims. The selection of specific design is done with regards to the specific engineering requirements. FIG. 11 shows three positions of an object (105), being supported by an air-cushion produced by the injection system in an non-contact manner. In position "b" the object is at a distance X from the SASO-conduit outlet, and there is an equilibrium between the object weight −mg, and the aerodynamically induced force F. In position "a" the distance X to the SASO-conduit outlet is decreased and the force F increases and pushes the object back to equilibrium position "b". This position control of self-adaptive nature results from the SASO "fluidic return spring" behavior. In position "c" the distance X increases with the force F decreasing, thus the object weight pulls the object back to its equilibrium position "b". This equilibrium position is unconditionally stable.

Figure 12:
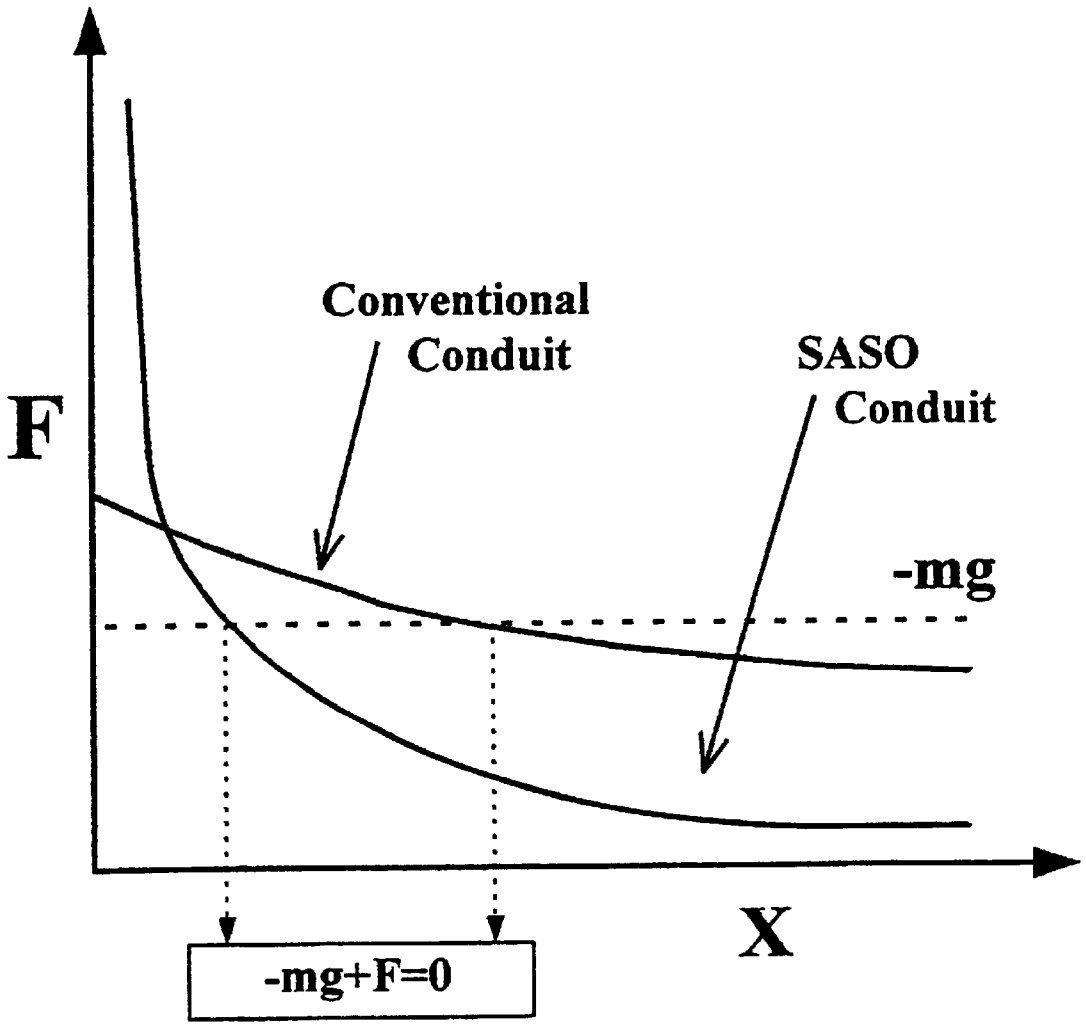
FIG. 12 illustrates the relation between the displacement and the forces that act on an object being supported by an air-cushion in accordance to a preferred embodiment of the present invention, compared with a conventional air-cushion.

FIG. 12 illustrates the relation between the distance X and the aerodynamically induced forces F, that act on an object being supported by an air-cushion injection system based on SASO-conduits, with comparison to a similar air-cushion system equipped with conventional conduits. The advantage of employing SASO-conduits for air-cushion support is illustrated in FIG. 12, where the SASO fundamental feature of sustaining large internal pressure drop is beneficially implemented.

When air is injected through one or more SASO-conduits, the object is at equilibrium position in a much shorter distance X with respect to conventional conduits. As X decreases, with the SASO-conduit outlet being almost covered, most of the manifold high pressure applied at the SASO-conduit inlet is introduced to the outlet due to a decay of the vortical aerodynamic blockage effect within the SASO-conduit, and the internal pressure drop $\Delta P$, is dramatically reduced. Therefore, when the object is not in equilibrium and the distance X decreases, the SASO-conduit "aerodynamic return spring" possess a "stiff" character, where the stiffness directly relates, to the internal pressure drop $\Delta P$ through the SASO-conduit. The SASO-conduit exhibits an "aerodynamic return spring" that acts as a self-adaptive positioning control mechanism, where much larger aerodynamic return force (relative to conventional conduits) pushes the object back to the equilibrium position, mainly by increasing the static pressure between the injection system "injection-surface" and the object. It means that due to the potential of the SASO-conduit to sustain large internal pressure drop $\Delta P$, the control characteristics with respect to the object positioning is improved. Furthermore, when SASO-conduits are used, the equilibrium position X become significantly smaller, thus accurate positioning control can be obtained, compared to conventional conduits. The characteristics or the sensitivity of the SASO-conduit self-adaptive positioning control is, in fact, the slope of the curve F.vs.X that is given in FIG. 12, where, with respect to conventional conduits, the SASO-conduit slope is extremely steeper at equilibrium position and thus the control characteristics is significantly improved.

Figure 11A:
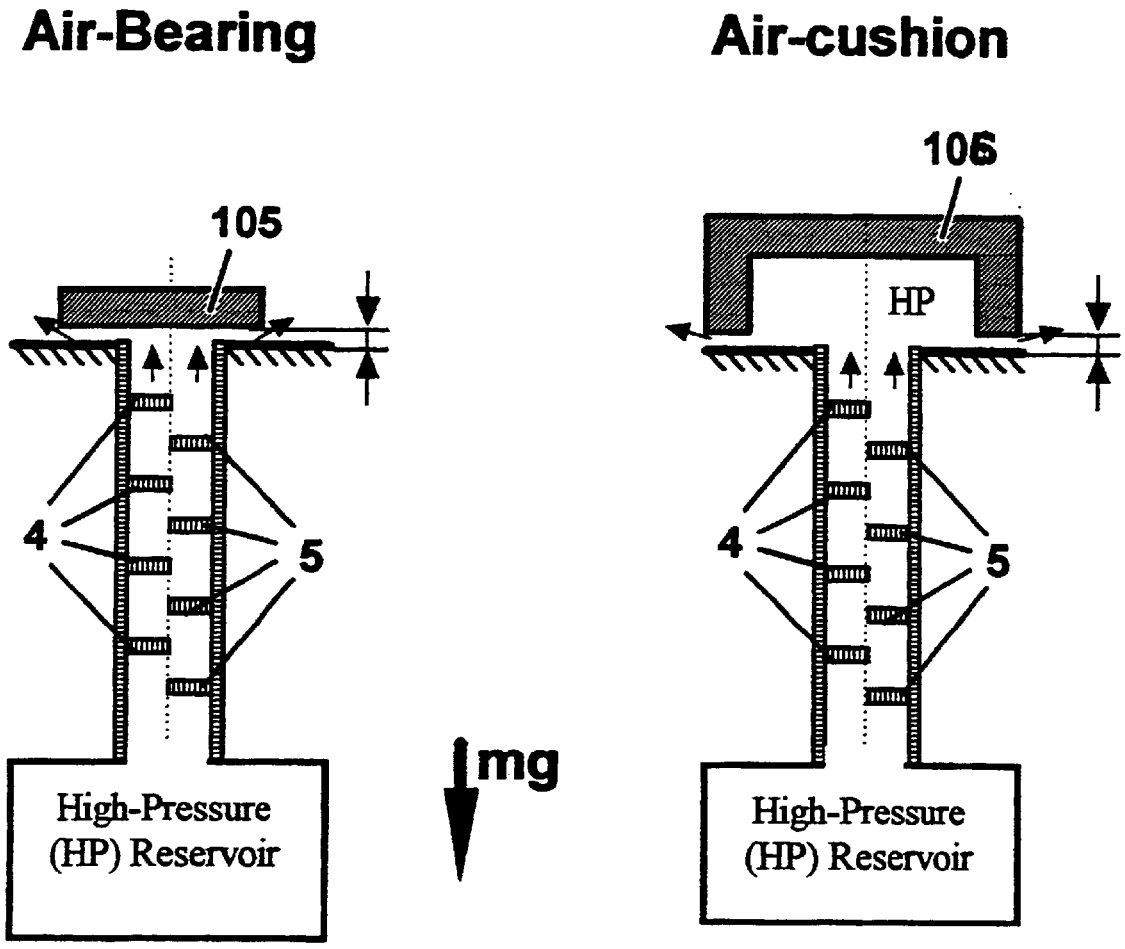
FIG. 11*a* illustrates a fluid injection apparatus, in accordance with another preferred embodiment of the present invention, employed as an air-bearing and an air-cushion system.

The distance X is the distance between the outlet and the lower surface of the object over it, for flat objects. An air bearing system shown in FIG. 11*a* is a typical example, where object (105) presents a flat lower surface to the SASO-device outlet. However if the lower surface of the object over the outlet of the SASO-device is provided with a cavity (106), than although the lower surface of the object is further away than surface 105, the effective distance from the outlet is the distance of the rim which governs the pressure build-up inside the cavity. This feature can be utilized in an air-cushion application.

The required MFR of air-cushion injection system that implements SASO-technology is significantly reduced with respect to conventional conduits. Thus, injection systems that implement SASO-technology bring about a significantly reduced power consumption in comparison to similar system equipped with conventional conduits. A distinction has to be made between cases where the injection system supports the object and cases where the object itself is equipped with the injection system (compare FIG. 13*a* and FIG. 13*b*). In the first case a plurality of conduits are used and most of them may not be covered. In such situation, a full potential of the present invention. with respect to the MFR reduction, can be obtained, since all the uncovered SASO-conduits are aerodynamically blocked.

Figure 13A:
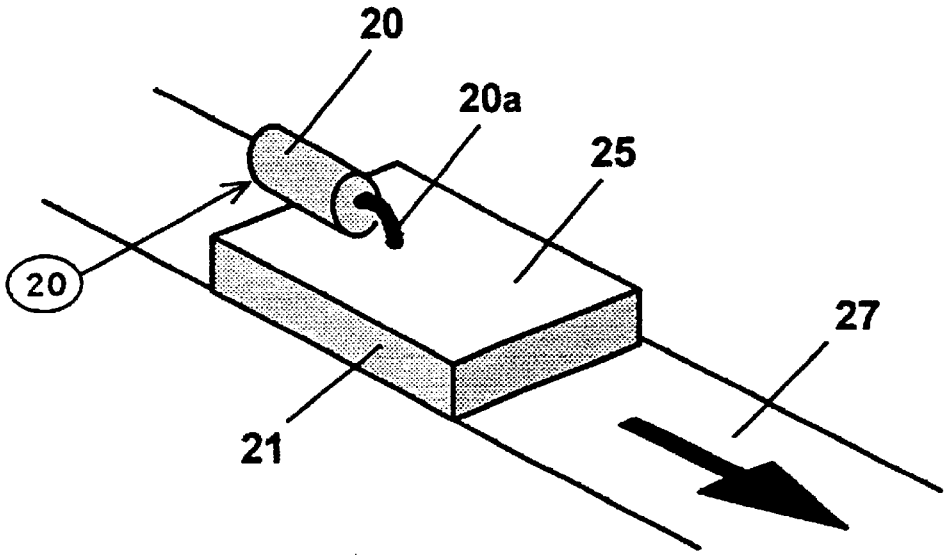
FIG. 13*a* illustrates a Self-induced air-cushion apparatus, equipped with SASO injection elements.
Figure 13A:
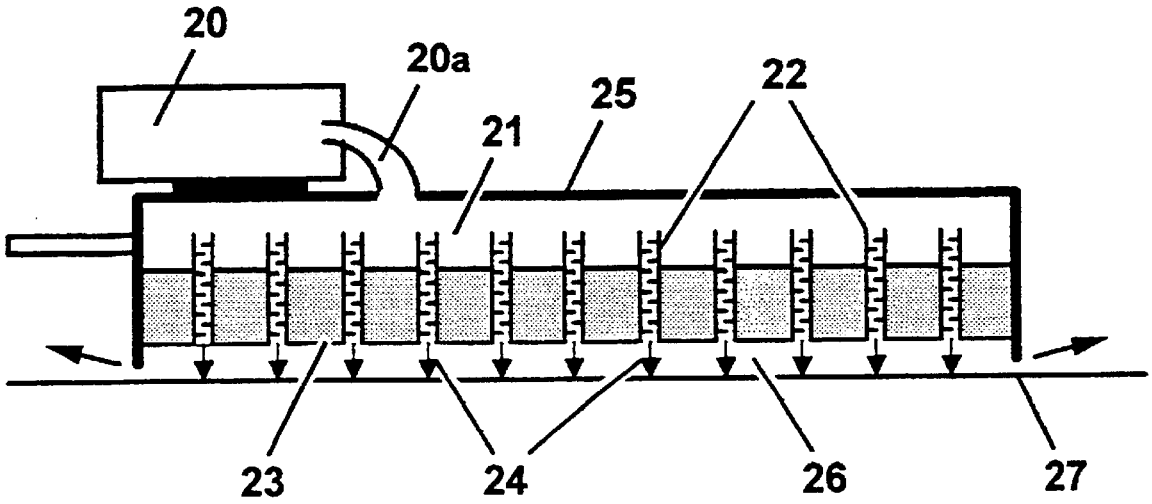

A typical embodiment of an air-cushion conveying system in accordance with the present invention is shown schematically in FIG. 13*a*. A high-pressure sources (20) connected through a pressure hose (20*a*) to a manifold (21). The air is injected through a plurality of SASO-conduits (22) and exits through the conduit outlets (24) at the "injection-surface" of the injection system (23). The injected air generates air bed (26) that supports the "floating" object (25), equipped with the injection system. The air bed is generated between the object surface and the conveying-route floor (27). The object floats in a steady state equilibrium, where the object weight is balanced by the air-cushion aerodynamically induced force. The aerodynamically induced force resulted from the SASO based injection system with accordance to the present invention, has superior performance in comparison with conventional conduits in two aspects: A much higher positioning accuracy and improved positioning control characteristics of self adaptive nature, can be obtained due to the enhanced "aerodynamic return spring" performance of injection system that uses the SASO. In addition, the MFR requirements are significantly reduced.

Figure 13B:
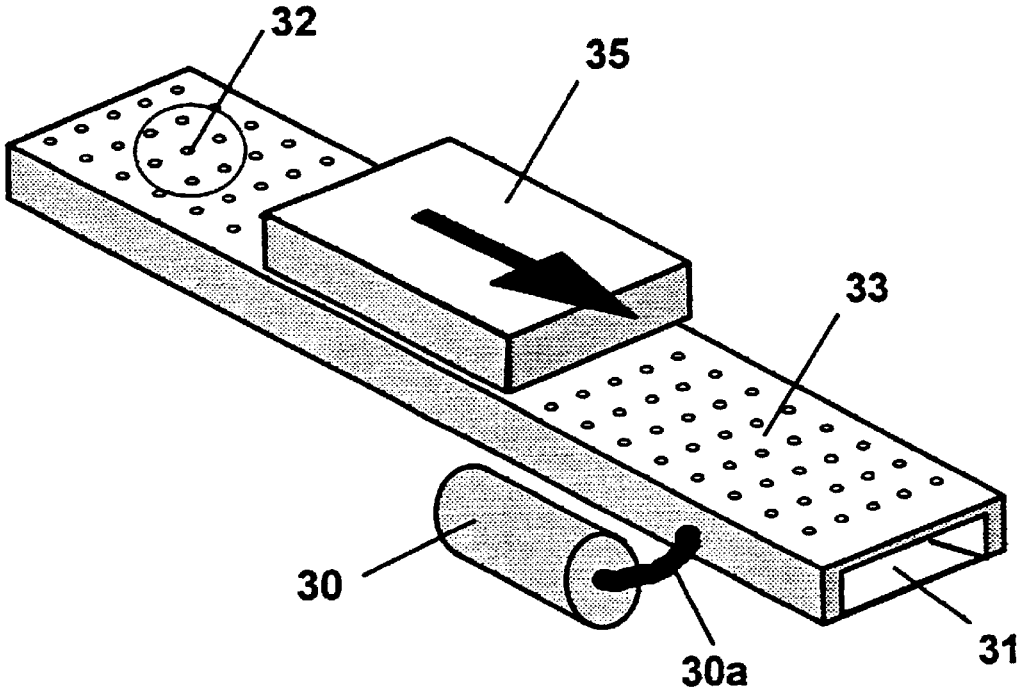
FIG. 13*b* illustrates an injection system, based on SASO-conduits, where air bed is generated by an inert conveyer.
Figure 13B:
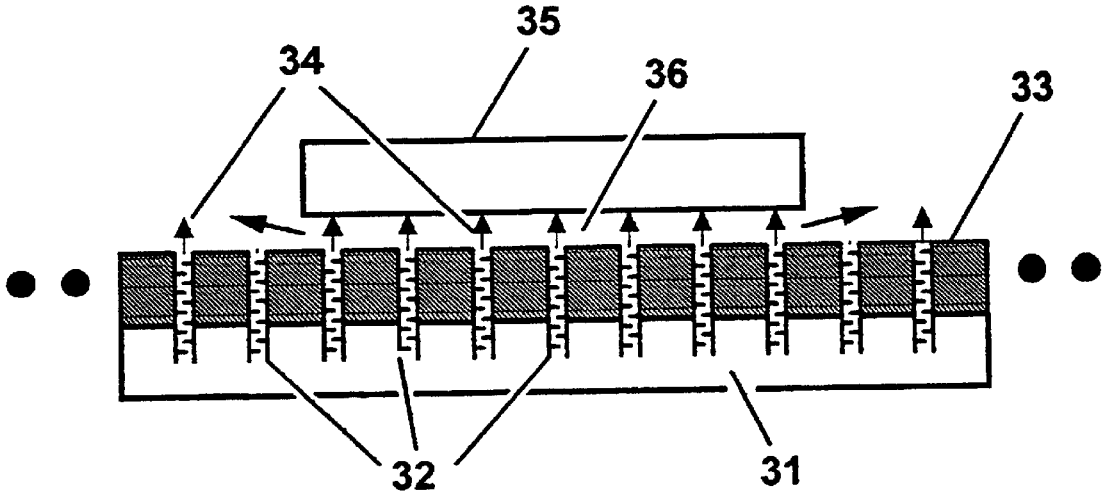

Another embodiment of an air-cushion conveying system is illustrated in FIG. 13*b*. High pressure source (30) connected through a pressure hose (30*a*) to an elongated manifold (31). The air is injected through a plurality of SASO-conduits (32) exiting through the conduits outlets (34) at the injection-surface of an inert injection system (33). The injected air generates an air bed (36) that supports the object (35) that is floating with no contact. Similar to the previous example, an air-cushion is generated, but in this example the injection system is the fixed-in-place conveyer route itself. The superiority of employing SASO-technology is already discussed in the previous example. The inert injection system suffers from a gradually increased parasitic MFR from a plurality of conduits that are not contributing to generate the aerodynamically induced force but they unnecessarily expend (parasite) mass flow. By using employing SASO-technology all the conduits that are not covered will effectively be aerodynamically blocked, thus significant reduction of the MFR is obtained.

Figure 14A:
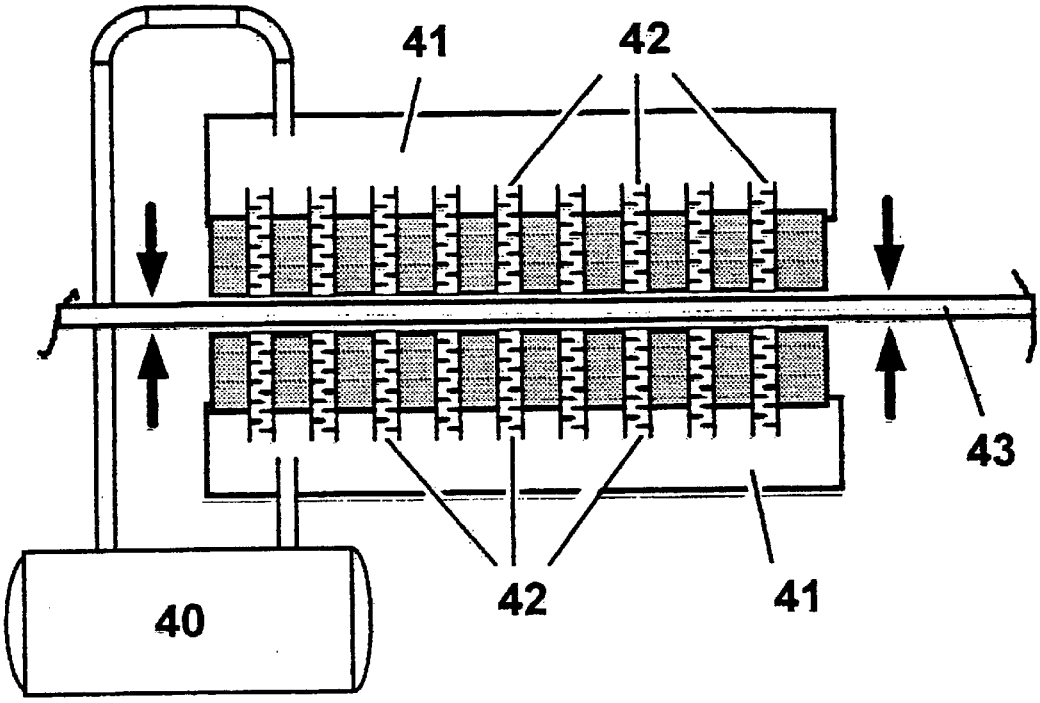
FIG. 14*a* illustrates a dual opposing air-cushion apparatus based on SASO injection elements.

Air-bed supporting or non-contact conveying apparatus may apply fluid injection from more than one direction in various applications. In some case it is important to maintain a distance between a moving objects and stationary surfaces, and in the same time guide the objects in specific routes. This can be achieved by injection from several directions to apply the aerodynamically induced forces to maintain the desired temporal positioning of the conveyed objects. FIG. 14*a* is a schematic representation of such a system, where gravity is irrelevant (thus horizontal or vertical or any other alignment combination is allowed). A flat object (43), possibly flexible (such as paper), is supported or conveyed, between two opposite injection-surfaces, in a pathway defined between the surfaces. A high pressure reservoir (40) feeds the two pressure manifolds (41), pressurized air is injected through SASO-conduits (42), provided to both of the injection system injection-surfaces. The air injection generates two air-cushions that support the object (43) from its two sides. The aerodynamic induced forces are in equilibrium when the object surface is in a same distance from both injection surfaces, as required. When the object shifts closer to one of the surfaces, the aerodynamically induced forces which vary with that distance, change as well. The change of the aerodynamically induced is opposite to the change in the distance, thus the positioning control, of self-adaptive nature, acts as two opposing aerodynamic return springs to return the object back to the required position.

Figure 14B:
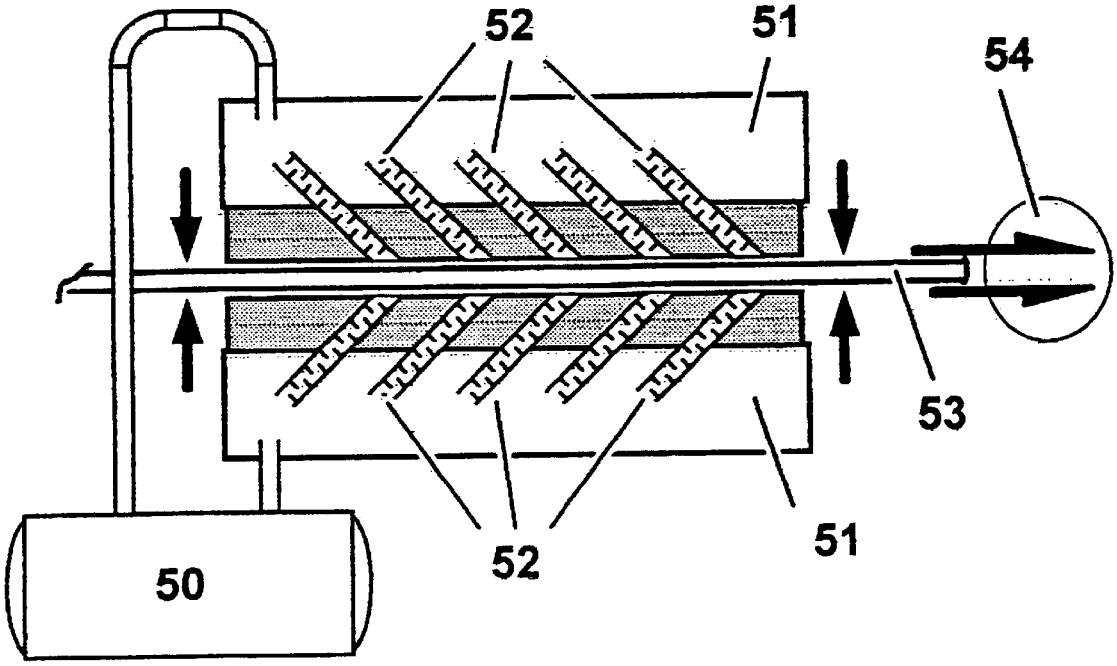
FIG. 14*b* illustrates a dual opposing air-cushion apparatus based on SASO injection elements with fluidic viscous force that are used to move the object.

The injection system of the present invention can be also used to generate a linear motion by using the perpendicular (with respect to the manifold surface) component of the aerodynamically induced force, as seen in FIG. 14*b*. In this embodiment of the present invention, a high pressure source (50) feeds two manifolds (51). The pressurized air is injected through SASO-conduits (52) located in both injection system injection-surfaces, in an inclined orientation with respect to the injection system injection-surfaces. The air injection generates two air-cushion that support the flat object (53) from two sides. In such fluid injection orientation, the object, in addition, is aerodynamically forced to move in a predetermined direction, determined by the direction of inclination of the SASO-conduits (52), the movement evoked by viscous friction forces generated by the parallel flow. The previously discussed advantages of using SASO-conduits in the present invention are also relevant for such air-cushion types of injection systems, and in particular, the aspects of position control and MFR reduction.

Figure 15:
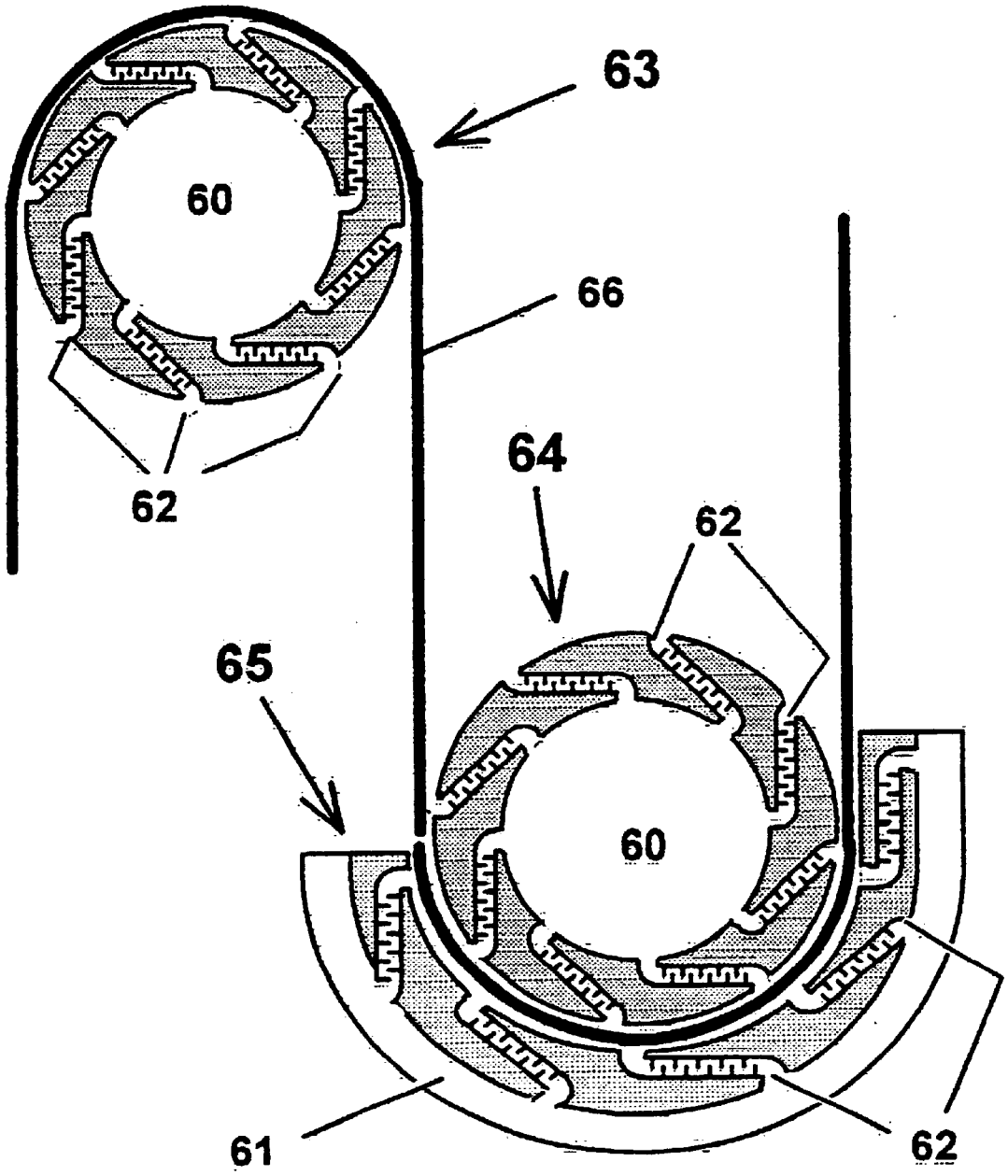
FIG. 15 illustrates two cylindrical air-cushions incorporated as dual air-cushions non-contact supports.

Air-bed of supporting or conveying systems need not be restricted to flat surfaces only, and cylindrical geometry is also allowed, as demonstrated in FIG. 15. In such an injection system (presented in FIG. 15 in a sectional view), internal high pressure reservoirs (60), or external reservoir (61) are used. The system comprises a cylindrical air support surface (64) provided with a plurality of SASO-conduits (62), whose outlets lay on the injection-surface of the cylinder, and whose inlets are connected to the internal high pressure reservoir (60). For conveying objects, such as sheet of paper (63), over the surface, the tension of the object (63) acting against the aerodynamic force exerted by the air-cushion developed over the cylindrical injection-surface, this embodiment (embodiment a in FIG. 15) would suffice. For conveying objects beneath the surface, an additional matching support surface (65) is provided below support surface (64), again having a high pressure reservoir (61) connected to a plurality of SASO-conduits (62), whose outlets lay on the cylindrical injection-surfaces. The conveyed object—sheet (63)—is suspended within the passage provided between the surfaces, held at equilibrium by the opposite forces exerted on it by the air-cushions from both sides and beneficially implements the "aerodynamic return spring" advantages of the SASO-conduit.

The air is injected through SASO-conduit (62) located on the outer surfaces of two cylinders (63,64), and the inner surface of one semi-cylinder (65). Air beds are generated between the cylindrical surfaces and the moving flexible sheet (66), that could be paper or plastic sheet or any other sheet that needs to be supported without contact. The different between the two supporting systems of FIG. 15 is clear: The supporting cylinder (63) generates aerodynamically induced forces of self-adaptive nature with respect to positioning control, and the aerodynamically induced force is balanced by the sheet tension. The inner cylinder (64) and the outer semi-cylinder (65) that support the sheet in both sizes exhibit similar positioning control character, but in contrast, the balanced position is not significantly affected by the sheet tension, where the balance is achieved by two sided air-cushions.

Another injection system using SASO-conduit to generate aerodynamically induced forces is a multi-directional positioning control system. Such application is, for example, the monorail air-cushion supporting system, shown in FIG. 16*a*. In this application the monorail base (70) supports a carriage (71) that equipped with a high pressure air source (72) and manifolds (73,74). High pressurized air is injected through sets of SASO-conduits (75,76) and air-cushions are generated to support the object that is moving along the monorail and control its position in a two-directional manner. In fact, two injection systems are involved in such a non-contact injection system. The first one is responsible for the vertical positioning. It includes a high pressure manifold (73) and air injection system with SASO-conduits (75) that generate air-cushion to balance the carriage weight. The second injection system is responsible for the horizontal or lateral positioning control, where the air is injected from a designated high pressure manifolds (74), through SASO sets of conduits (76), and generate two opposing air-cushions. These air-cushions serve as aerodynamic positioning control mechanism of self-adaptive manner from both horizontal sides, a similar positioning control situation to the apparatus presented in FIG. 14*a*. Accordingly, the advantages of implementing SASO-technology for non-contact positioning control, are previously discussed.

Figure 16A:
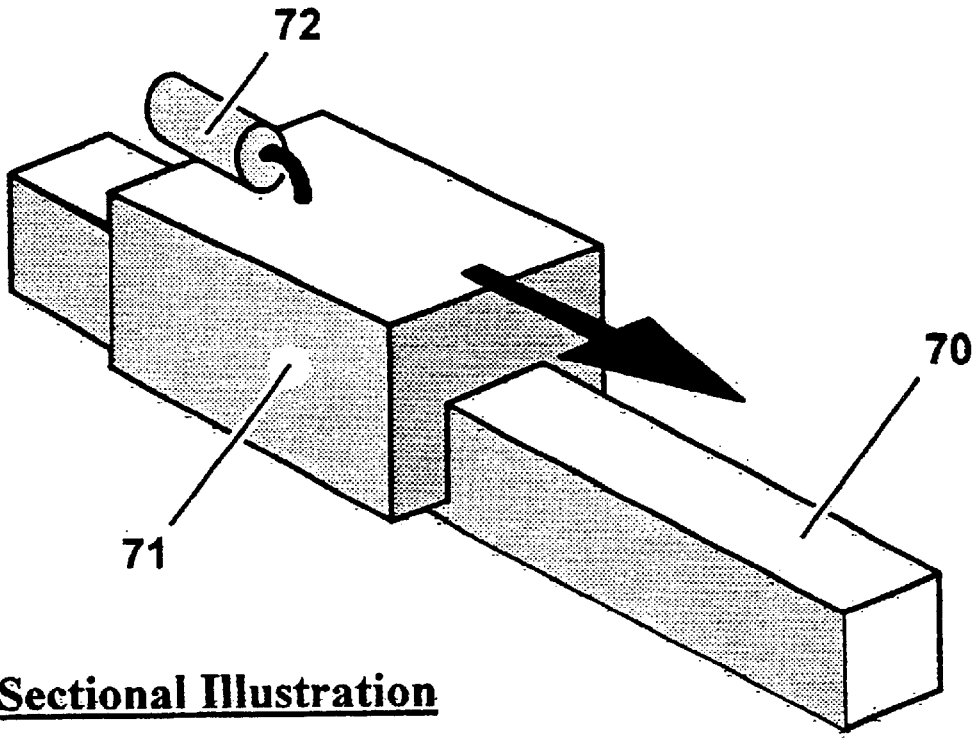
FIG. 16*a* illustrates a monorail application of two-dimensional air-cushions support and control.
Figure 16A:
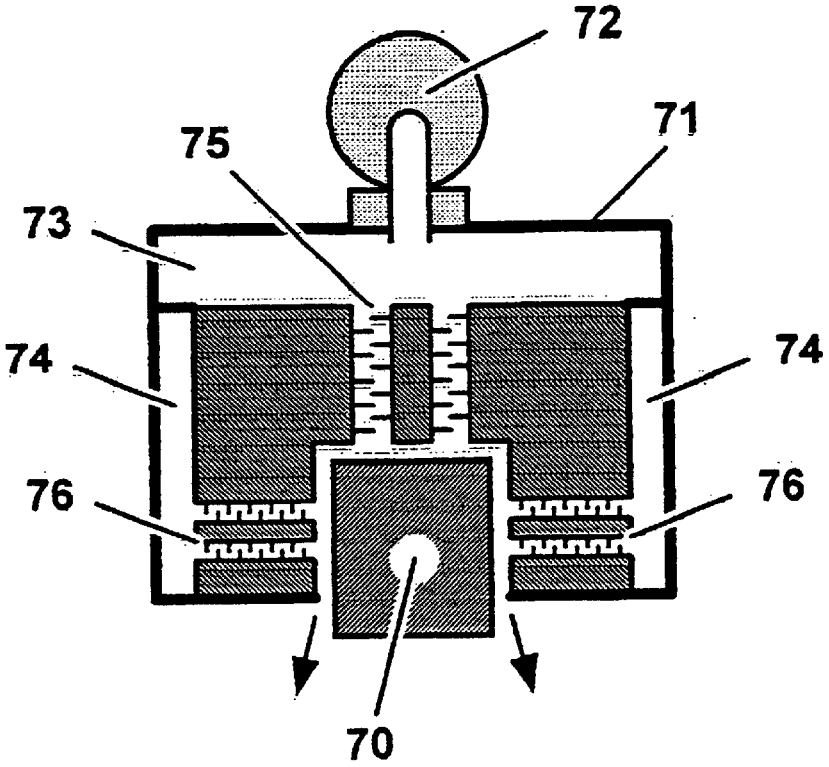
Figure 16B:
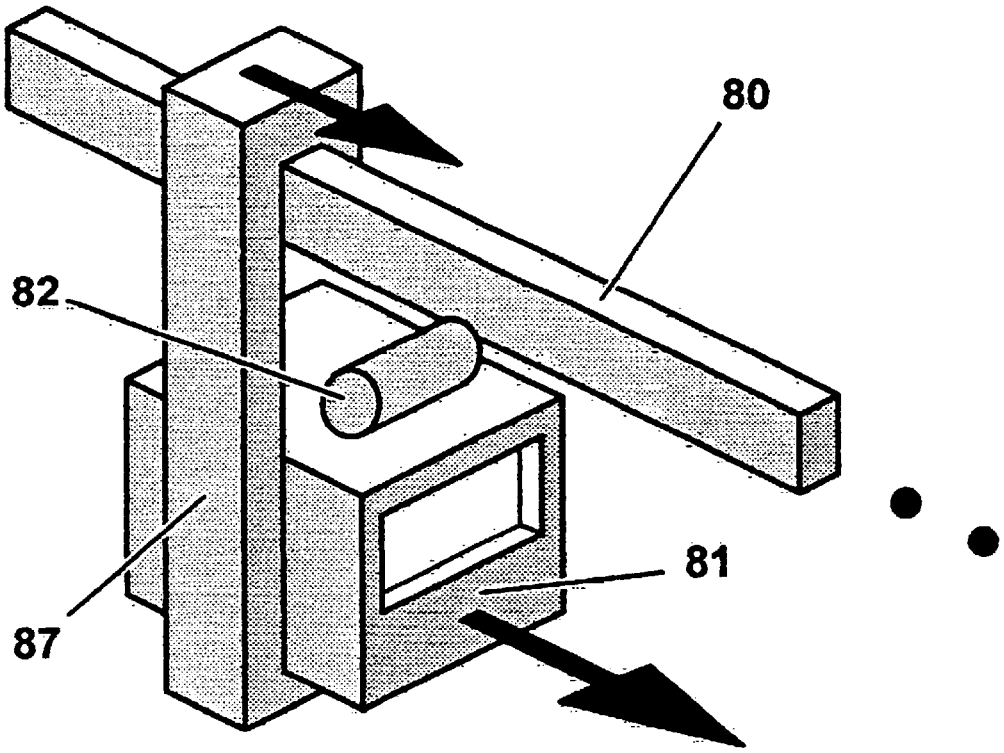
FIG. 16*b* depicts a suspended carriage employing two-dimensional air-cushions support and control.
Figure 16B:
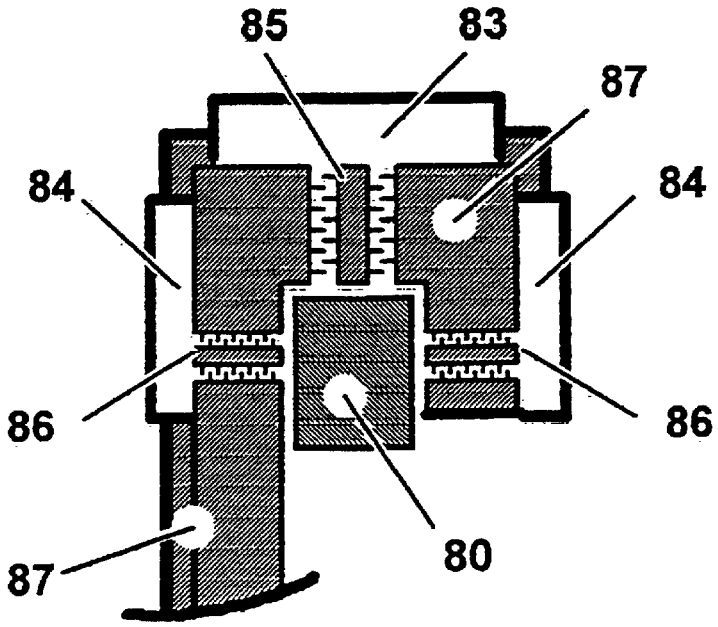

Similar air-cushion injection system is shown in FIG. 16*b*. In this application a hooked carriage (81) supports by a hook (87) to the monorail (80). This injection system, includes a high pressure air source (82) and manifolds (83,84). The high pressure air is injected through sets of SASO-conduits (85,86), in order to generate the air-cushions to support the object that is moving along the monorail and to control its position in a two-directional manner with no contact. All the details given for the previous air-cushion injection system shown in FIG. 16*a*, are also relevant for this SASO-technology application.

Figure 17:
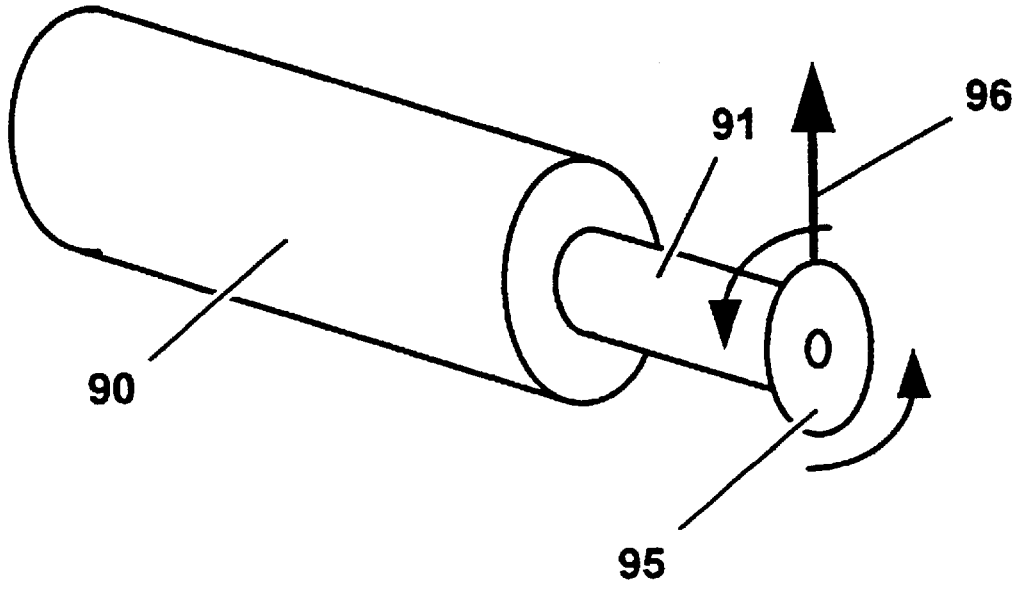
FIG. 17 illustrates an air-spindle based on SASO injection elements.
Figure 17:
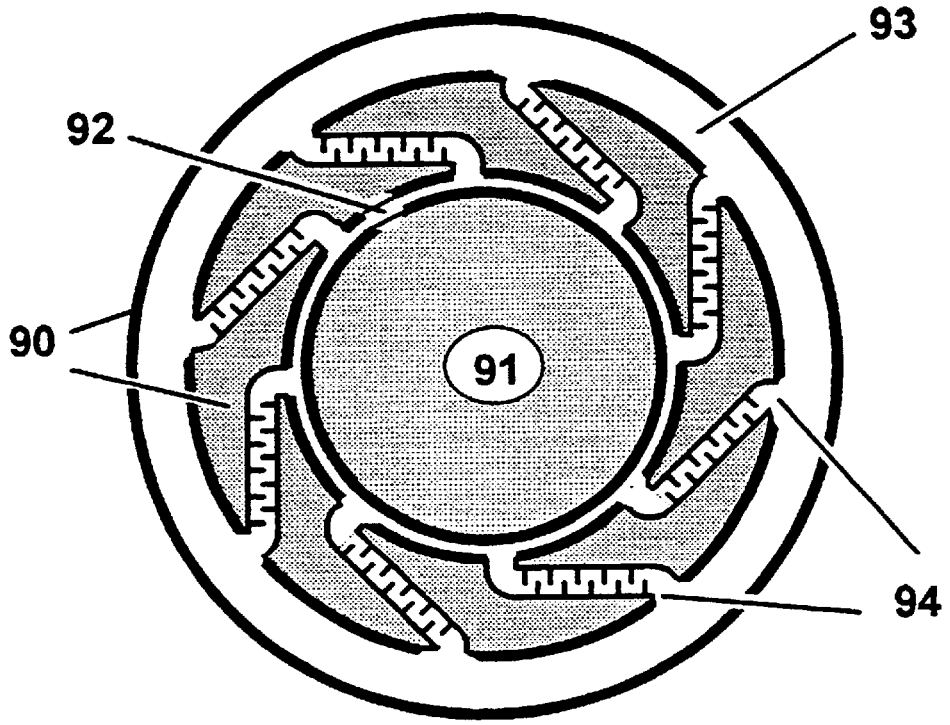

A different application based on high pressure injection can be applied in spindles that use air bearings. A schematic description of such an application can be found in FIG. 17. A rotor component of the spindle (91), rotates in high angular speed, is supported by a thin air-cushion (92), produced by an air injection system in accordance with a preferred embodiment of the present invention. The pressurized air at the high pressure reservoir (93), located within the stator component (90) of the spindle, is injected through a plurality of SASO-conduits (94) connected by their inlets to the high pressure reservoir (93) attached to the stator component. The injected air is issued from the inner cylindrical surfaces of the spindle stator. The spindle rotor usually supports a tool (95) at its end, and as a result, it is subjected to side forces, whose direction is indicated by arrow 96, applied on the tool while rotating. It is important to maintain the radial positioning of the rotor at a very high accuracy of order of η-meter (for example: dicing applications in the semi-conductor industry). Currently known spindles apply a plurality of small diameter conventional injection conduits, that consume high MFR, to achieve an effective "aerodynamic return spring" for controlling the radial positioning in a self-adaptive manner, especially when it is subjected to the side force. As previously mentioned with respect to FIGS. 13 and 14, the SASO aerodynamic return spring effect is superior in comparison with conventional conduits. Therefore the uses of injection system based on SASO-conduits for spindles or similar hydraulic or pneumatic applications, can offer improved positioning accuracy and control characteristics and significantly reduced MFR. Attention is drawn, with respect to air bearing applications, to two additional advantages of using SASO new injection technology: (1) reduced production cost of relatively large conduit that performs as a miniature orifice (as required for micro-metric accuracy needs of radial positioning control), (2) reduced risk of mechanical blockage by contaminants, mainly due to the fact that SASO-conduit physical scale is significantly larger then its "dynamic" scale with respect to fluid injection or MFR.

The implementation of SASO-technology to non-contact support and positioning control, in particular, its "aerodynamic return spring" character, offers significantly improved characteristics of current non-contact injection systems. The above mentioned applications are only a representative review of such SASO-applications. However, the unique characteristics of SASO-technology with respect to injection systems used to generate aerodynamically induced forces, open new opportunities. The Upper Non-contact Gripping (or the UNCG) apparatus, to be describe hereafter, is a selective example of such novel SASO-applications.

Upper Non-Contact Gripping (ANCG)

Figure 18:
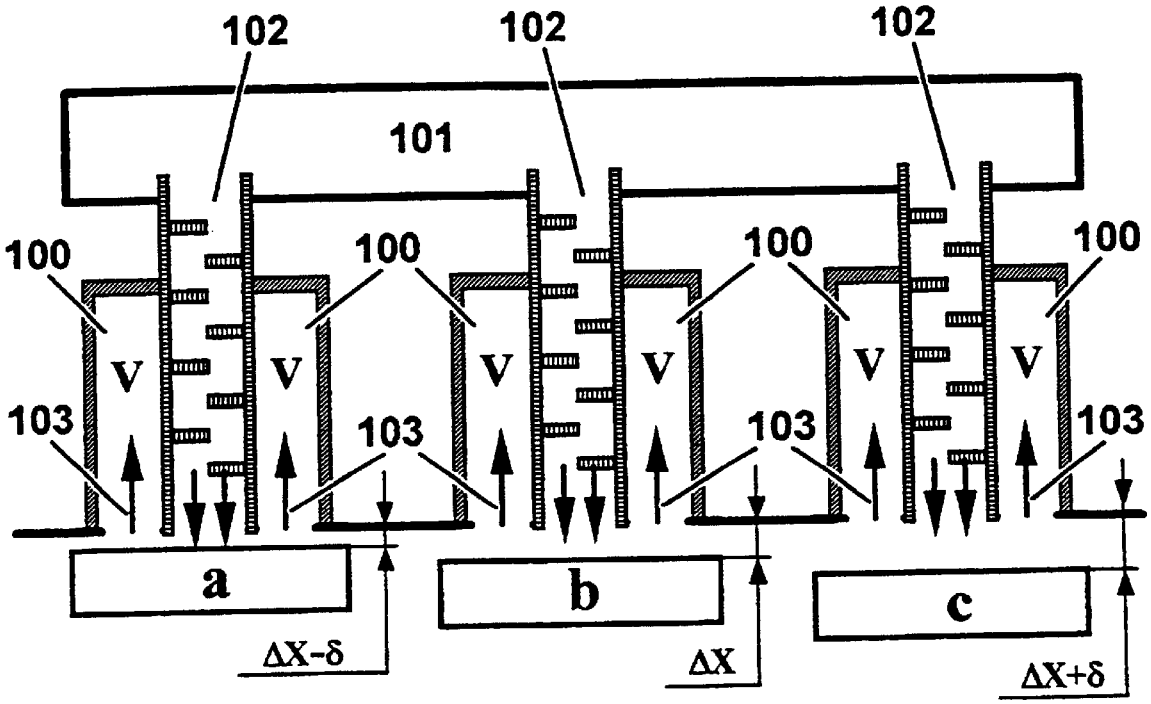
FIGS. 18 & 18*a* show a schematic illustration of an Upper Non-contact Gripping system, based on SASO injection elements.

A different group of applications that implements the novel SASO injection system to generate aerodynamically induced forces, with accordance to the present invention, is the Upper Non-Contact Gripping (or the UNCG) device, as schematically demonstrated in FIG. 18. This application uses two contradictory aerodynamically induced forces: (a) vacuum suction that pulls the object toward the UNCG injection-surface and (b) injection of pressurized air through SASO-conduits that pushes the object away from that injection-surface. FIG. 18 shows an UNCG apparatus, that may serve as a robot arm, in three distinct positions (a,b,c) in respect to the distance from the UNCG injection-surface to the object to be supported. The UNCG has two interlaced manifolds, a vacuum manifold (100) generates a vacuum suction that is applied through one or more conventional vacuum pads (103) to generate the lifting aerodynamically induced force. The opposing aerodynamically induced force, acting in the direction of the gravity, is supplied from a high pressure air manifold (101) that injects air that impinges on the object through one or more SASO-conduits (102). The two contradictory aerodynamically induced forces act simultaneously on the object to be supported with no-contact, and the twin components of the total aerodynamically induced force and the gravity are in equilibrium.

Figure 18A:
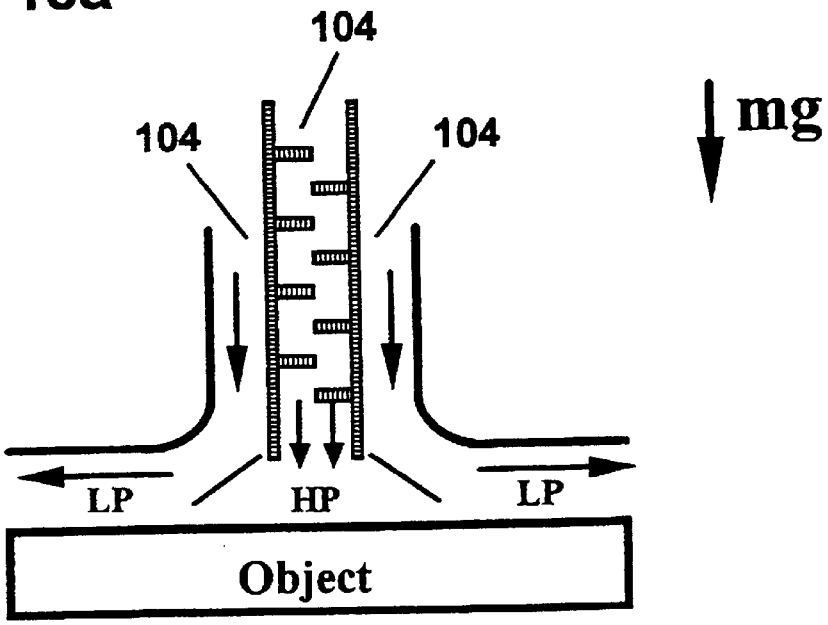

Another alternative to generate a fluidic suction effect can be obtained by using a system (104) that accelerates the air to low static pressure and introduces the accelerated air in parallel to the object surface to generate low pressure (LP) on portion of the object surface, where the rejecting high pressure (HP) aerodynamically induced forces is obtained by injection through SASO-conduits (105) onto other portion of the object's surface, as shown in FIG. 18*a*. Consequently, a similar two contradictory aerodynamically induced forces can be obtained.

Figure 19:
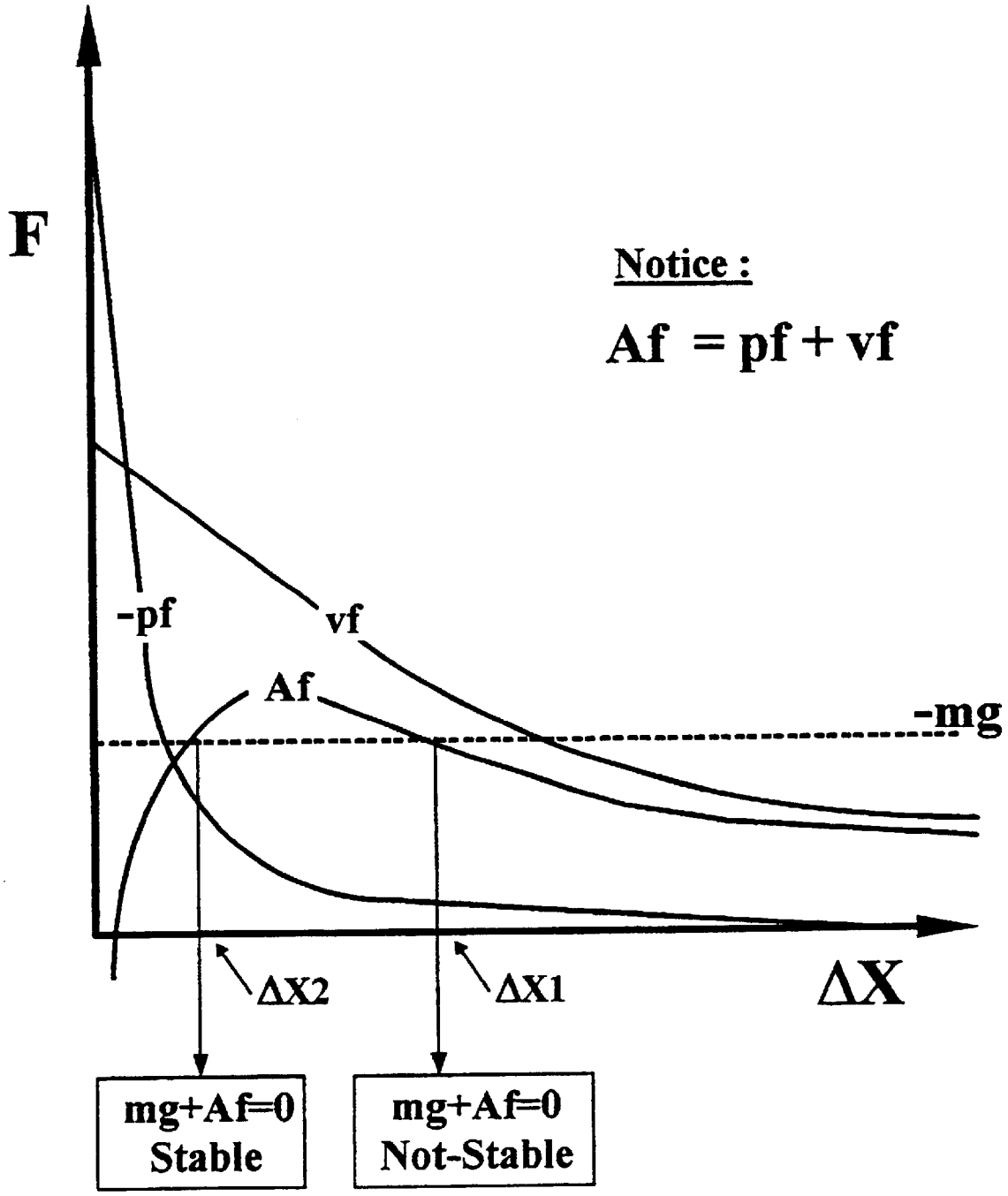
FIG. 19 illustrates the relation between the displacement and force in a SASO based Upper Non-Contact Gripping system, showing the equilibrium positioning as well as the positioning stability.

FIG. 19 illustrates the relation between the displacement—ΔX (the distance from the UNCG injection-surface to the object surface), and the aerodynamically induced forces in a SASO based UNCG system. The lifting aerodynamically induced force that basically balances the gravity is generated by vacuum suction. Relatively speaking (with respect to the injection force), the vacuum suction induced force is characterized by a long range effect as shown in FIG. 19 (curve vf, represents the vacuum force). The contradictory rejecting force, generated by high pressure injection through the SASO-conduit, is characterized by a relatively short range effect, (curve −pf represents the rejecting force, where the sign minus (−) indicates that the force acting in the gravitational force direction, i.e. downwards). The combination of the SASO based injection and the conventional vacuum suction aerodynamically induced forces results in a combined net force, expressed by the curve Af. It has to be emphasized that the injection and the suction pads have adjacent outlets, thus significant mutual interactions affects the combined force Af and must be taken into account.

In the equilibrium state (position "b" in FIG. 18), a balance between the combined force Af and the weight of the object −mg (marked by dashed line in FIG. 19), is obtained. In fact, two equilibrium positions may be achieved from the two UNCG (short and long range) contradictory aerodynamically induced forces, one is unstable and the second one is stable. When the injection-surface of the UNCG system is approaching the object, the long range force induced by vacuum suction is dominant. This force increases as ΔX is reduced and eventually the combined aerodynamically induced force Af balances the object weight at a distance ΔX1 (FIG. 19). Yet, this position is unstable and the object is forced by the vacuum suction to move further towards the UNCG injection-surface thus the combined aerodynamically induced force Af is further increased. As ΔX becomes further smaller, the short range rejecting aerodynamically induced force, generated by high pressure air injection through SASO-conduit, is rapidly increased, thus the combined aerodynamically induced force Af starts to decrease. Eventually a second balanced position ΔX2 (FIG. 19), is reached—this time a stable equilibrium. This positioning stability is exhibited by the following two contradictory effects:

(1) As the abject is slightly set off balance and the gap is decreased by δ (position "a" in FIG. 18), the short range injection force (−pf) is pushing the object back to the (stable) balance position ΔX2 (position "b", FIG. 18).

(2) As the abject is slightly set out of balance and the gap is increased by δ (position "c" in FIG. 18), the long range suction force (vf) is pulling the object back to the same (stable) equilibrium position ΔX2.

The characteristics of the positioning control, of self-adaptive nature, near the stable position ΔX2, is governed mainly by the short range aerodynamically induced force (−pf). The use of SASO-conduits for UNCG systems has a significant superiority over conventional conduits due to the fact that the sensitivity of the combined force (Af) with ΔX (or the gradient dAf/dΔX), is gradually improved. As a result, the Positioning control is improved, by using injection through one or more SASO-conduits. In other words, the stiffed "aerodynamic return spring" nature of the SASO is beneficially implemented in UNCG systems.

By using the UNCG system, the object can be held or conveyed by the combined force (Af), where the object is "floating" and does not come with physical contact with the UNCG injection-surface. It can be for example, a robot arm that holds an object with no contact from its upper side. As long as a UNCG system use injection through one or more SASO-conduits to produce the short range rejecting force, it is covered by the scope of the present invention. Furthermore, as long as SASO-conduits are used, the UNCG system is covered by the scope of the present invention also if any mechanism, fluidic or non fluidic, is implemented to produce the contradictory force that is employed to attract the object. In addition, applications of UNCG systems may involve gravity force but it also may not be related in any sense to gravity, and as long as SASO-conduits are used for injection, the UNCG system is covered by the scope of the present invention.

Figure 20A:
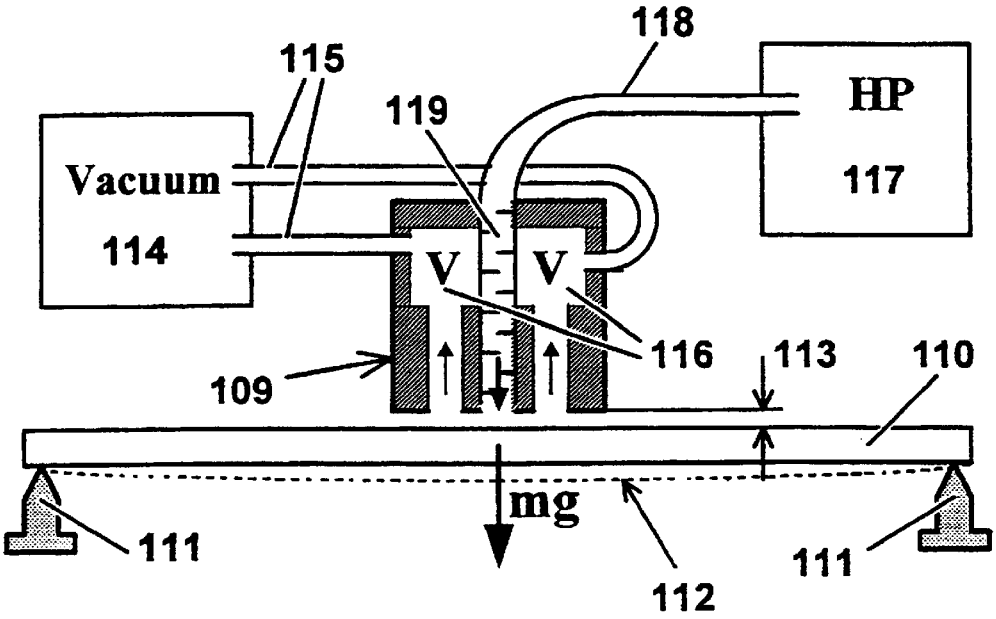
FIGS. 20*a,b* illustrate two example of a SASO based Upper Non-Contact Gripping system holding a wafer or similar object.
Figure 20B:
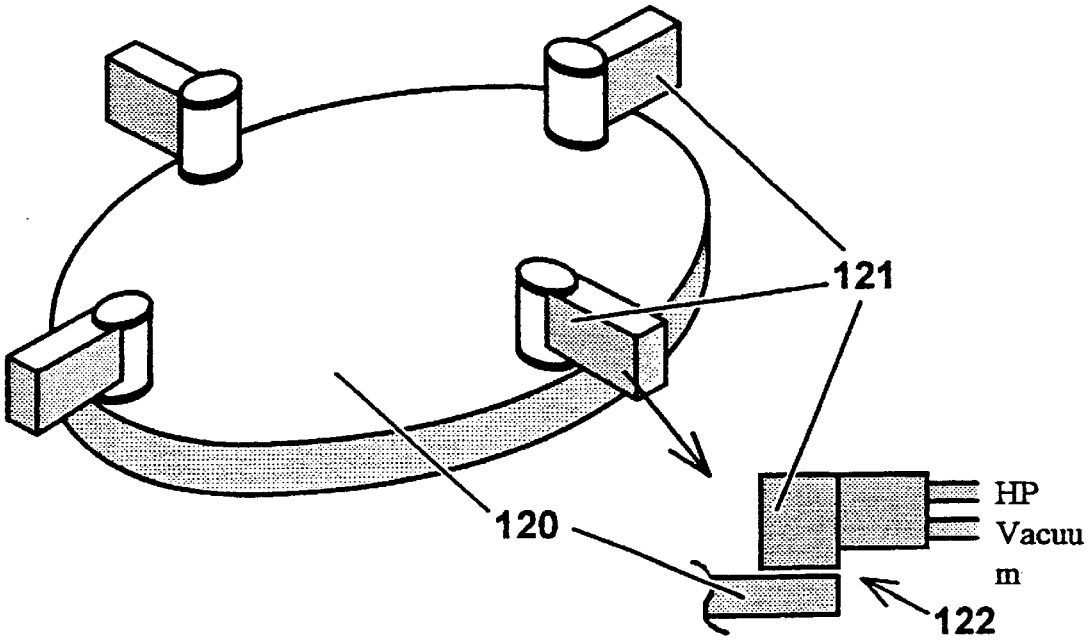

Without derogating generality, a typical UNCG system in accordance with a preferred embodiment of the present invention, is shown in FIG. 20*a*. It is a robot arm that may be applicable in the semiconductor industry to support wafers without having a physical contact with them. A central housing 109 provided with a SASO-conduit (119), connect to a high pressure reservoir (117), and two vacuum ports (116), positioned about said SASO-conduit, on either side of it. A large wafer (110) that is already supported with contact at its edges (111) is supported by the combined aerodynamically induced force to remain flat, preventing its deformation (112) due to its own weight, and maintaining a required positioning (113). The vacuum leg of the UNCG system includes a vacuum source (114), vacuum suction pipelines (115) and one or more conventional suction ports (116). The contradictory injection leg of the UNCG system includes high pressure source (117), high pressure pipelines (118) and one or more SASO injection ports (119). Alternatively, a peripheral UNCG support of such a wafer (120) is suggested in FIG. 20*b*, where four peripheral arms (121) are used to hold the object in a non-contact fashion (122).

Figure 21A:
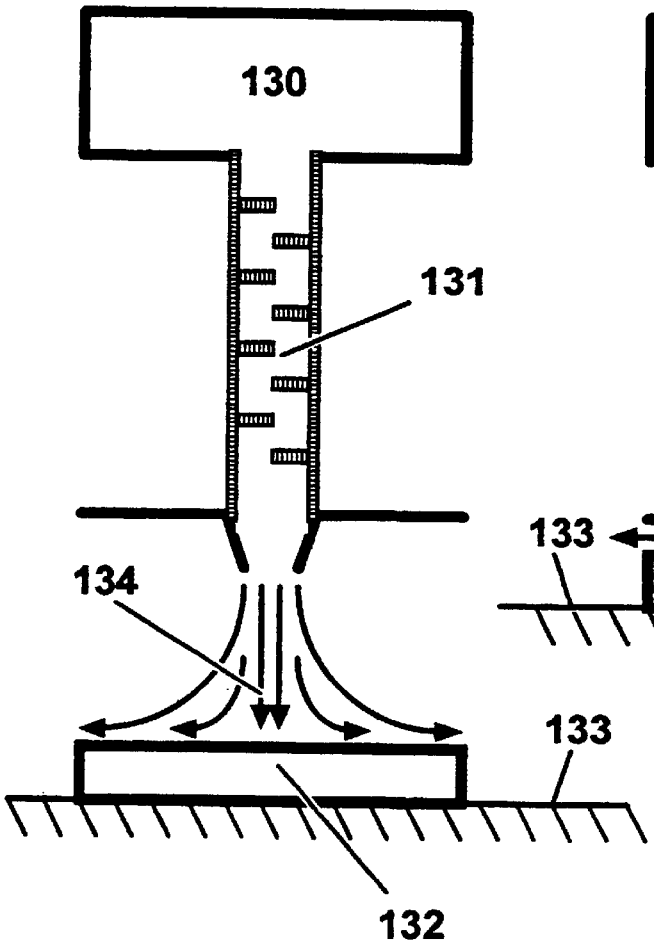
FIG. 21 illustrates the enforcing of an object to contact with a surface by means of a SASO based injection system.
Figure 21B:
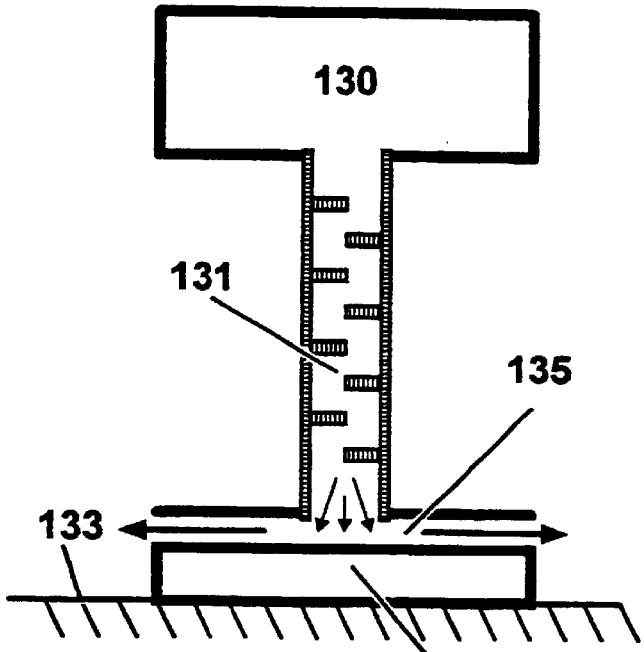

The last example for injection system that produced aerodynamically induced forces, with accordance to a preferred embodiment of the present invention, is a system where one or more SASO-conduits are used to produce forces that holds down an object by high pressure injection on top of it as shown in FIGS. 21*a* and 21*b*. In both cases, the pressurized air from a high pressure source (130) is injected through SASO-conduits (131) towards the object (132) and forced it to attach to the underneath supporting surface (133). In case of FIG. 21*a*, where the distance to the object is relatively large, an impinging jet (134) is forcing the object to attach to the underneath supporting surface (133), and when the distance become small (see (135) in FIG. 21*b*), the SASO aerodynamic blockage effect degrades and high pressure is introduced at the SASO-conduit outlet, thus generating strong force on the object. Both cases are covered by the scope of the present invention as long as SASO-technology is used to enforce the object by injection of air or any other fluid.

It should be emphasized that the injection systems of the present invention, used to generates aerodynamically induced forces, and based on the SASO-technology of the described vortical aerodynamic blockage mechanism, can implement any SASO-conduit variant, where only examples of such variants are illustrated in the Figures.

It should be clear that the description of the embodiments and attached Figures set forth in this specification serves only for a better understanding of the invention, without limiting its scope as covered by the following Claims.

It should also be clear that a person in the art, after reading the present specification could make adjustments or amendments to the attached Figures and above described embodiments that would still be covered by the following Claims.

What is claimed is:

1. An apparatus for controlling a fluid injection and in particular gaseous fluid injection induced forces comprising:

a high pressure source;

a high pressure reservoir fluidically connected to said high pressure source;

an injection surface;

at least one of a plurality of conduits;

wherein the conduit has an outlet positioned on said injection surface and an inlet fluidically connected to said high pressure reservoir and is provided with a plurality of fins mounted on the internal wall of said conduit said fins arranged in two arrays substantially opposite each other;

wherein each of the fins of either one of said fin arrays excluding the fin nearest to the inlet and the fin nearest to the outlet of said conduit is positioned substantially opposite to one of a plurality of cavities each cavity defined between two consecutive fins of one of said arrays of fins and a portion of said conduit internal walls;

whereby when fluid flows through said conduit a plurality of vortices is facilitated within said cavities, each vortex positioned in one at said cavities, said vortices may exist at least temporarily during said flow thus forming an aerodynamic blockage allowing a central core-flow between tips of the fins, thus limiting the mass flow rate and maintaining a substantial pressure drop within the conduit, and when an object blocks said outlet the flow stops and the pressure drop is eliminated thus effectively forcing the object away, and whereas when said object almost blocks said outlet the internal pressure drop through said conduit is substantially increased with respect to a gap between the injection surface and the facing surface of said object thus said conduit acts like a fluidic return spring when injecting from close distance toward an object.

2. The apparatus as claimed in claim 1, wherein said fluid is air.

3. The apparatus as claimed in claim 1, wherein said fins are L-shaped.

4. The apparatus as claimed in claim 1, wherein said fins are U-shaped.

5. The apparatus as claimed in claim 1, wherein said conduit follows a straight path.

6. The apparatus as claimed in claim 1, wherein said conduit follows a tortuous path.

7. The apparatus as claimed in claim 1, wherein said conduit cross-section is substantially rectangular.

8. The apparatus as claimed in claim 1, wherein said conduit cross-section is substantially polygonal.

9. The apparatus as claimed in claim 1, wherein said conduit cross-section is substantially circular.

10. The apparatus as claimed in claim 1, wherein the downstream distribution of said conduit cross-section area is uniform.

11. The apparatus as claimed in claim 1, wherein the downstream distribution of said conduit cross-section area is divergent.

12. The apparatus as claimed in claim 1 wherein the downstream distribution of said conduit cross-section area is convergent.

13. The apparatus as claimed in claim 1, wherein said fins are substantially perpendicular to said internal wall of the conduit.

14. The apparatus as claimed in claim 1, wherein said fins are inclined with respect both to the general core-flow direction of motion and to the conduit internal walls.

15. The apparatus as claimed in claim 1, wherein the average thickness of each of said fins is smaller in order of magnitude than the distance between said fin and the next consecutive fin of the same fin array.

16. The apparatus as claimed in claim 1, wherein the cross-section of the fin is substantially rectangular.

17. The apparatus as claimed in claim 1, wherein the cross-section of the fin is substantially trapezoidal.

18. The apparatus as claimed in claim 1, wherein the cross-section of the fin is substantially concave at least on one side.

19. The apparatus as claimed in claim 1, wherein the distance between two consecutive fins is constant along the conduit.

20. The apparatus as claimed in claim 1, wherein the distance between two consecutive fins varies along the conduit.

21. The apparatus as claimed in claim 1, wherein the span of each of said fins is uniform along the conduit.

22. The apparatus as claimed in claim 1, wherein the span of said fins varies along the conduit.

23. The apparatus as claimed in claim 1, wherein the span of said fin is laterally uniform.

24. The apparatus as claimed in claim 1, wherein the span of said fin laterally varies.

25. The apparatus as claimed in claim 1, wherein the tips of said fins are sharp.

26. The apparatus as claimed in claim 1, wherein the tips of said fins are blunt.

27. The apparatus as claimed in claim 1, wherein the tips of said fins are curved.

28. The apparatus as claimed in claim 1, wherein each of said fins blocks substantially half of the conduit lateral width.

29. The apparatus as claimed in claim 1, wherein the two opposite fin arrays do not overlap.

30. The apparatus as claimed in claim 1, wherein the two opposite fin arrays overlap.

31. The apparatus as claimed in claim 1, wherein the ratio between the fin span and the gap between that fin and a consecutive fin of the same array of fins is in the range of 1:1 to 1:2.

32. The apparatus as claimed in claim 31, wherein the said ratio is about 1:1.5.

33. The apparatus as claimed in claim 1, wherein the absolute value of the gap between the virtual plane connecting the fin tips of one of said two opposite fin arrays and the virtual plane connecting the fin tips of the second of said two opposite fin arrays is smaller in order of magnitude than the lateral width of said conduit.

34. The apparatus as claimed in claim 33, wherein said absolute value of said gap is not more than 20% of the adjacent lateral width of said conduit.

35. The apparatus as claimed in claim 1, wherein the said conduit passive dimension defined as the dimension perpendicular to the flow and to the span of the fins is in the order of magnitude the span of the fins.

36. The apparatus as claimed in claim 35, wherein said passive dimension is substantially larger than the lateral dimension of the conduit.

37. The apparatus as claimed in claim 35, wherein said passive dimension follows a close substantially annular route.

38. The apparatus as claimed in claim 1, wherein said apparatus may be conveyed along a predefined pathway substantially without physical contact by floating over an air cushion generated and controlled by the apparatus.

39. The apparatus as claimed in claim 1, wherein said injection surface defines a predetermined pathway producing an air cushion on which an object may be conveyed substantially without physical contact.

40. The apparatus as claimed in claim 1, wherein it is incorporated with another such apparatus, the apparatuses positioned substantially opposite each other, the injection surfaces defining between them a pathway whereby a substantially flat object may be conveyed between these surfaces substantially without physical contact with the surfaces.

41. The apparatus as claimed in claim 1, wherein some of the plurality of conduits are positioned inclined with respect to said injection surface to induce an aerodynamic conveying force in a predetermined direction.

42. The apparatus as claimed in claim 1, wherein at least two substantially perpendicular injection surfaces are provided to make up substantially non-contact support or positioning control in a two dimensional manner.

43. The apparatus as claimed in claim 1, wherein the injection surface is cylindrically shaped.

44. The apparatus as claimed in claim 1, wherein said injection surface is an inner cylindrical surface of a stator component of a spindle.

45. The apparatus as claimed in claim 1, wherein it is incorporated with another such apparatus, wherein the injection surfaces of said apparatuses are cylindrically shaped and are positioned coaxially so that one external injection surface is concave and the second inner injection surface is convex.

46. The apparatus as claimed in claim 45, wherein the inner cylindrical injection surface is rotatable.

47. The apparatus as claimed in claim 1, wherein one or more of said conduits that produce fluid injection force are combined with at least one of a plurality of vacuum ports that produce fluid suction force in an opposite direction to the fluid injection force, whereby when both injection and suction induced forces are actuated simultaneously the combined force holds the object at a stable equilibrium position and balances the object against its own weight the object suspended in the air without physical contact.

48. The apparatus as claimed in claim 1, wherein a support surface is provided substantially opposite the injection surface so that the fluid injection force may hold an object positioned between the injection surface and the support surface against the support surface.

49. An apparatus for controlling a fluid injection and in particular gaseous fluid injection induced forces comprising:

a high pressure source;

a high pressure reservoir fluidically connected to said high pressure source;

an injection surface;

at least one of a plurality of conduits;

wherein the conduit has an outlet positioned on said injection surface and an inlet fluidically connected to said high pressure reservoir and is provided with a helical fin mounted on the internal wall of said conduit thus a helical cavity is formed defined by said helical fin and said internal wall;

whereby when fluid flows through said conduit a helical vortex is facilitated within said cavity and may exist at least temporarily during said flow thus forming an aerodynamic blockage allowing a central core-flow, thus limiting the mass flow rate and maintaining a substantial pressure drop within the conduit, and when an object blocks said outlet the flow stops and the pressure drop is eliminated thus effectively forcing the object away, and whereas when said object almost blocks said outlet the internal pressure drop through said conduit is substantially increased with respect to the gap between the injection surface and the facing surface of said object thus said conduit acts like a fluidic return spring when injecting from close distance toward an object.

* * * * *